US008796524B1

(12) United States Patent
Deck

(10) Patent No.: US 8,796,524 B1
(45) Date of Patent: Aug. 5, 2014

(54) STRINGED INSTRUMENT IMPROVEMENTS

(76) Inventor: Brent Douglas Deck, Kansas City, KS (US)

( * ) Notice: Subject to any disclaimer, the term of this patent is extended or adjusted under 35 U.S.C. 154(b) by 49 days.

(21) Appl. No.: 13/494,007

(22) Filed: Jun. 11, 2012

Related U.S. Application Data

(63) Continuation-in-part of application No. 13/424,357, filed on Mar. 19, 2012, now abandoned, and a continuation-in-part of application No. 12/842,028, filed on Jul. 22, 2010, and a continuation-in-part of application No. 12/283,668, filed on Sep. 15, 2008, now Pat. No. 8,252,999.

(60) Provisional application No. 61/454,495, filed on Mar. 18, 2011, provisional application No. 61/271,586, filed on Jul. 22, 2009, provisional application No. 60/960,075, filed on Sep. 14, 2007, provisional application No. 61/500,137, filed on Jun. 23, 2011, provisional application No. 61/511,979, filed on Jul. 26, 2011, provisional application No. 61/529,910, filed on Aug. 31, 2011.

(51) Int. Cl.
*G10D 3/00* (2006.01)

(52) U.S. Cl.
USPC ..... 84/313

(58) Field of Classification Search
USPC ..... 84/313
See application file for complete search history.

(56) References Cited

U.S. PATENT DOCUMENTS

| | | | | |
|---|---|---|---|---|
| 1,839,395 A | | 1/1932 | Kauffman | |
| 2,241,911 A | | 5/1941 | Kauffman | |
| 2,741,146 A | | 4/1956 | Fender | |
| 2,949,806 A | * | 8/1960 | Turman | 84/297 R |
| 3,124,991 A | * | 3/1964 | Costen | 84/267 |
| 3,411,394 A | | 11/1968 | Jones | |
| 3,580,124 A | | 5/1971 | Mancini | |
| 4,285,262 A | | 8/1981 | Scholz | |
| 4,397,212 A | | 8/1983 | Carson | |
| 4,481,854 A | | 11/1984 | Dugas | |
| 4,576,080 A | | 3/1986 | McLellan | |
| 4,648,304 A | * | 3/1987 | Hoshino et al. | 84/313 |
| 4,658,693 A | | 4/1987 | Hennessey | |
| 4,704,936 A | | 11/1987 | Steinberger | |
| 4,782,732 A | | 11/1988 | Kato et al. | |
| 4,903,568 A | | 2/1990 | Itoh | |

(Continued)

FOREIGN PATENT DOCUMENTS

| | | |
|---|---|---|
| CA | 1295494 | 2/1992 |
| CA | 2077736 | 9/1994 |

(Continued)

OTHER PUBLICATIONS

U.S. Appl. No. 11/776,783, filed Jul. 12, 2007, Steinberger, Fig 5b.

(Continued)

*Primary Examiner* — Robert W Horn

(57) ABSTRACT

This disclosure relates to improvements to a stringed musical instrument, and to guitar embodiments for use with transposing and non transposing vibrato mechanisms.

Vibrato devices for guitars are known. The device and method disclosed improve the ability to of a player to bend entire chords in a manner that maintains harmonic relationship between individual strings.

The disclosure also includes improved manual controls and means to extend the transposing range of such a vibrato device.

23 Claims, 60 Drawing Sheets

(56) References Cited

U.S. PATENT DOCUMENTS

| | | | | |
|---|---|---|---|---|
| 4,939,971 | A | 7/1990 | Satoh | |
| 4,951,543 | A | 8/1990 | Cipriani | |
| 4,955,275 | A | 9/1990 | Gunn | |
| 5,038,657 | A | 8/1991 | Buseley | |
| 5,088,374 | A | 2/1992 | Saijo | |
| 5,140,884 | A * | 8/1992 | Bowden | 84/312 R |
| 5,194,679 | A | 3/1993 | Cohen | |
| 5,198,601 | A | 3/1993 | McCabe | |
| 5,419,227 | A | 5/1995 | Lavineway | |
| 5,551,329 | A | 9/1996 | Iovane | |
| 5,672,835 | A | 9/1997 | Doughty | |
| 5,747,713 | A * | 5/1998 | Clement | 84/313 |
| 5,824,925 | A | 10/1998 | Yost | |
| 5,965,831 | A | 10/1999 | McMabe | |
| 5,986,190 | A | 11/1999 | Wolff et al. | |
| 6,100,459 | A | 8/2000 | Yost | |
| 6,175,066 | B1 | 1/2001 | McCabe | |
| 6,825,406 | B2 | 11/2004 | Thidell | |
| 6,875,911 | B2 * | 4/2005 | Schryer | 84/313 |
| 6,891,094 | B2 | 5/2005 | McCabe | |
| 6,989,483 | B2 | 1/2006 | Ramsay | |
| 7,189,908 | B2 | 3/2007 | Lavineway | |
| 7,259,309 | B1 * | 8/2007 | Lovelace et al. | 84/313 |
| 7,304,232 | B1 | 12/2007 | Nicholes | |
| 7,339,102 | B2 * | 3/2008 | Folmar et al. | 84/313 |
| 7,479,592 | B1 | 1/2009 | Slavik | |
| 7,696,420 | B2 | 4/2010 | Thompson | |
| 2006/0179998 | A1 | 8/2006 | Sperzel | |

FOREIGN PATENT DOCUMENTS

| | | |
|---|---|---|
| WO | PCT/US1996/012315 | 7/1996 |
| WO | PCTUS2004/043599 | 8/2005 |
| WO | PCTUS2008/053910 | 2/2008 |
| WO | PCT US2010/27736 | 1/2011 |

OTHER PUBLICATIONS

U.S. Appl. No. 12/283,668, filed Mar. 18, 2011, Deck, Parent of current CIP.

U.S. Appl. No. 12/842,028, filed Feb. 17, 2011, Deck, Parent of current CIP.

* cited by examiner

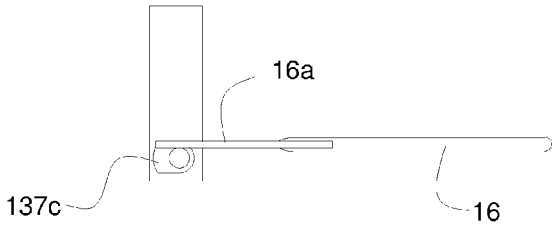
Fig 11D
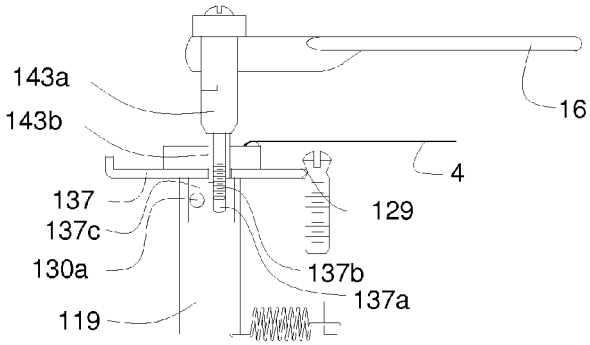
Fig 11E
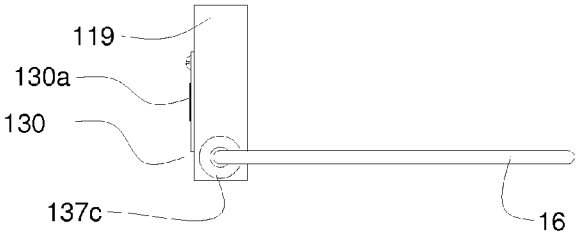
Fig 11F
Fig 11G
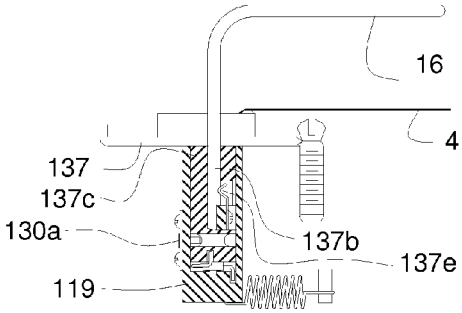
Fig 11H
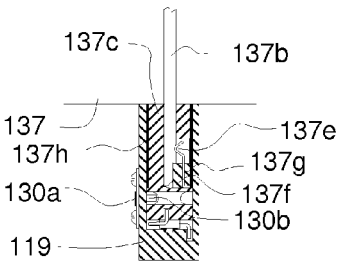
Fig 11J
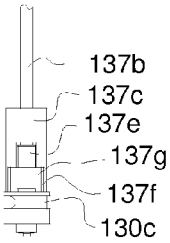

Fig 13
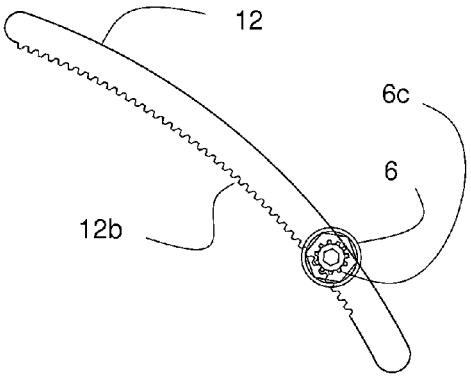
Fig 14A
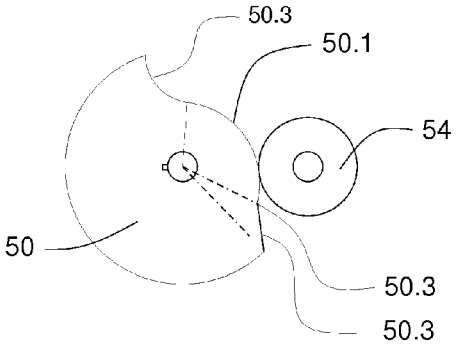
Fig 14B
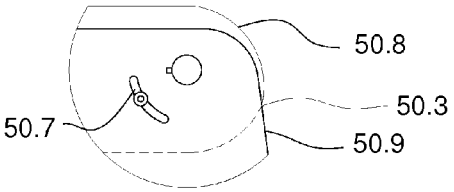
Fig 14C
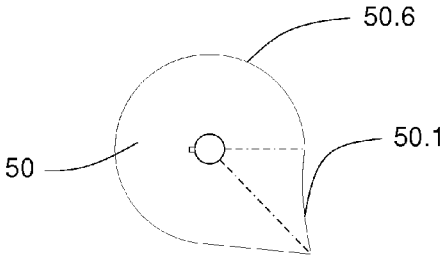
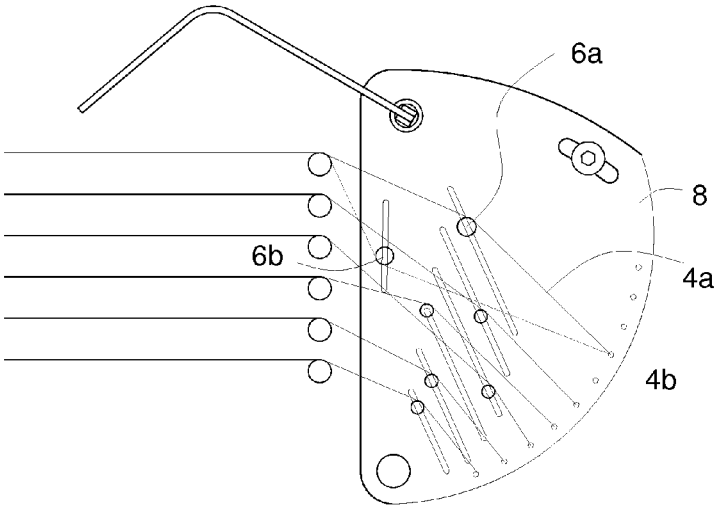
Fig 15

Fig 16D
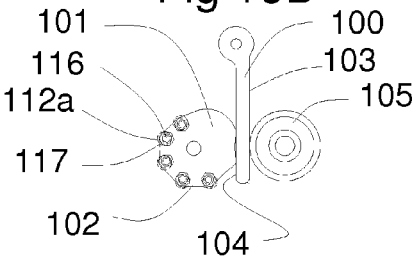
Fig 16E
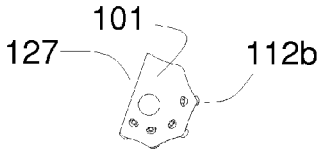
Fig 16F
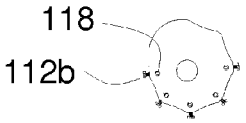
Fig 16G
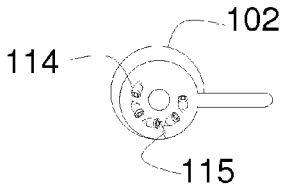
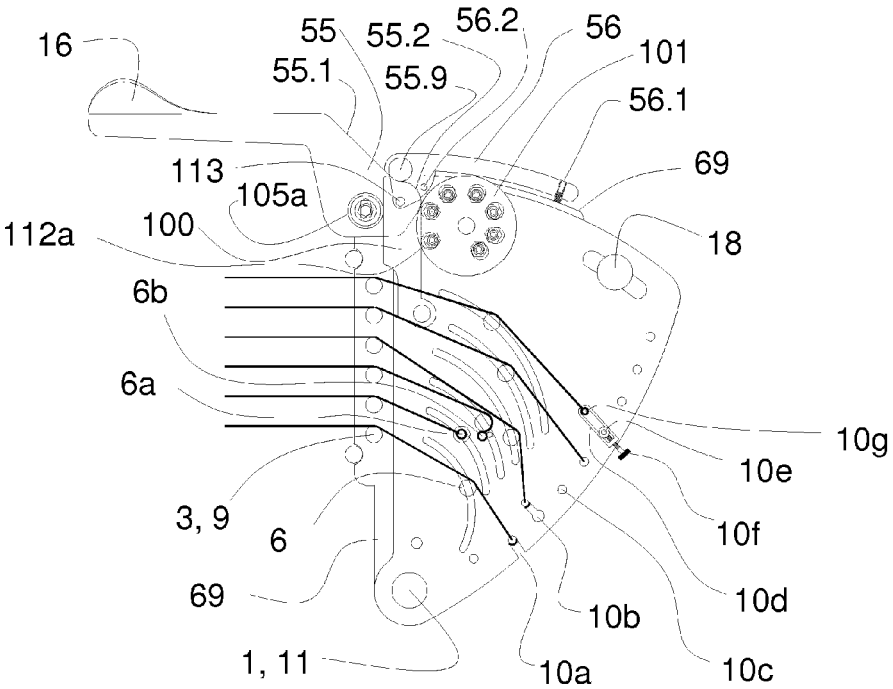
Fig 16H Fig 31A
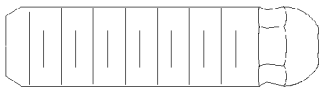
Fig 31B
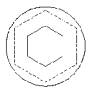
Fig 31C
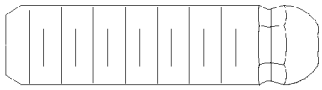
Fig 31D
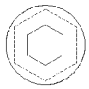
Fig 31E
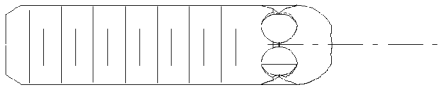
Fig 31F
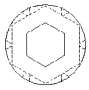
Fig 31G
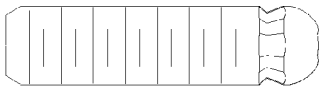
Fig 31H
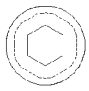
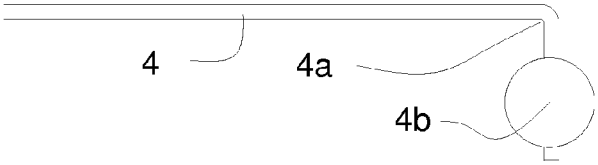
Fig 31J
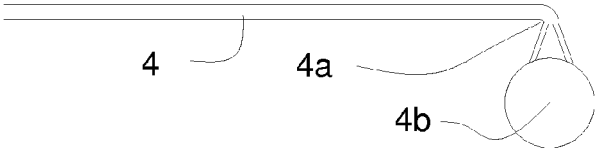
Fig 31K
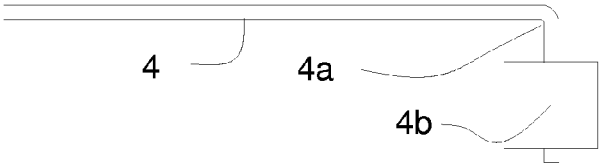
Fig 31L
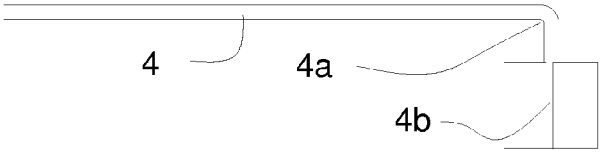
Fig 31M

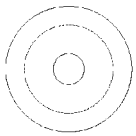
Fig 32A
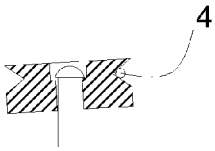
Fig 32D
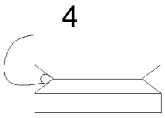
Fig 32B
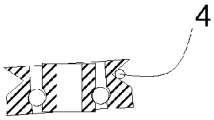
Fig 32C
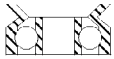
Fig 32E
Fig 32F
Fig 32G
Fig 32H
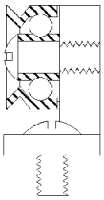
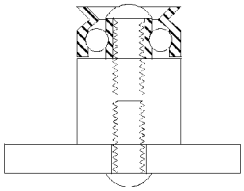
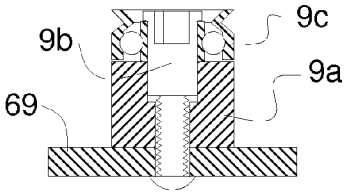
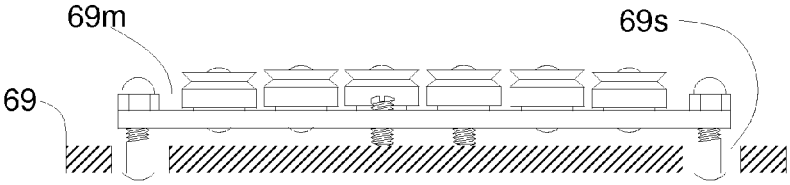
Fig 33A
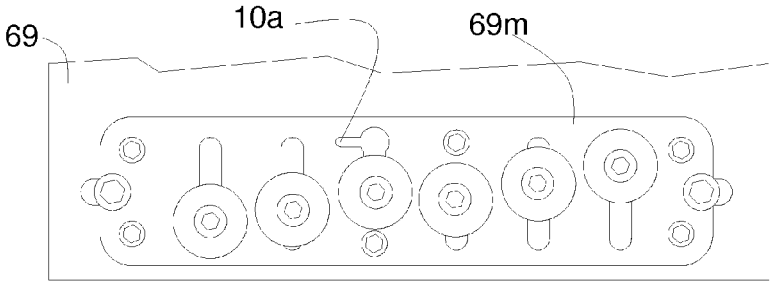
Fig 33B Fig 34R
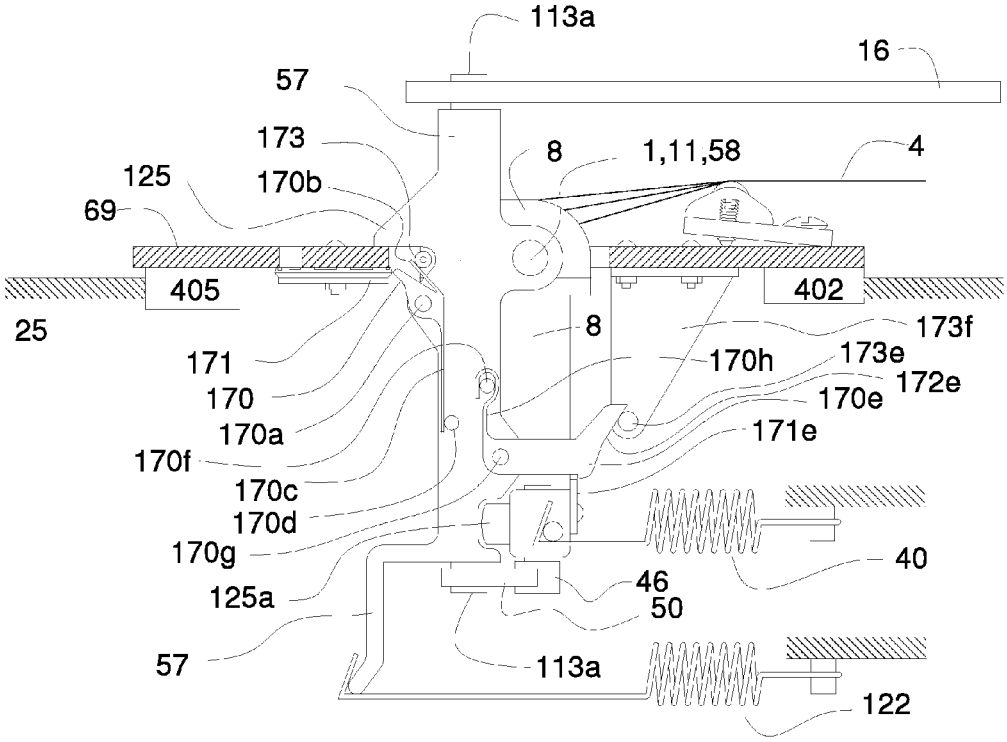
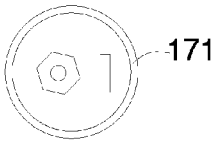
Fig 34S
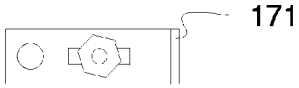
Fig 34T

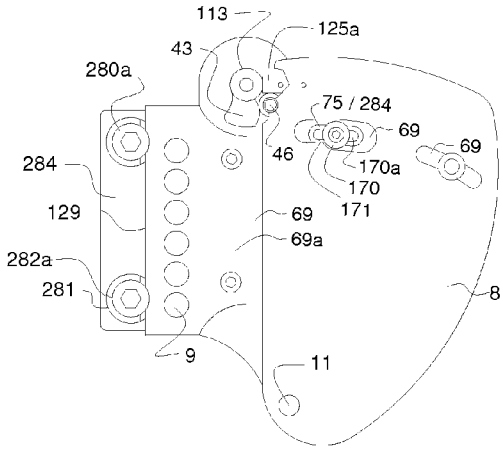
Fig 35A
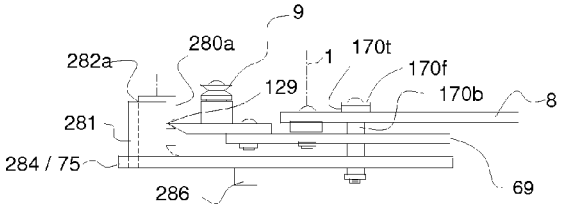
Fig 35B
Fig 35C
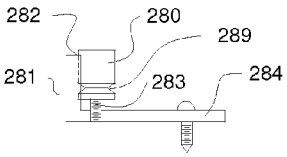
Fig 35D
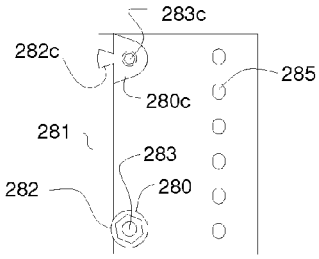
Fig 35E
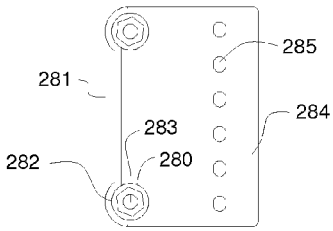
Fig 35F
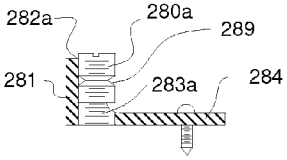
Fig 35G
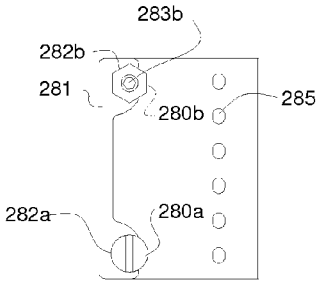
Fig 35H
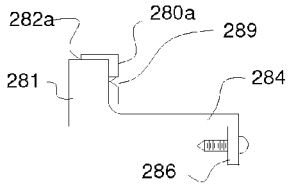

STRINGED INSTRUMENT IMPROVEMENTS

This application is a continuation in part of U.S. non-provisional application Ser. No. 13/424,357 filed Mar. 19, 2012 now abandoned by the present applicant, which claimed priority to U.S. provisional application 61/454,495 filed Mar. 18, 2011 by the same applicant.

This application is a continuation in part of U.S. non-provisional application Ser. No. 12/842,028 filed Jul. 22, 2010 by the present applicant, which claimed priority to U.S. provisional application 61/271,586 filed Jul. 22, 2009 and to PCT application U.S. Ser. No. 10/27,736 filed Mar. 17, 2010.

This application is a continuation in part of U.S. non-provisional application Ser. No. 12/283,668 filed Sep. 15, 2008 now U.S. Pat. No. 8,252,999 by the present applicant, which in turn claimed priority to U.S. provisional application 60/960,075 filed Sep. 14, 2007.

This application claims priority to U.S. provisional application 61/500,137 filed Jun. 23, 2011 by the same applicant.

This application claims priority to U.S. provisional application 61/511,979 filed Jul. 26, 2011 by the same applicant.

This application claims priority to U.S. provisional application 61/529,910 filed Aug. 31, 2011 by the same applicant.

The disclosure of this application incorporates by reference the entirety of said application Ser. Nos. 12/283,668 and 12/842,028.

The disclosure of this application is also supplemented by incorporation by reference to every claim previously submitted during prosecution of the each said applications incorporated by reference.

Said incorporation by reference shall supplement the present disclosure without in any way limiting the scope or meaning of the disclosure or claims of the present application or subsequent applications.

In the event that a present figure shares the same designation as one incorporated by reference, or if no figure submitted bears a designation matching a reference in the present text, then the most recently submitted figure bearing the proper designation shall be relied upon with regard to a reference in the present text.

FIELD OF INVENTION

The present invention relates to devices which enhance the expressive qualities of a stringed musical instrument by empowering the artist to "bend" notes and chords in a harmonic manner.

SUMMARY

The application discloses various embodiments having guides adjustably fixed relative to a pivoting tailpiece, causing the strings to be stretched or relaxed when the tailpiece is rotated, enabling maintenance of relative pitch among strings.

The application discloses dual axis control, enabling a musician to sweep easily from "bend" to "dive" (sharp to flat) while using the muscles on only one side of the hand and wrist. Dual axis control further allows biasing a tailpiece against a separate stop on a separate axis after either a bend or a dive, with enhanced stability at neutral pitch, and requiring no locking mechanism.

The application discloses various embodiments of a cam-enabled return spring to maintain neutral tuning when the device is released without adversely affecting motion of the device.

Embodiments also include a beneficial combination of pitch-relative and non-pitch-relative vibrato means, where a non-pitch-relative vibrato displacement may be used to compensate for non-linearities in string tension while transposing over large spans.

Also disclosed are various embodiments enabling improved electronic control, improved limitation on string stress, improved float about a neutral position, improved flex compensation, improved string anchoring, improved fulcrum support, and improved bending means for individual strings.

DRAWINGS

Letters I and O are omitted from figure designations in the interest of clarity.

Figure 5A:
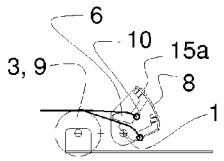
FIG. 5A is a side view of a vibrato mechanism with rotational axis parallel to bridge where combined string guide and anchor are suspended within an arcuate shell.
Figure 5B:
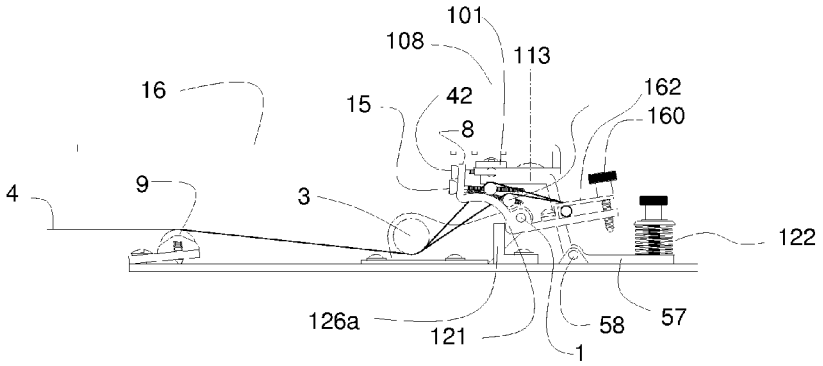
FIG. 5B is a side view of a vibrato mechanism having a string guides supported on a slotted arcuate main member.
Figure 5C:
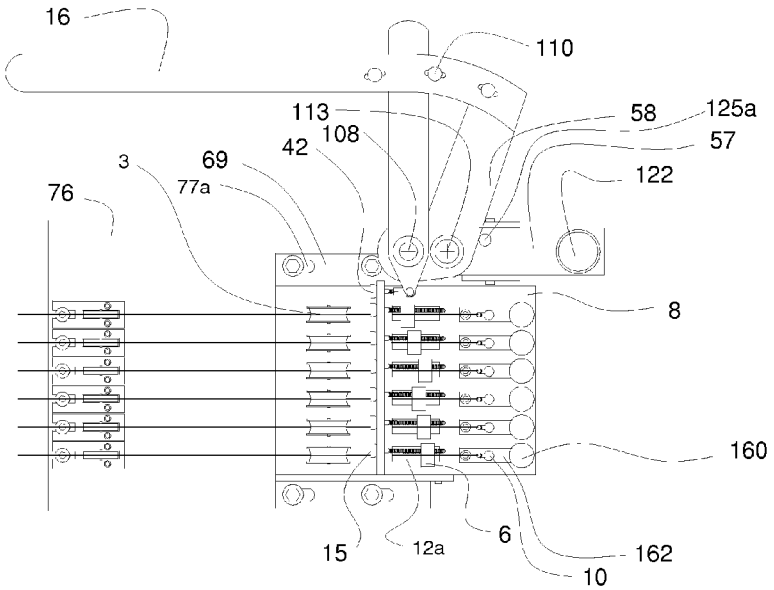
FIG. 5C is a top view the mechanism of FIG. 5B, and further showing schematic transposing means attached to control arm.
Figure 5D:
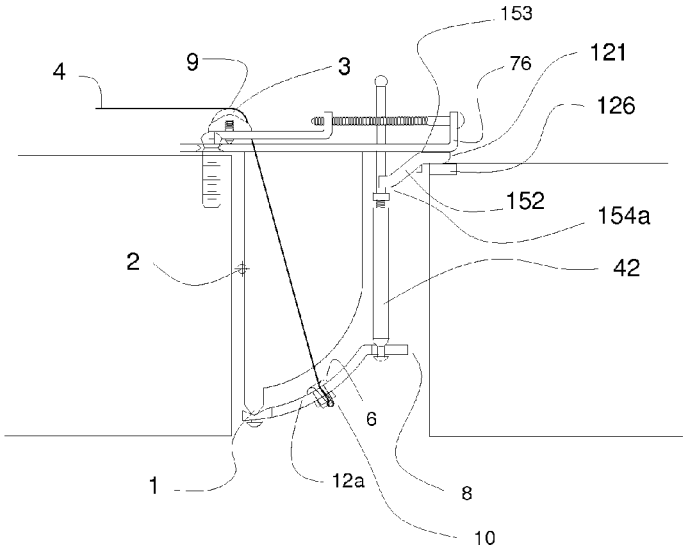
Figure 5E:
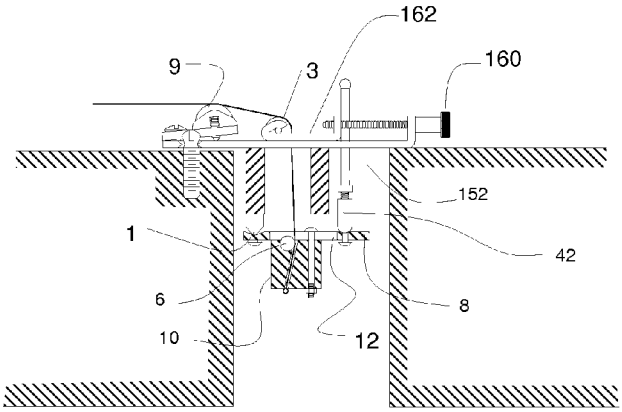
Figure 5F:
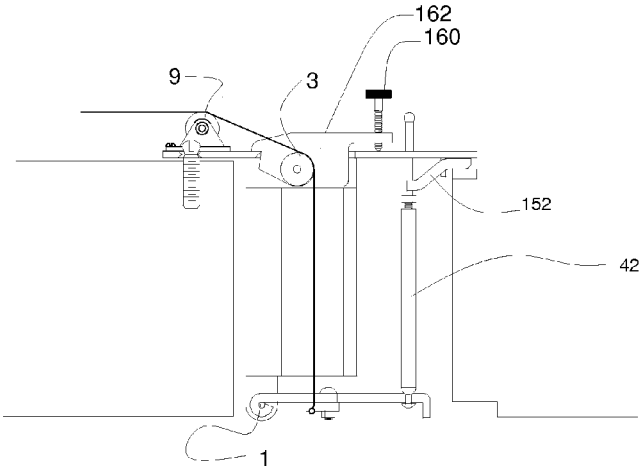

FIGS. 5D, 5E, and 5F are side views of vibrato devices having main rotating member displaced from string plane, sans control means illustration.

Figure 6A:
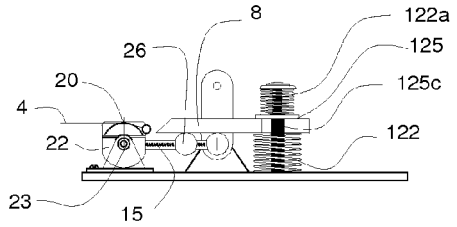
Figure 6B:
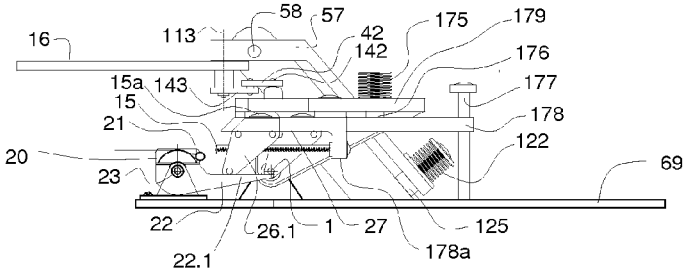

FIGS. 6A and 6B are side views of a vibrato devices having variable length actuator cranks engaging ball receiver crank arms.

Figure 6C:
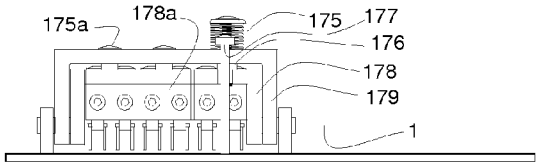

FIG. 6C is a rear view of the device depicted in FIG. 6B, sans control arm, dive transport, and bias spring means.

Figure 6D:
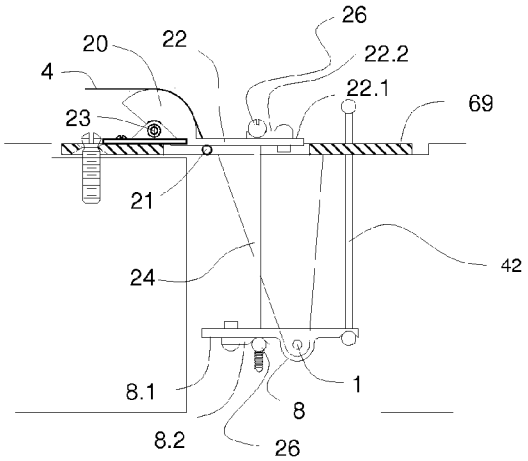

FIG. 6D is a side view of a vibrato device having a variable length actuator cranks displaced from string plane, sans control means illustration.

Figure 6E:
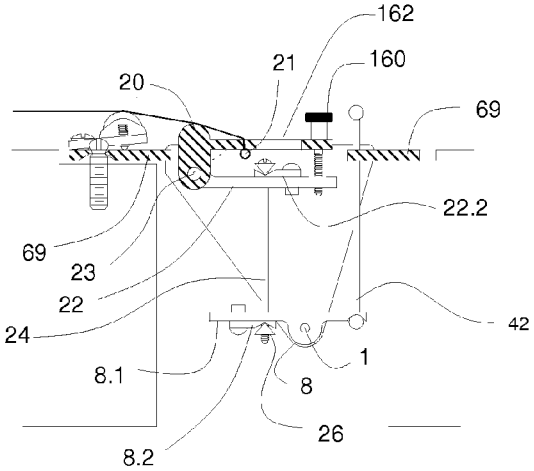

FIG. 6E is a side view of a vibrato device having a variable length actuator cranks and fine tuning means.

Figure 7:
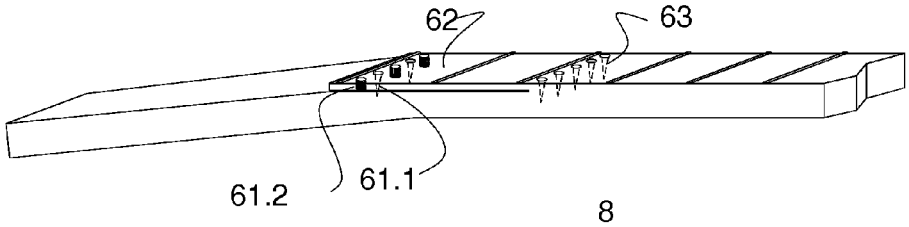
Figure 8A:
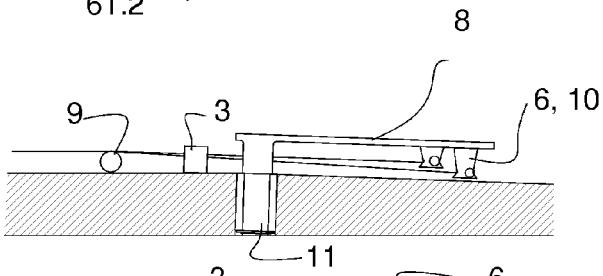
Figure 8B:
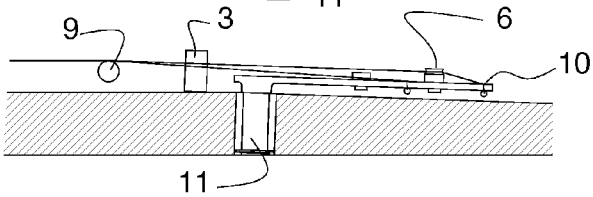
Figure 8C:
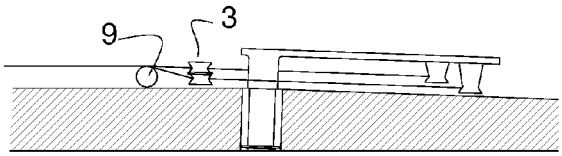
Figure 8D:
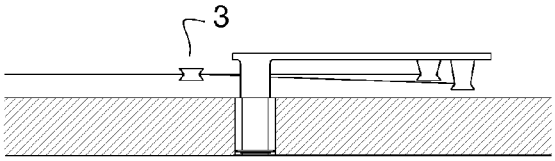
Figure 8E:
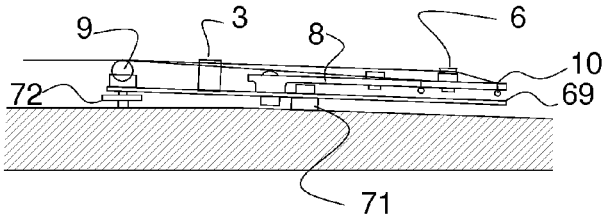
Figure 8F:
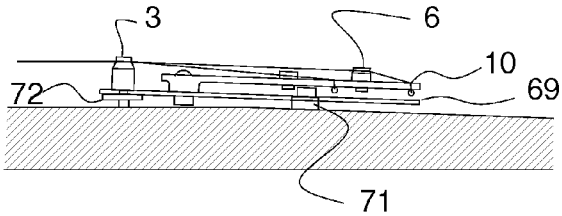

FIG. 7 is a perspective view of a composite neck having adjustable zero fret.

FIG. 8A through 8F are side views of a flat plate tailpiece with axis perpendicular to string plane and body.

Figure 9A:
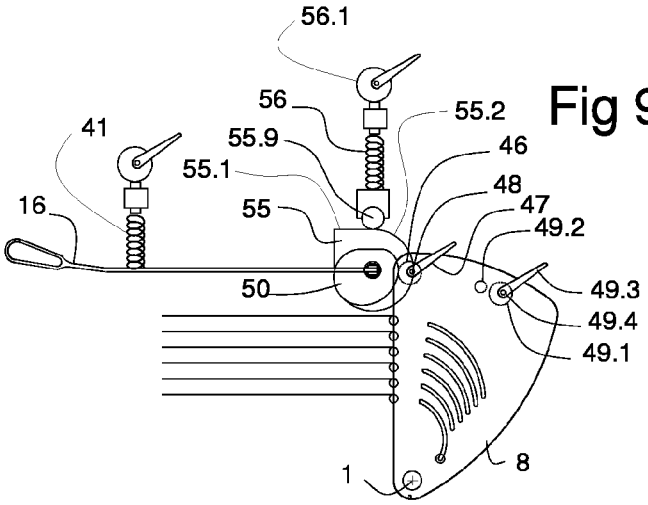
Figure 9B:
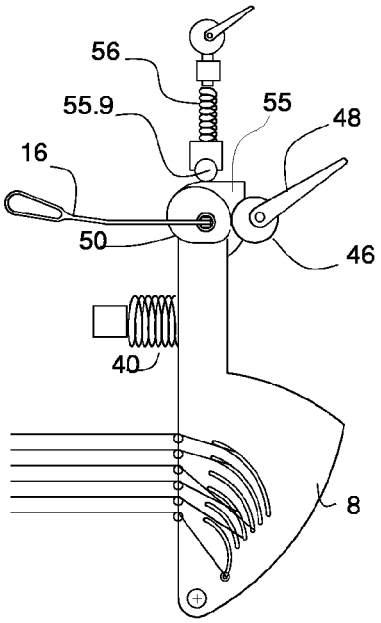
Figure 9C:
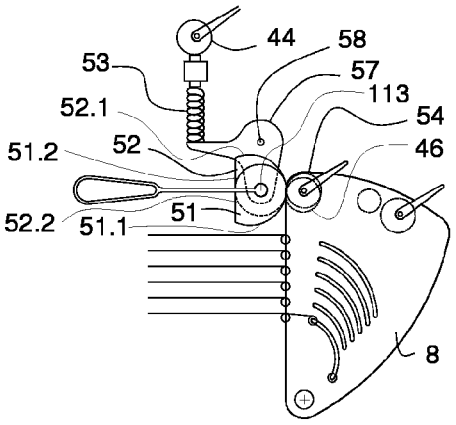

FIG. 9A through 9C are schematic top views of various control cam and return spring configurations on a flat plate vibrato tailpiece.

FIGS. 9A, 9B, and 9C show a face view of a flat plate configuration of various cam embodiments.

Figure 10A:
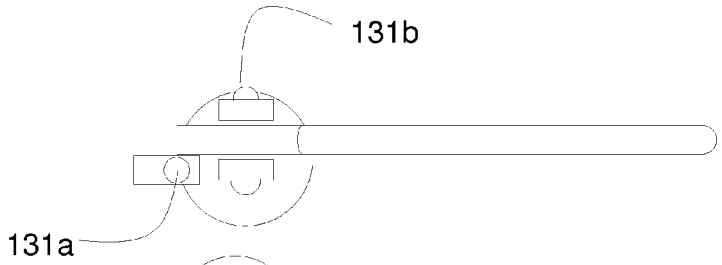
Figure 10B:
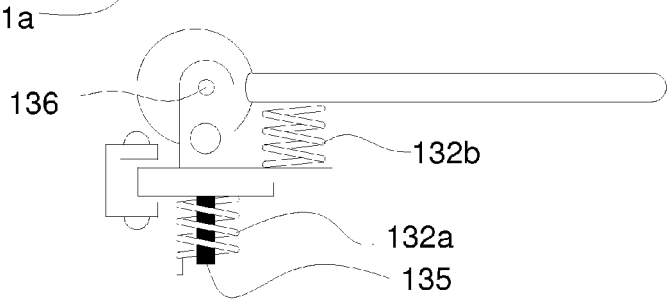

FIGS. 10A and 10B are top and side views of a control arm having electronic sensors measuring displacement about two axes.

Figure 10C:
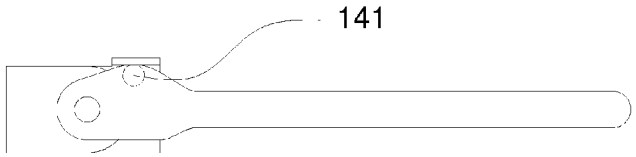
Figure 10D:
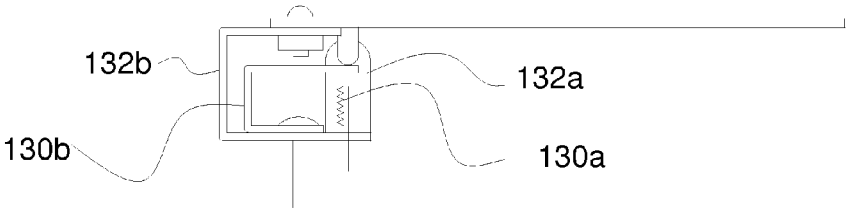

FIGS. 10C and 10D are top and side views of a control arm having electronic sensors measuring torque about two axes.

Figure 10E:
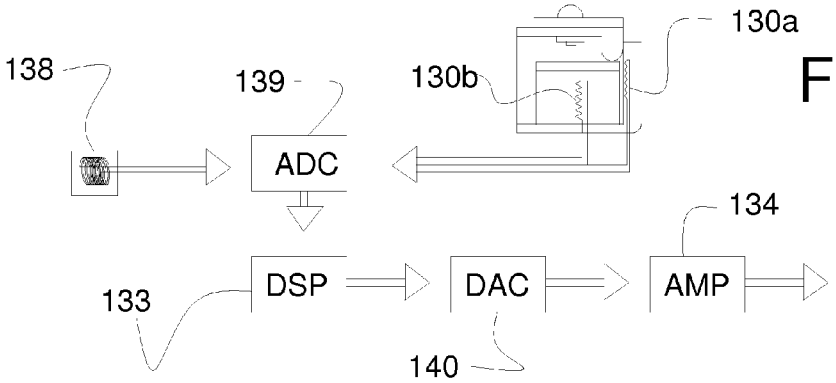

FIG. 10E is a flow chart of a digital processing circuit for an electronic vibrato arm.

Figure 10F:
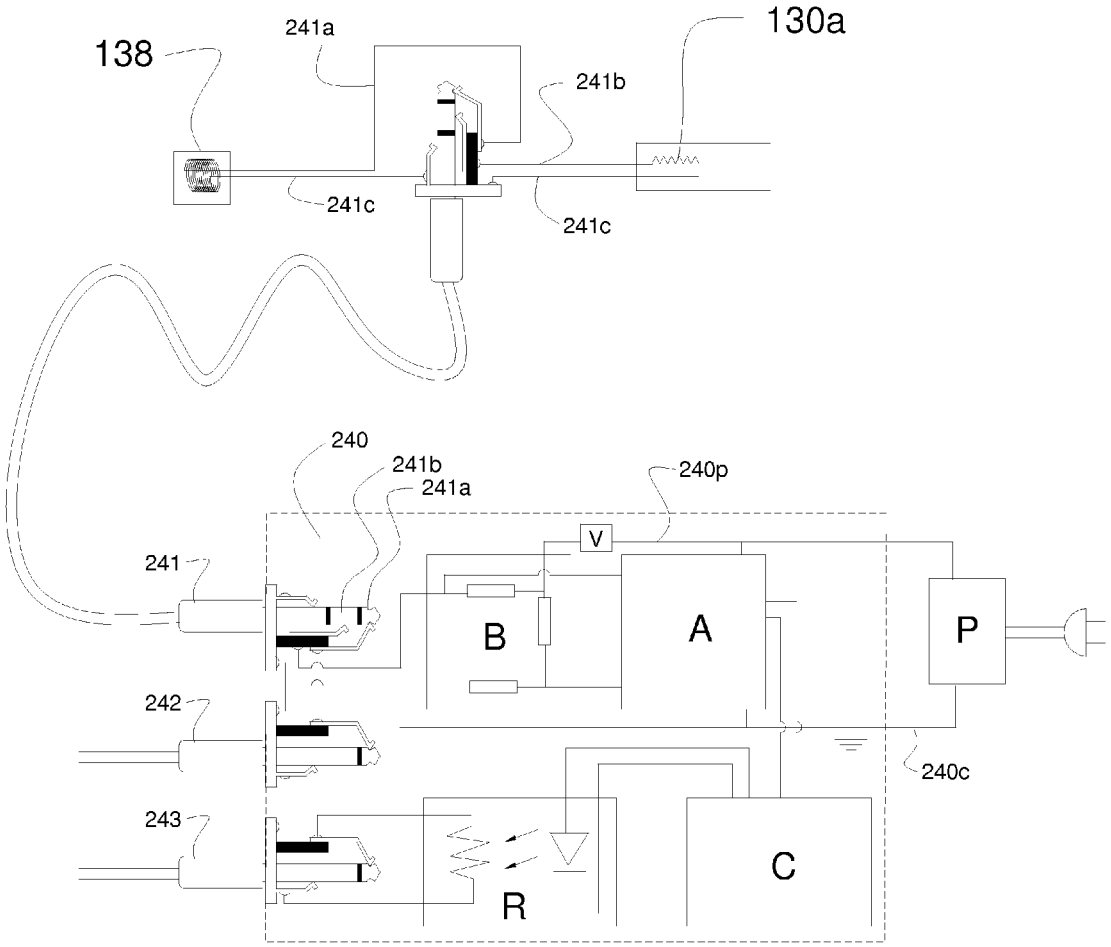

FIG. 10F is a schematic of an example of a control circuit using 3 conductor cable to feed an amplified sensor output to an external device (for example a commercial effects processor).

Figure 10G:
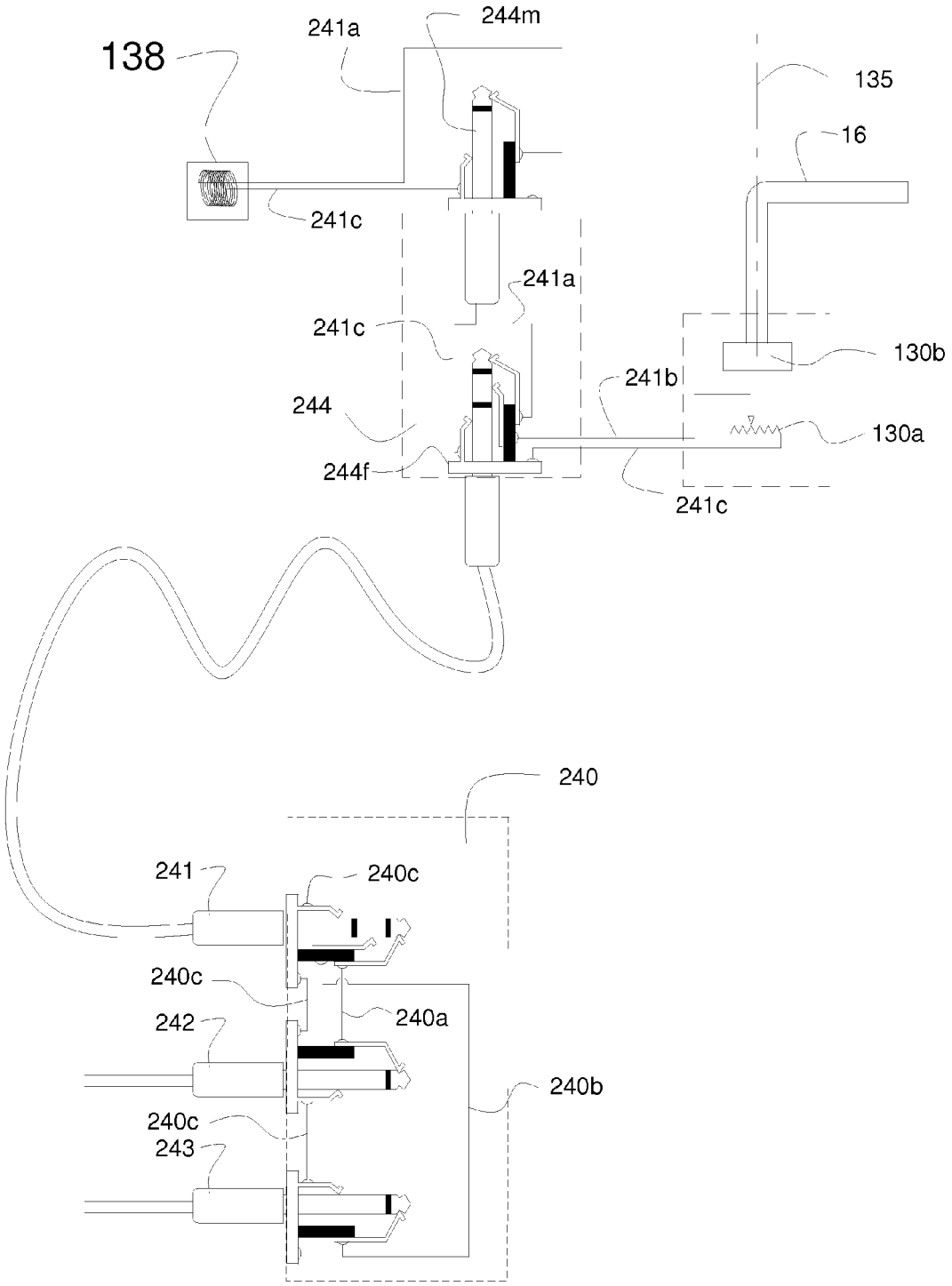

FIG. 10G is a schematic of an example of a control circuit using 3 conductor cable to feed a potentiometer output to an external device.

Figure 10H:
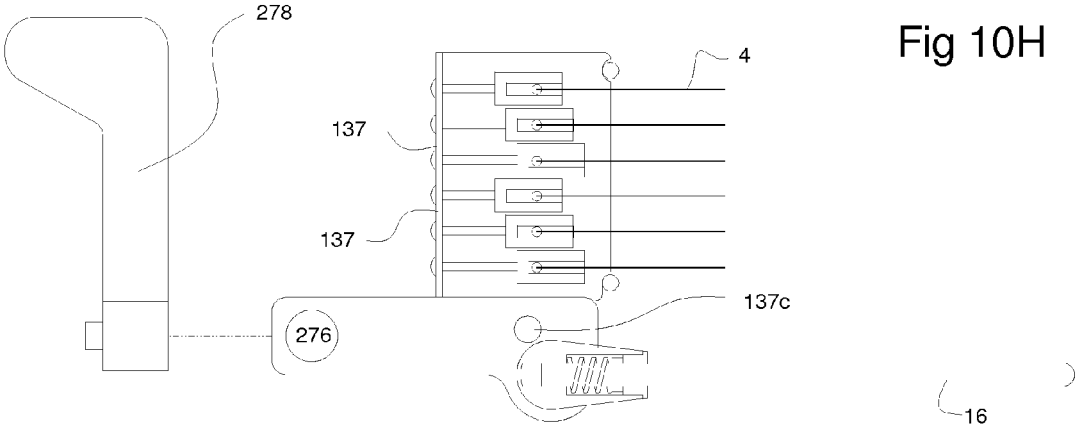
Figure 10J:
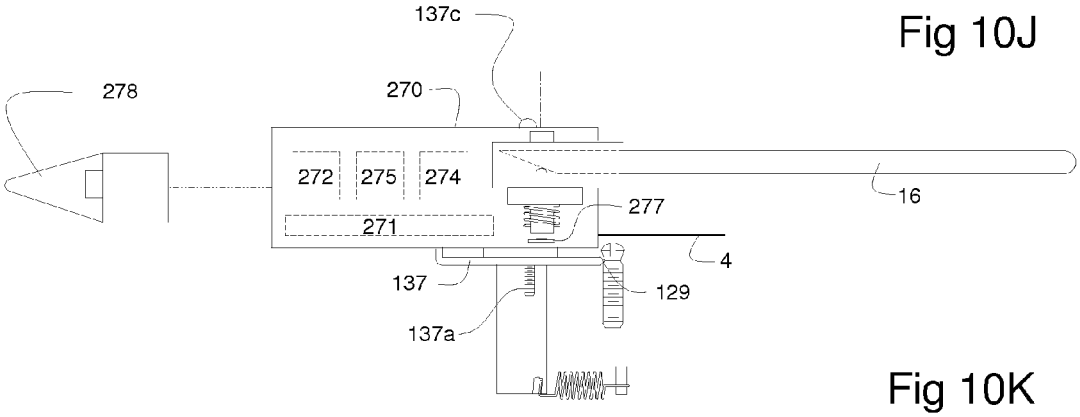

FIGS. 10H and 10J show top and side views of an electronic control arm mounted to a housing enclosing an rf transmitter and preferably a preprocessor.

Figure 10K:
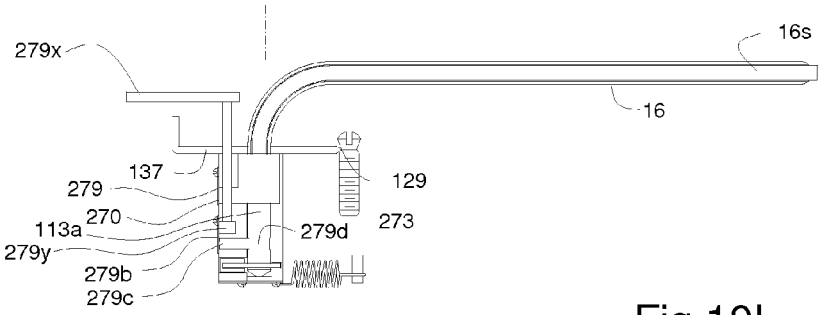
Figure 10L:
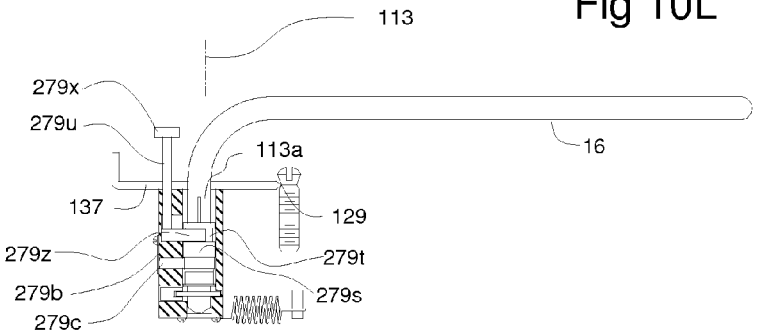

FIGS. 10K and 10L show side views of embodiments electronic control arms having means resisting rotation from an operative position.

Figure 10R:
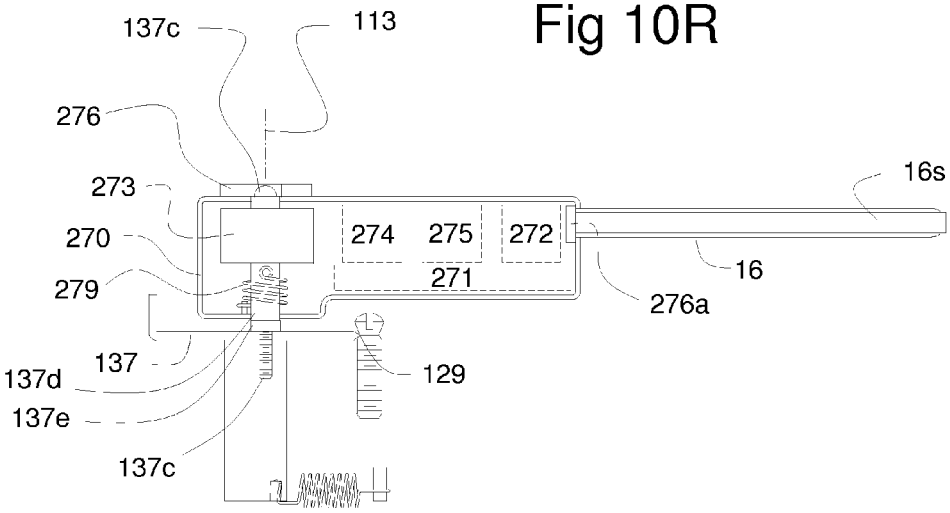
Figure 10S:
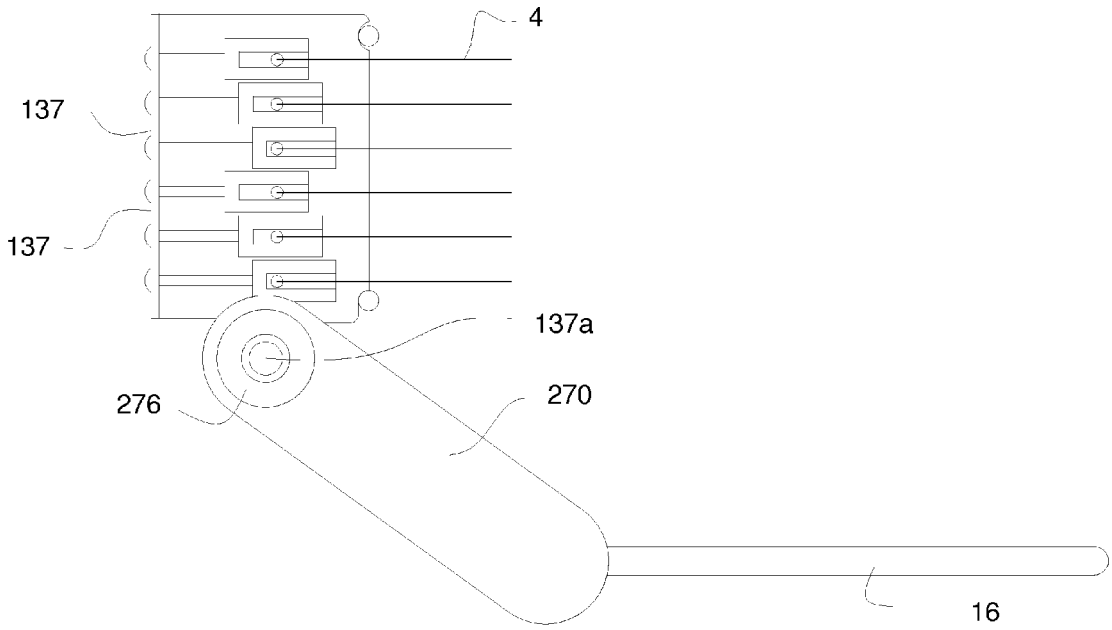

FIGS. 10R and 10S show side and top views of embodiments of an electronic control arm and housing.

Figure 10T:
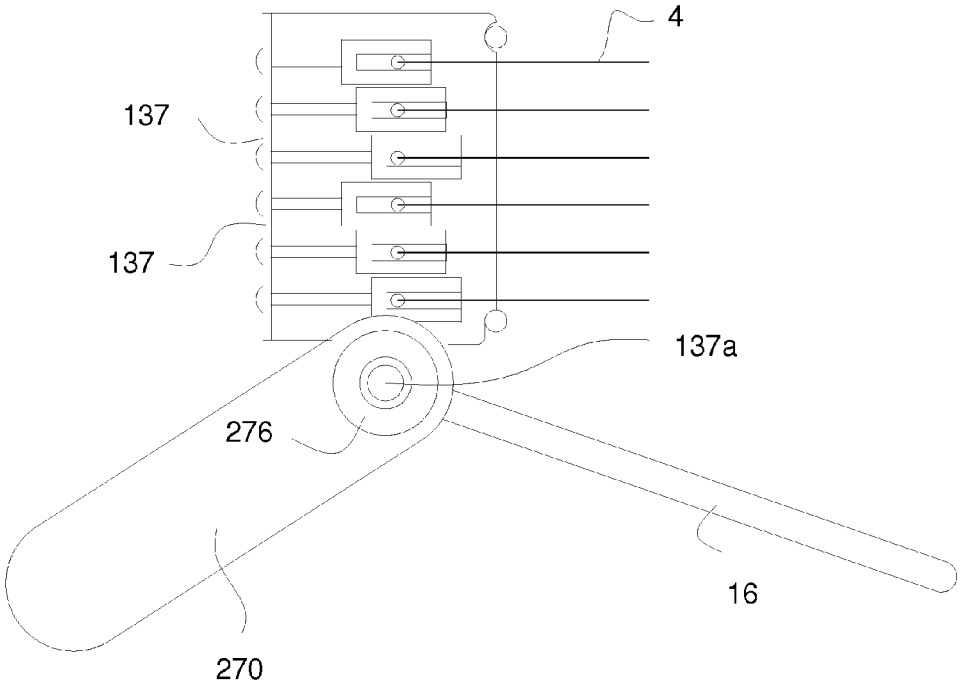
Figure 10U:
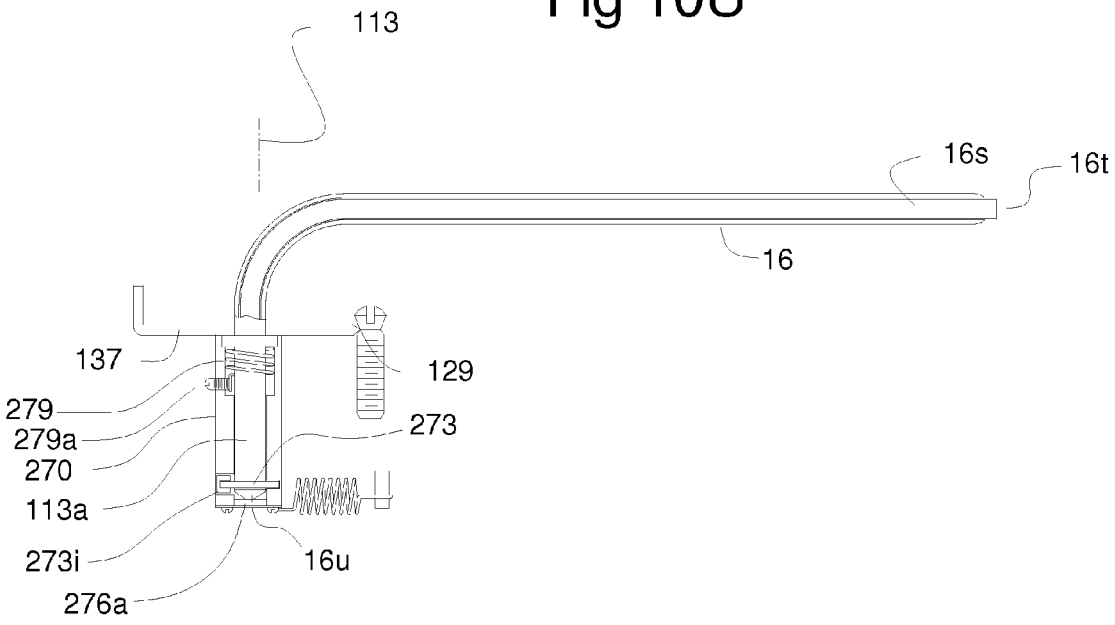

FIGS. 10T and 10U show top and side views of embodiments of an electronic control arm and housing.

Figure 10V:
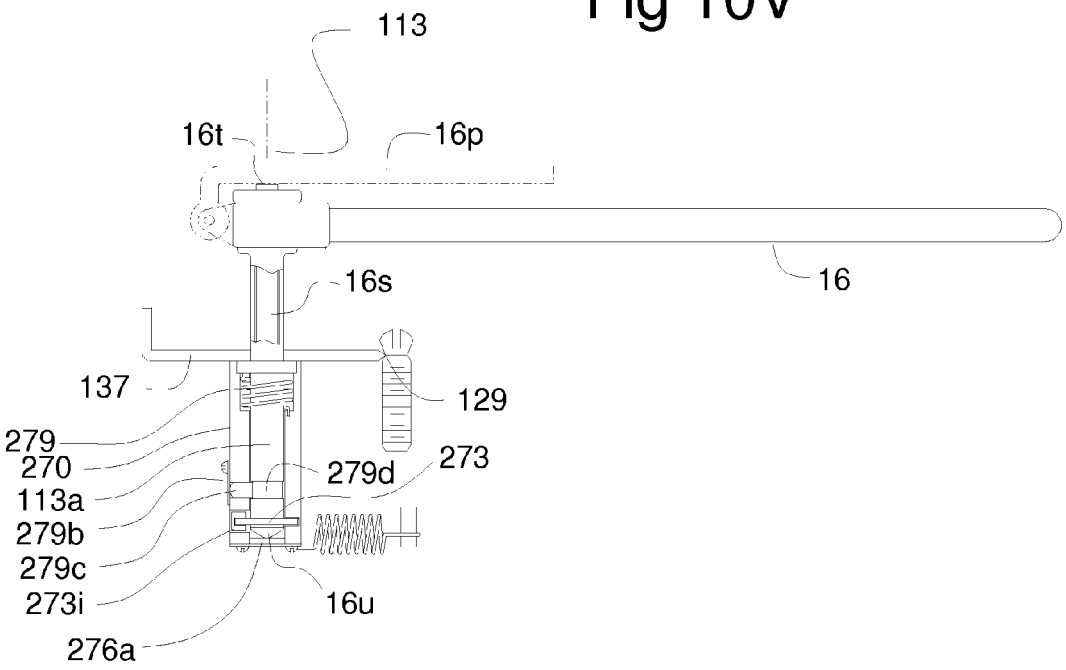
Figure 10W:
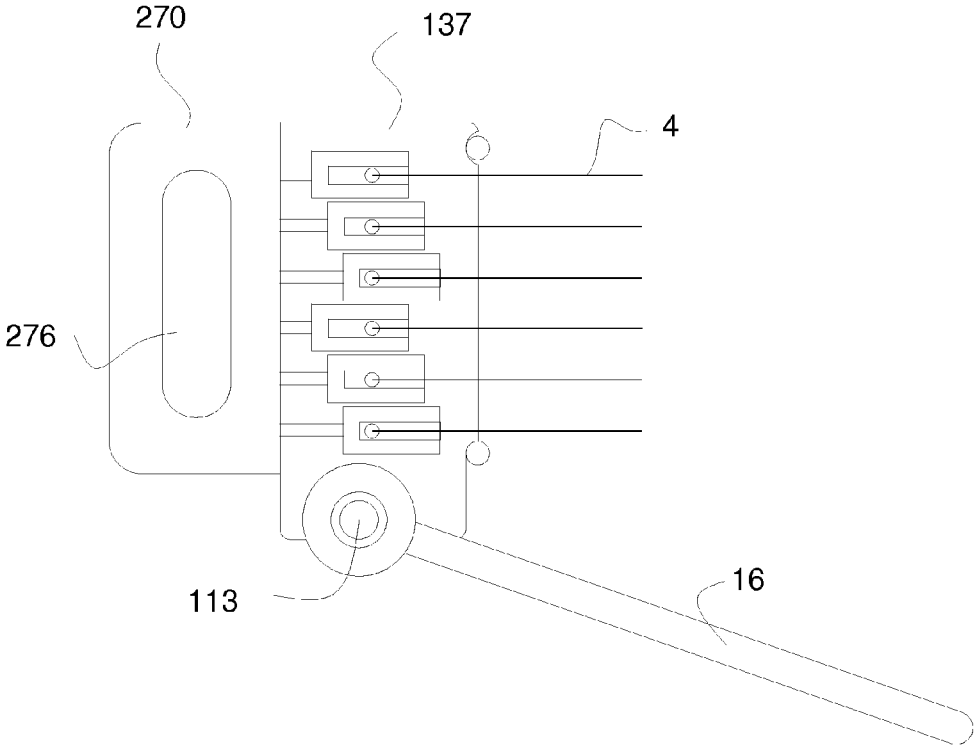

FIGS. 10V and 10W show side and top views of embodiments of an electronic control arm.

Figure 11A:
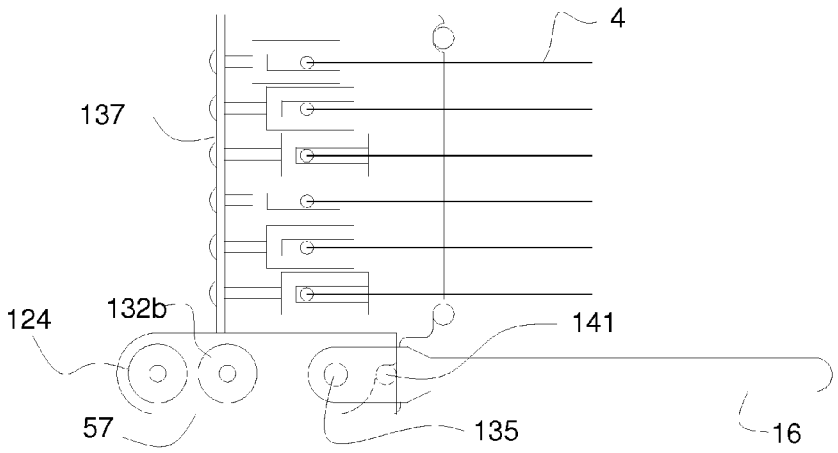

FIG. 11A is a top view of a standard vibrato device incorporating an electronic harmonic vibrator arm.

Figure 11B:
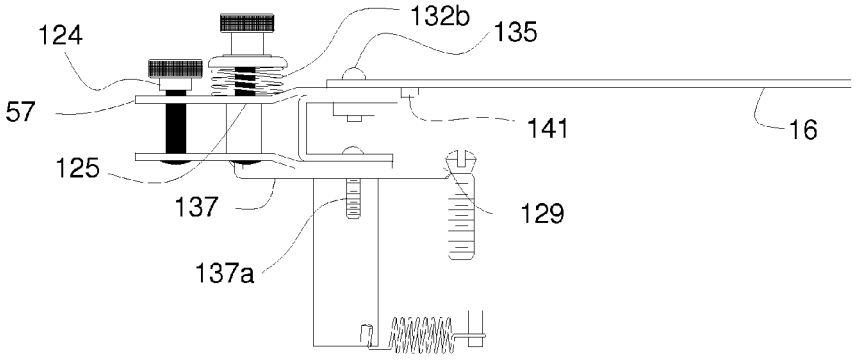
Figure 11C:
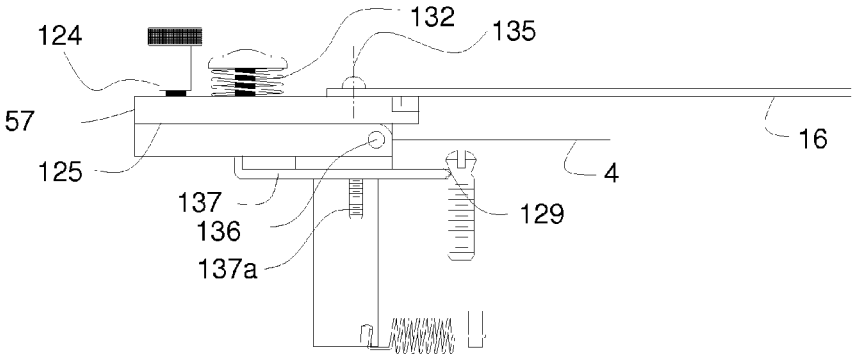

FIGS. 11B and 11C are side views of a standard vibrato device incorporating an electronic harmonic vibrator arm.

FIGS. 11D and 11E are top and side views of a standard vibrato device incorporating an electronic harmonic vibrato arm with sensor on or within the tone block.

FIG. 11F Is a top view of a vibrato tone block having a cylindrical receiver for the actuator arm.

FIGS. 11G and H Is a side views of a vibrato tone blocks having a cylindrical receiver for the actuator arm.

FIG. 11J is a front view of a cylindrical insert embodiment engaging control arm shaft and force or displacement sensor.

FIG. 11K through 11N and 11P through 11W show examples of circuits adapted to accept a signal from a sensor mounted on a vibrato control arm.

FIG. 13 is a top view of an arcuate guide path slot and guide having gear teeth means for adjustment.

FIGS. 14A, 14B, and 14C are top views of an multi-surface actuator cams or assemblies.

FIG. 15 is a top view of alternative adjustment means.

Figure 16A:
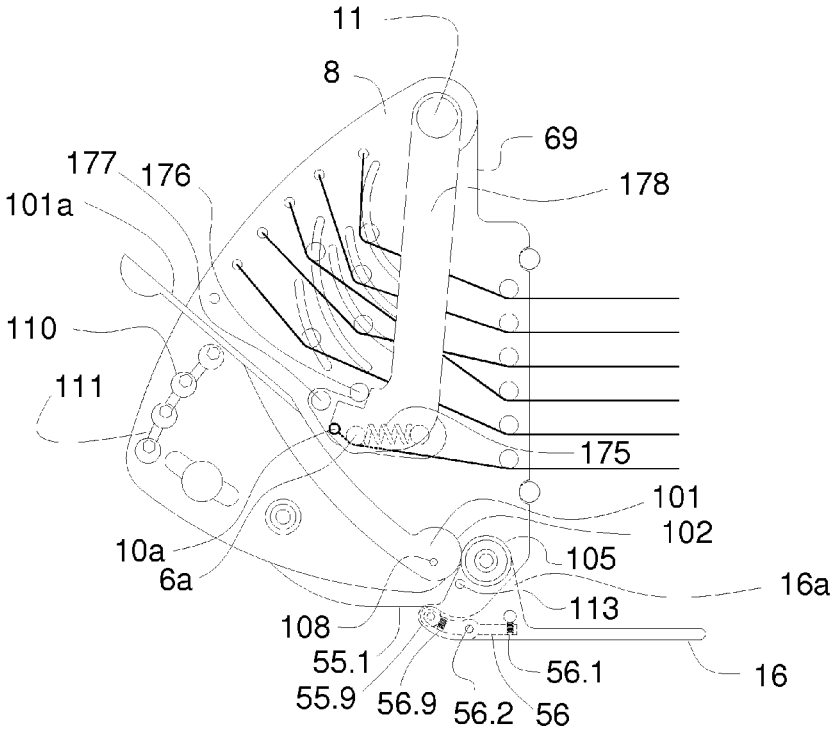

FIG. 16A is a top view of a flat plate vibrato device having single axis harmonic action, simple transposing means, and extreme bend capability.

Figure 16B:
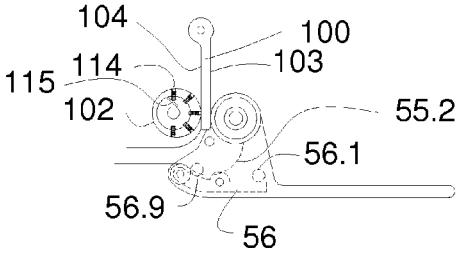
Figure 16C:
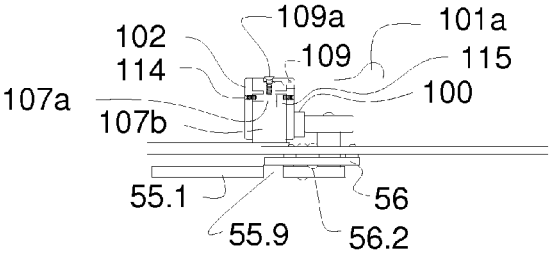

FIGS. 16B and 16C are top and side views of an eccentric transposing mechanism for a harmonic vibrator device.

FIGS. 16D, 16E, 16F, and 16G are top views of various transposing cam configurations.

FIG. 16H is a top view of a flat plate vibrato device having single axis harmonic action, leaf return spring means, multi-lobe cam transposer and idler lever, and various string anchor means.

Figure 17A:
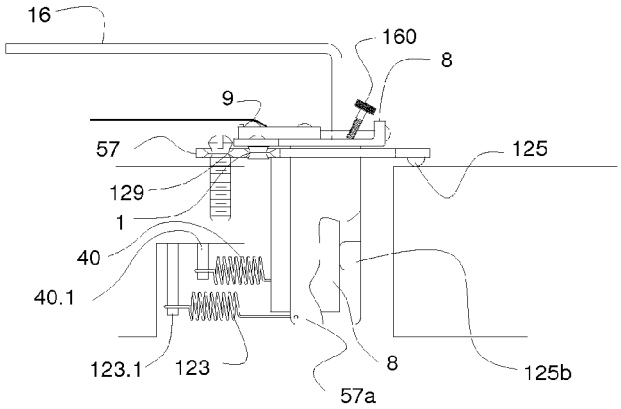
Figure 17B:
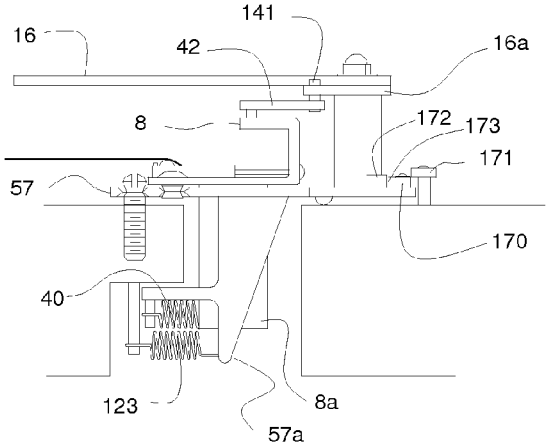
Figure 17C:
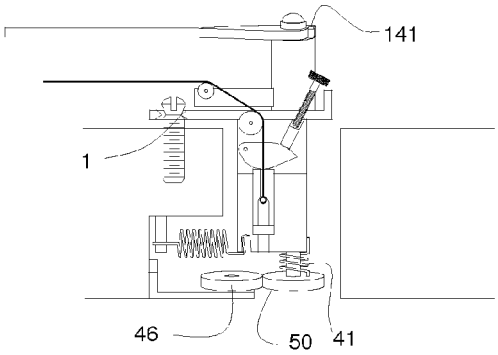

FIGS. 17A, 17B, and 17C are side views of a standard vibrato device incorporating present control improvements.

Figure 17D:
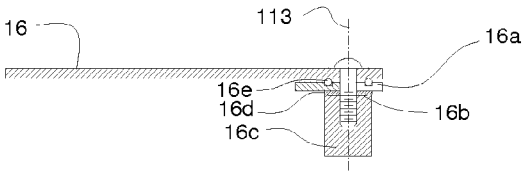

FIG. 17D illustrates surface relief means in control arm components to enhance non-axial rigidity of pivot means.

Figure 17E:
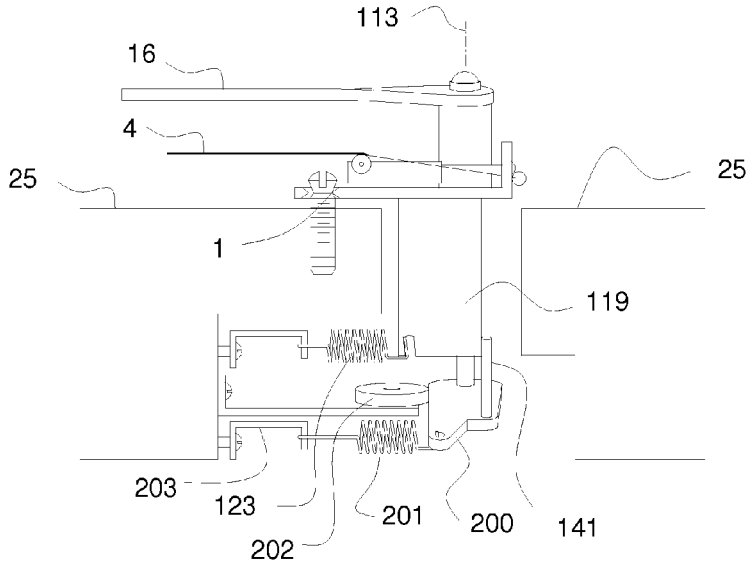
Figure 17F:
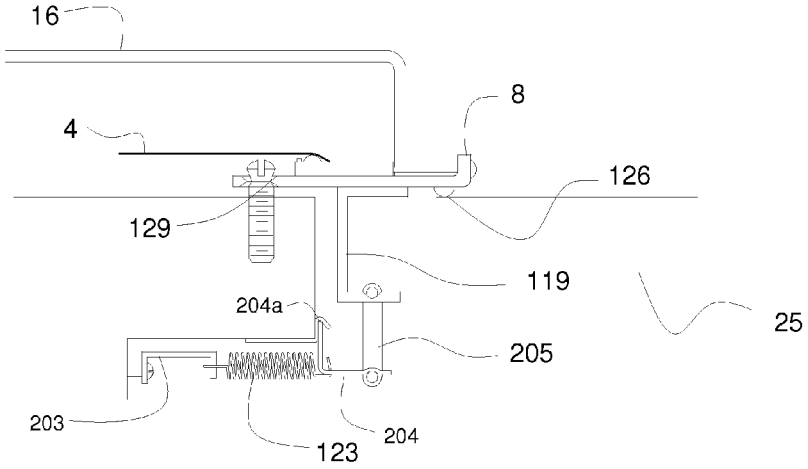
Figure 18A:
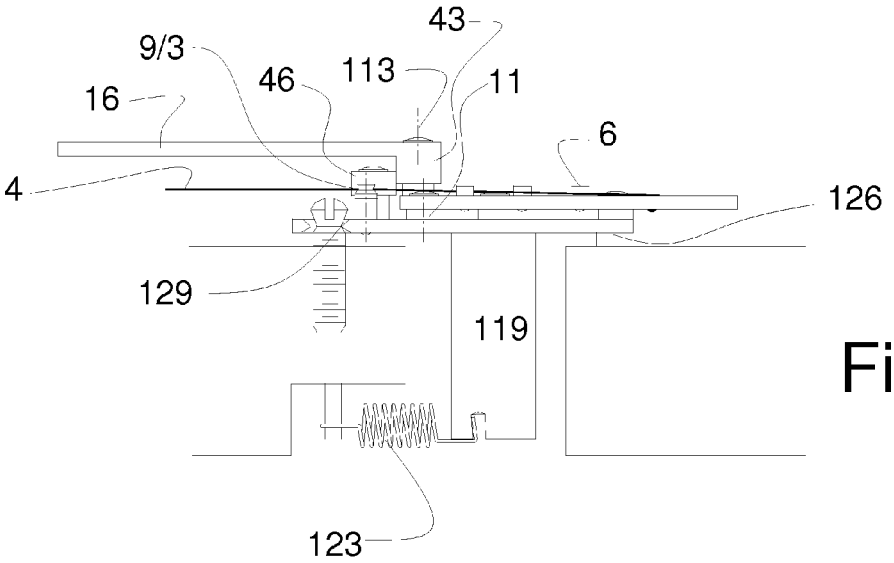
Figure 18B:
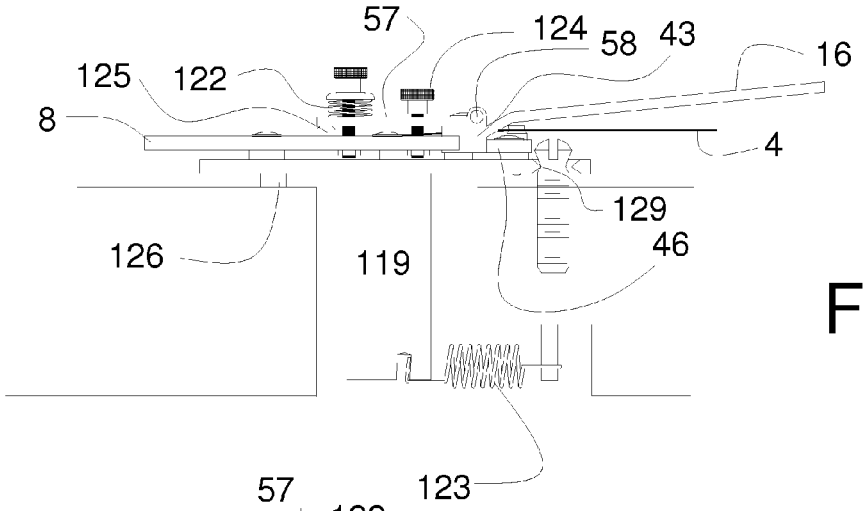

FIGS. 17E and 17F illustrate standard vibrato with variable bias tension FIGS. 18A and 18B are side views of flat plate combined harmonic/standard vibrato devices adapted for use on a guitar body routed for a standard bias spring block.

Figure 18C:
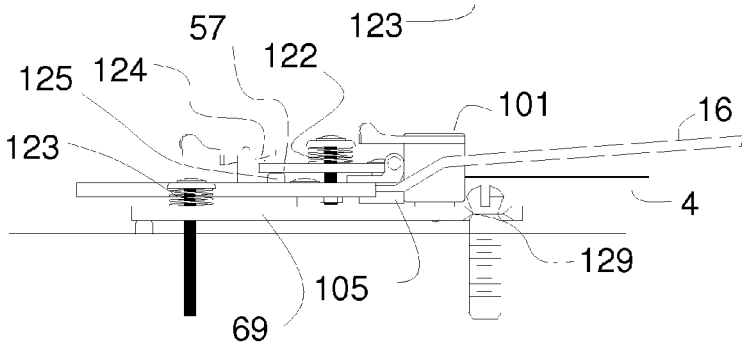

FIG. 18C is side views of a flat plate combined harmonic/standard vibrato device adapted for bolting on top of a solid guitar body.

FIGS. 19A, 19B, 19C and 19D are top views of a flat plate combined harmonic/standard vibrato device having idler link between transposing hub and control arm hub.

Figure 19A:
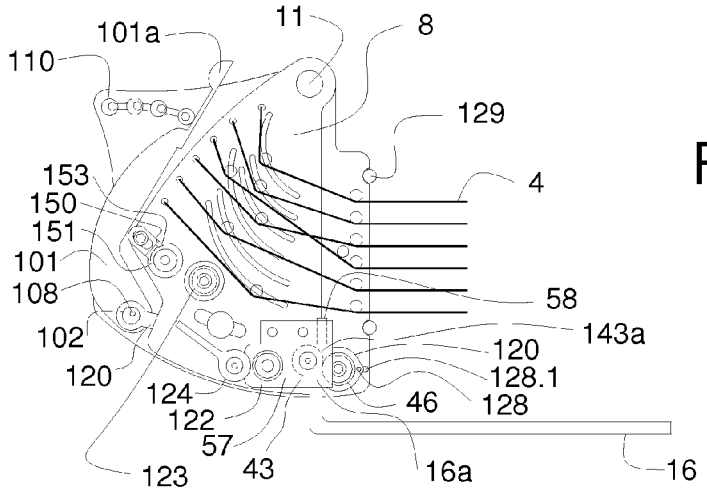
Figure 19B:
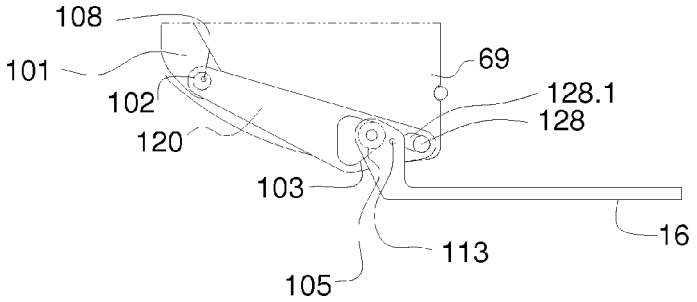
Figure 19C:
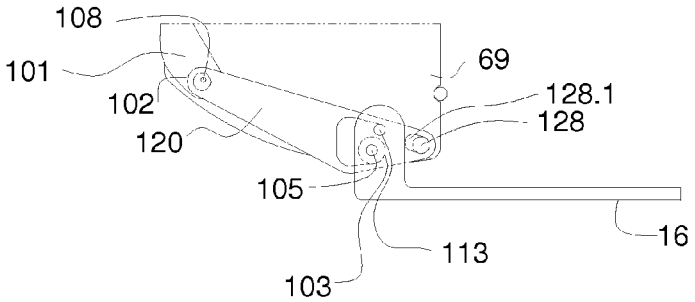
Figure 19D:
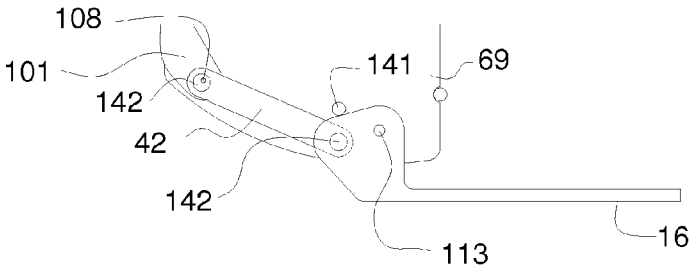
Figure 19E:
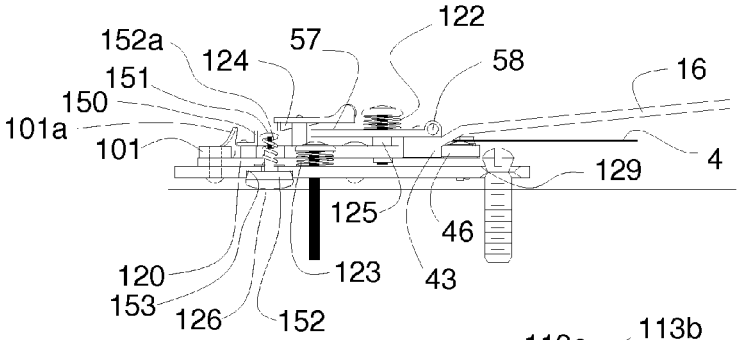
Figure 19F:
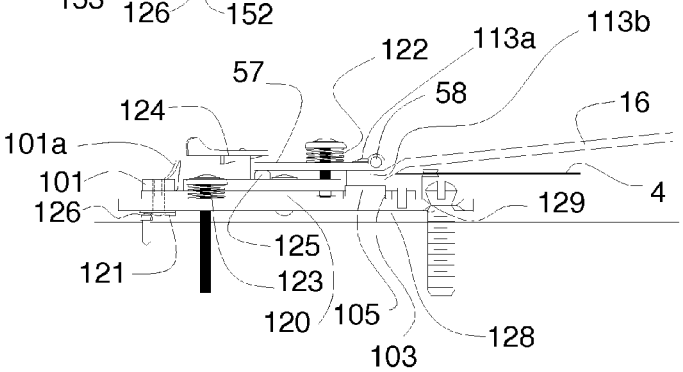
Figure 19G:
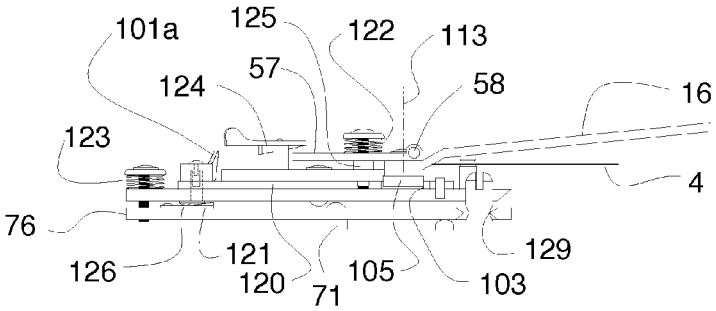

FIGS. 19E, 19F, and 19G are side views of a flat plate combined harmonic/standard vibrato device having idler link between transposing hub and control arm hub.

Figure 19H:
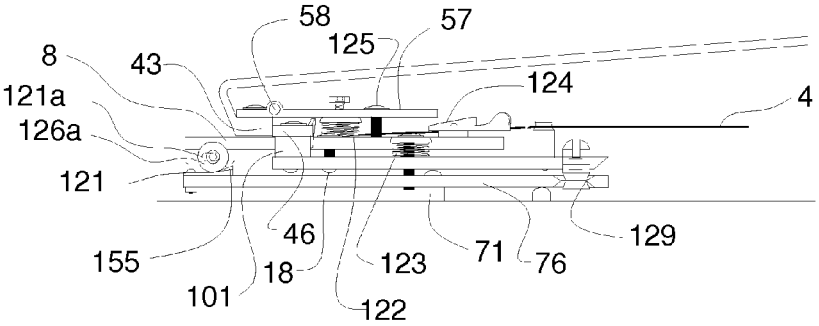

FIGS. 19G and 19H are side views of a flat plate combined harmonic/standard vibrato device having idler link between transposing hub and control arm hub, and further having secondary base to pivot during standard vibrato actions.

Figure 19J:
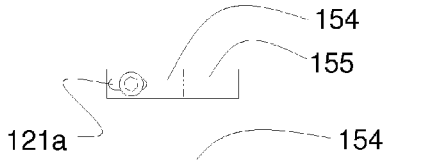
Figure 19K:
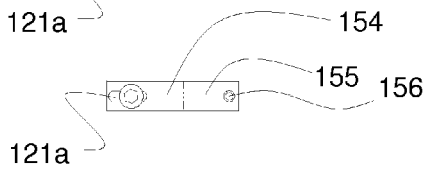
Figure 19L:
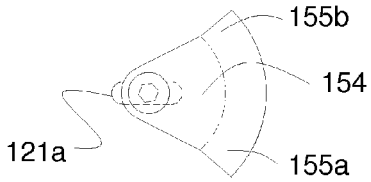

FIGS. 19J, 19K, and 19L are top views of examples of simple flex compensation cams.

Figure 20A:
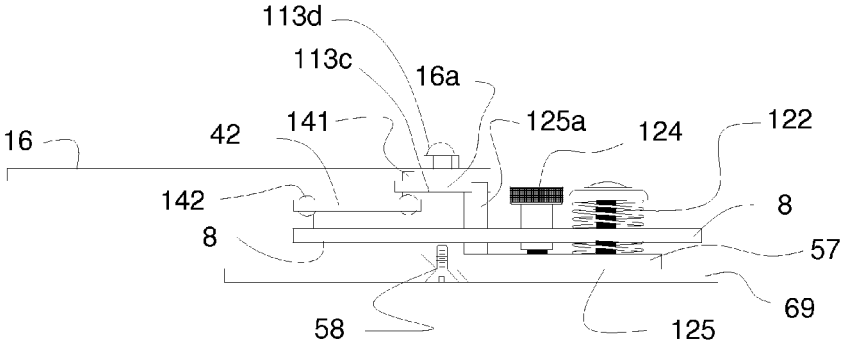
Figure 20B:
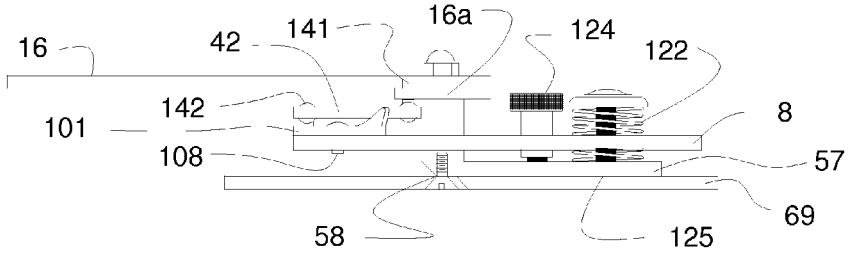

FIGS. 20A and 20B are side views of flat plate combined harmonic/standard vibrato devices where the harmonic dive transport mechanism pivots relative to the baseplate.

FIGS. 21A, 21B, 21C and 21D are side views of a combined harmonic/standard vibrato device having main axis parallel to bridge, and control arm pivoting from main rotating member.

Figure 21A:
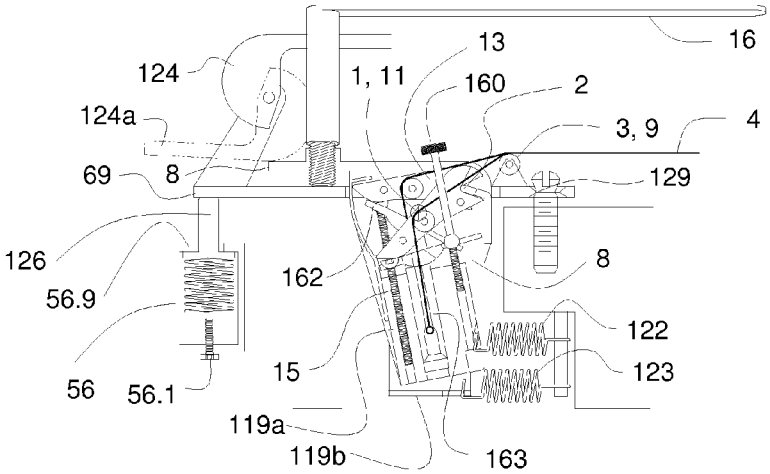
Figure 21B:
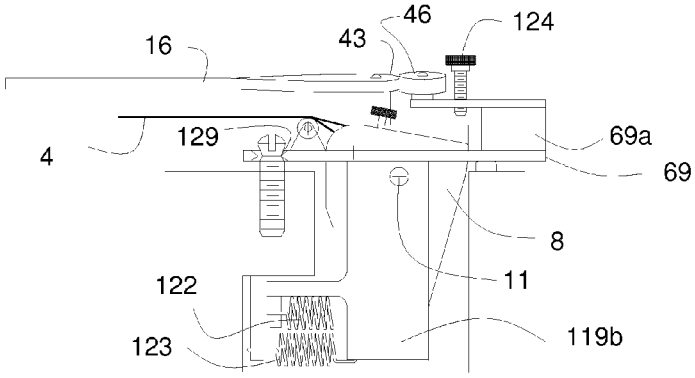
Figure 21C:
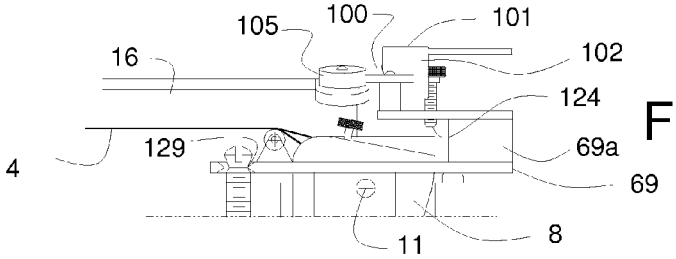
Figure 21D:
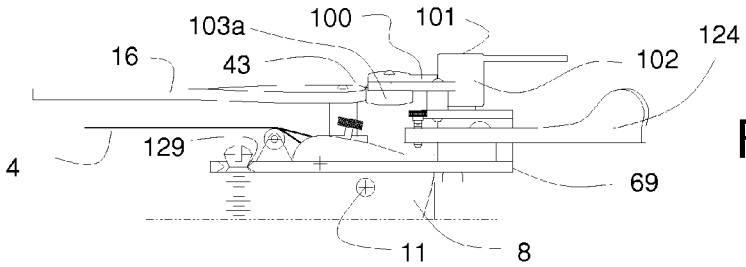
Figure 21E:
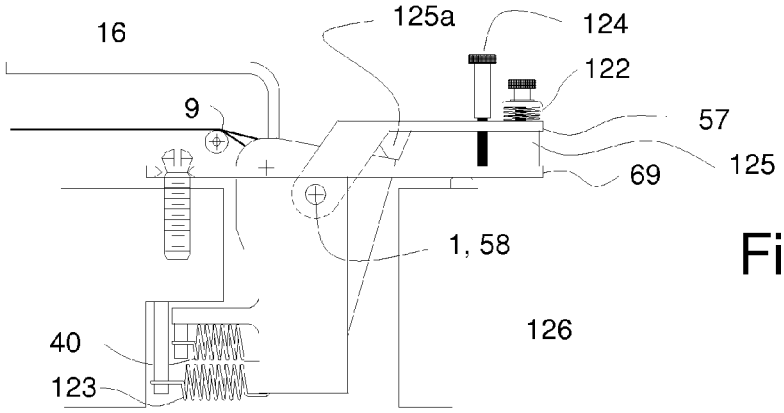

FIG. 21E is a side view of a combined harmonic/standard vibrato device having all bend and dive axes parallel to the bridge, and control arm fixed to the main member.

Figure 22A:
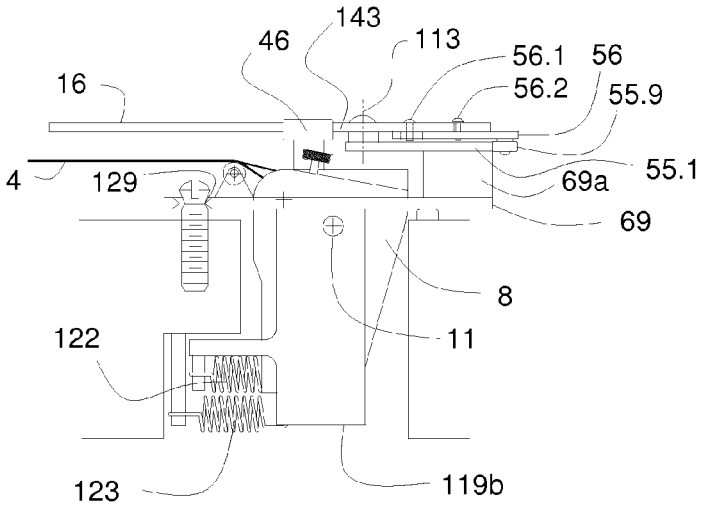
Figure 22B:
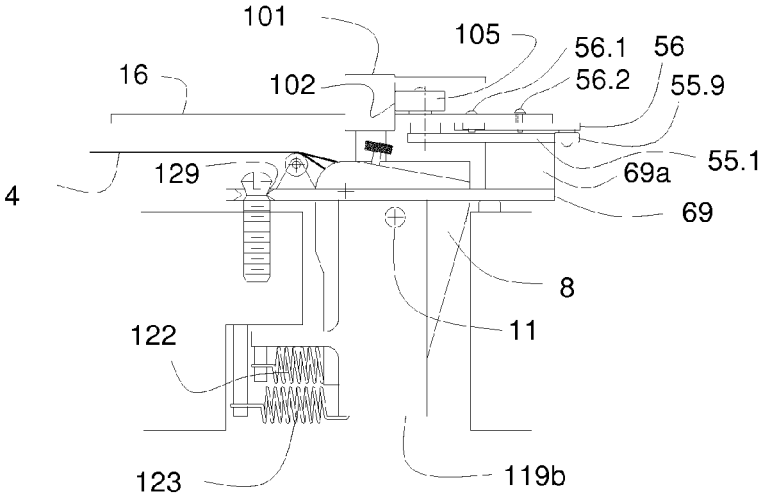

FIGS. 22A and 22B are side views of a combined harmonic/standard vibrato device having main axis parallel to bridge, having single axis harmonic action, and leaf return spring means.

Figure 23A:
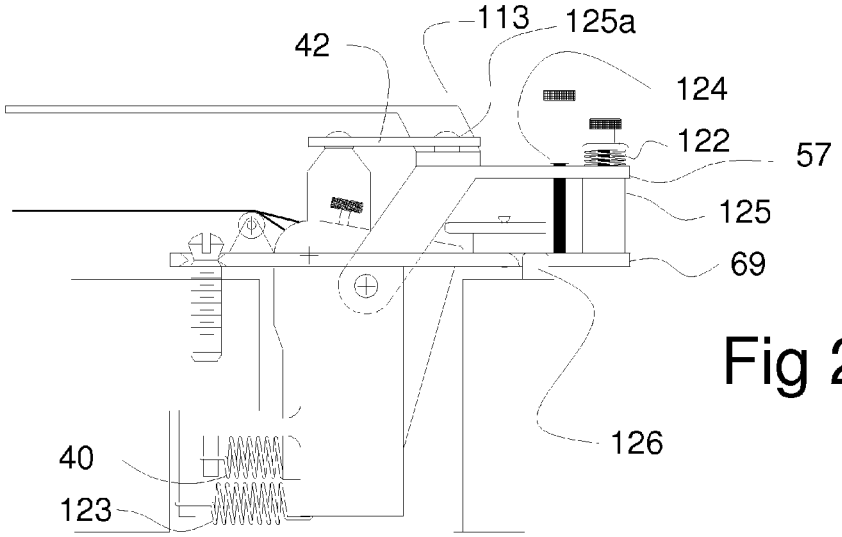
Figure 23B:
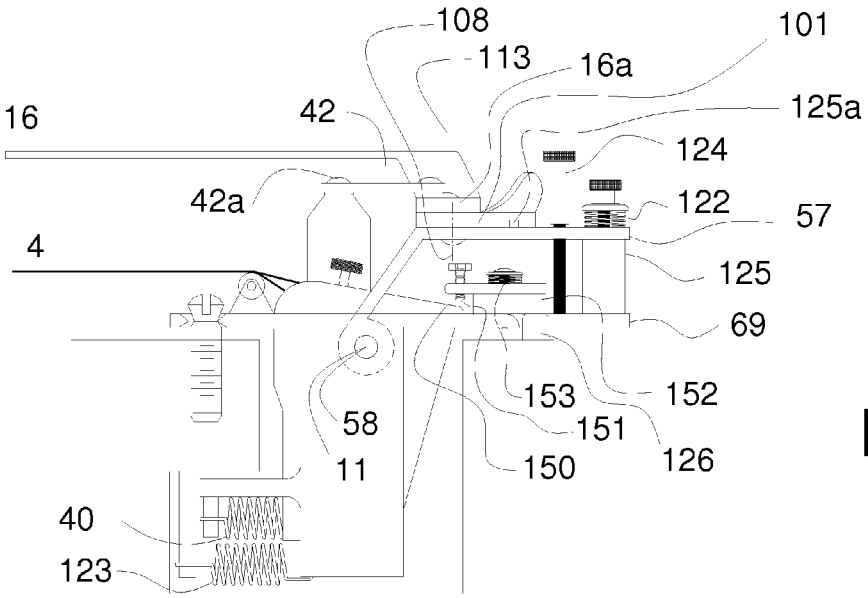
Figure 23C:
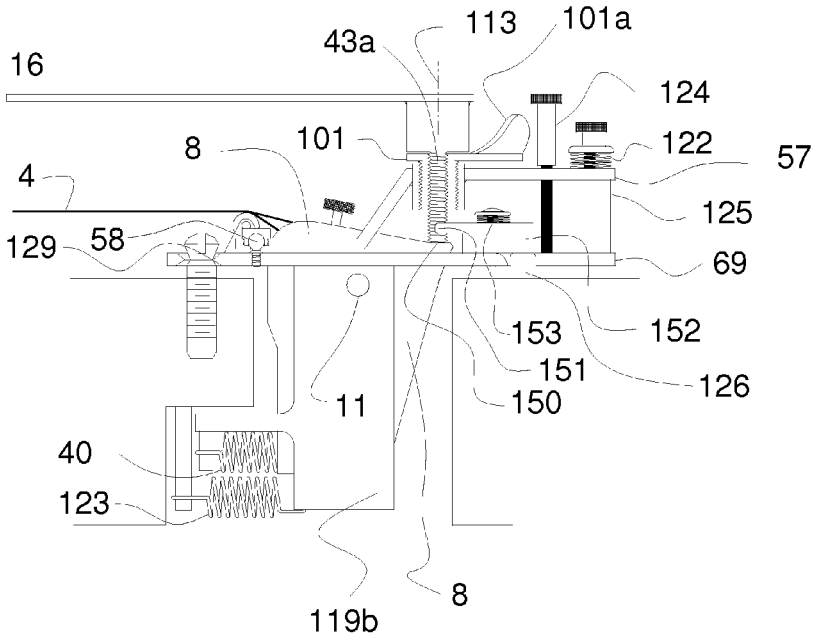

FIGS. 23A, 23B, and 23C are side views of a combined harmonic/standard vibrato device having main axis parallel to bridge, having dual axis harmonic action.

Figure 23D:
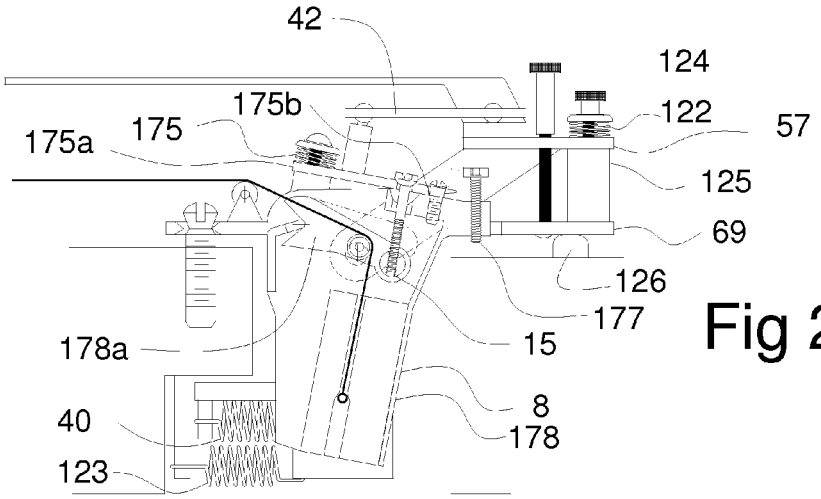

FIG. 23D is a side view of a vibrato as in FIG. 23A, and further including extreme bend means for one or more strings.

Figure 12A:
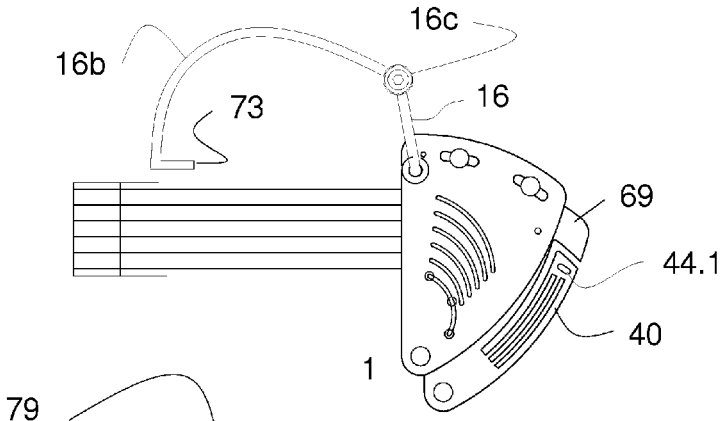
Figure 12B:
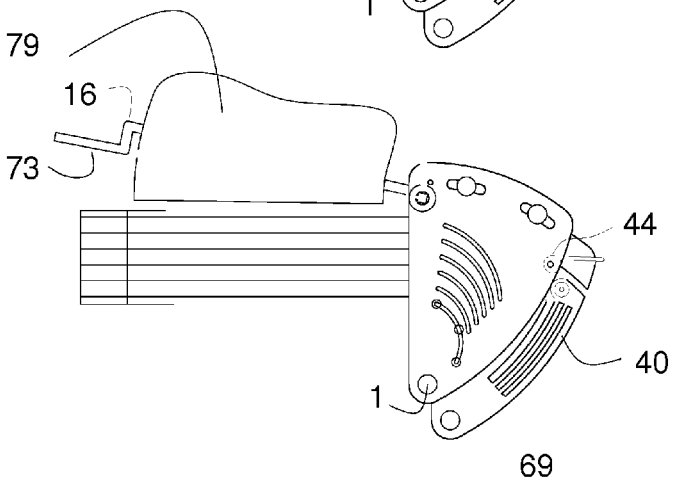

FIGS. 12A and 12B are top views of a vibrato assembly having integral leaf spring means and novel control arm configurations.

Figure 24A:
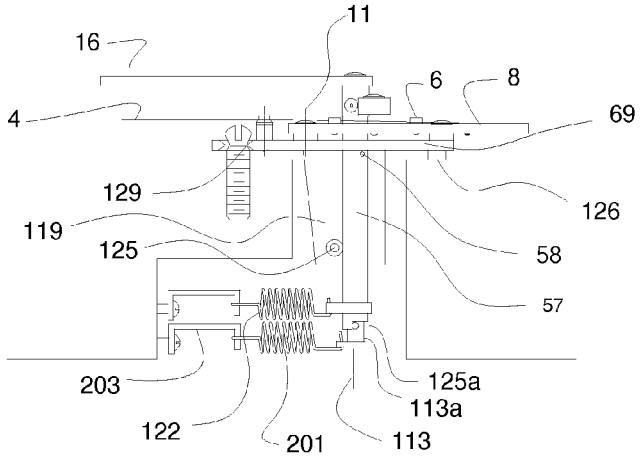
Figure 24B:
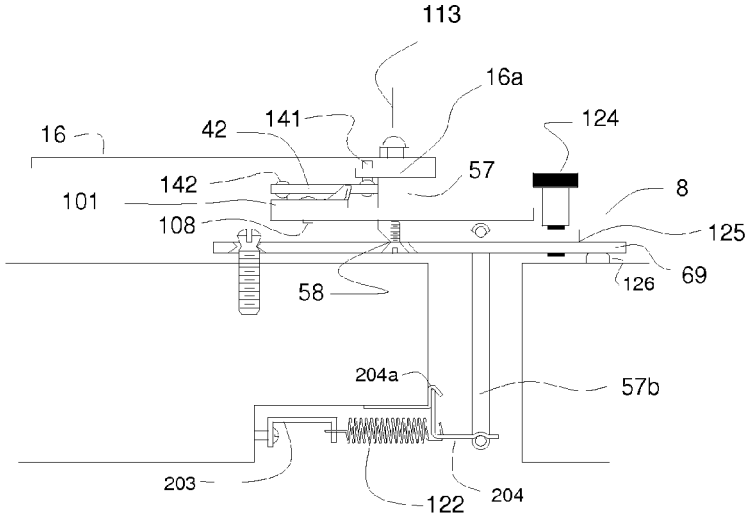
Figure 24C:
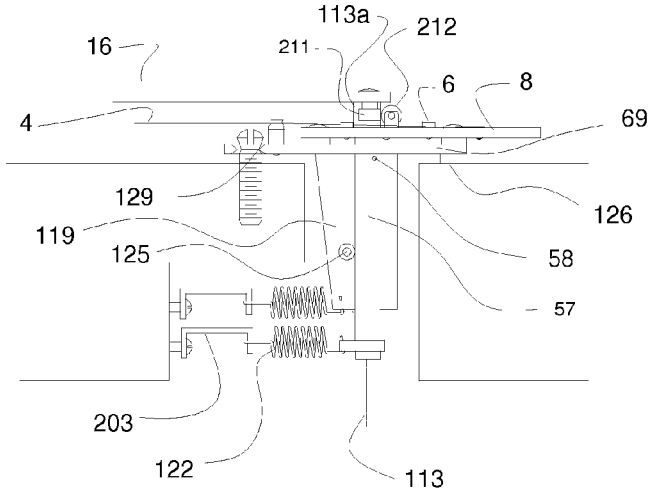

FIGS. 24A, 24B, and 24C are side views of harmonic device having bias springs concealed within the instrument body.

Figure 24D:
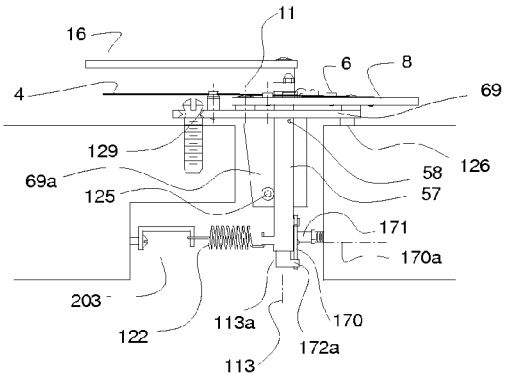
Figure 24E:
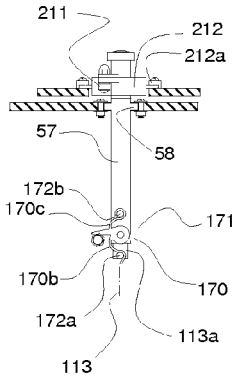

FIG. 24D is a side view, and 24E is a rear view of embodiments having a dive transport rocker extending below surface of the instrument, and further include a latch mechanism to reduce the necessary bias spring tension.

Figure 24F:
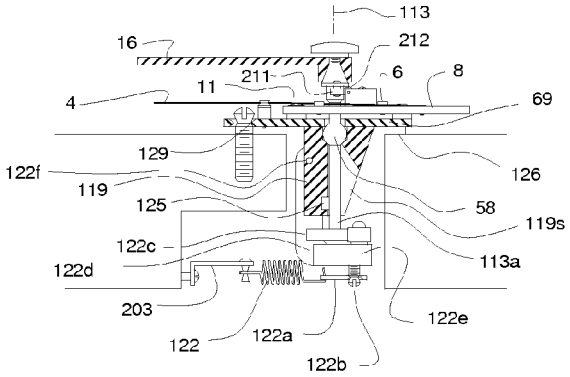

FIGS. 24F and 24 G are side views of embodiments having a dive transport rocker extending below surface of the instrument, where the rocker is made up of the control arm shaft itself, constrained within a slotted housing.

Figure 25A:
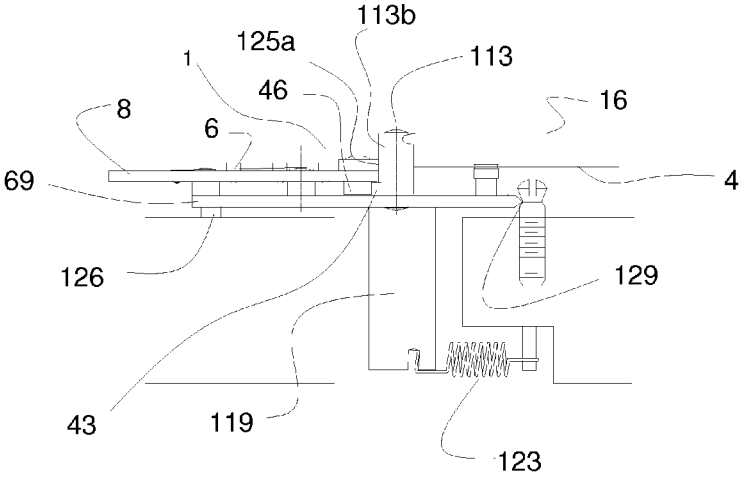

FIG. 25A is a side view of a vibrato embodiment having harmonic bend and standard dive, with control arm journal brake when not in use.

FIG. 25 B is an embodiment having a control arm journal rotating on a fixed control arm shaft cantilevered from the device base, and further having a transport device pivoting from that journal on an axis substantially parallel to the string plane.

Figure 25B:
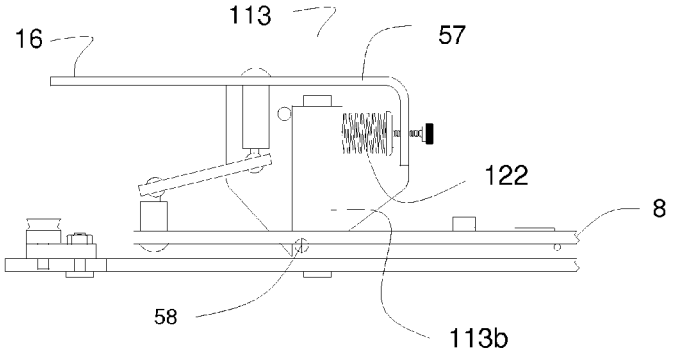
Figure 25C:
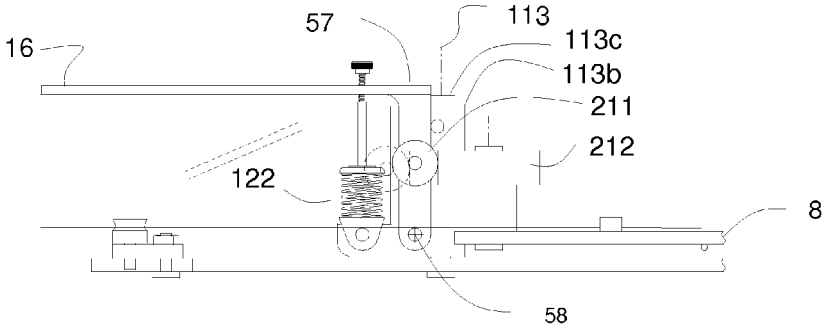
Figure 25D:
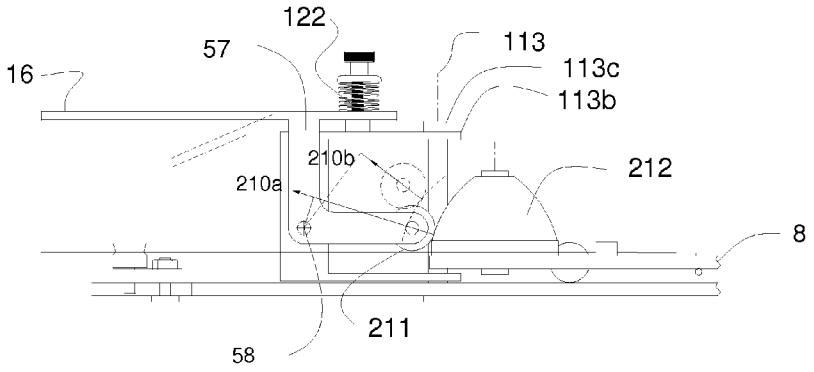

FIGS. 25C and 25D illustrate embodiments where the bend and dive actions are controlled by the interaction between rollers rotating on skewed axes, and where the dive transport pivots from the control arm journal or shaft.

Figure 25E:
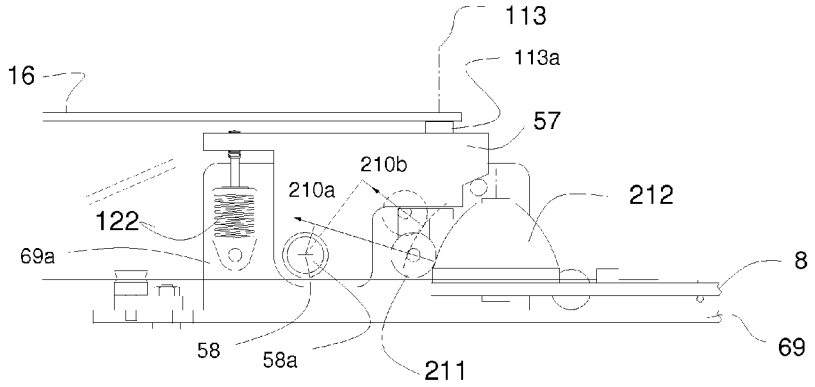
Figure 25F:
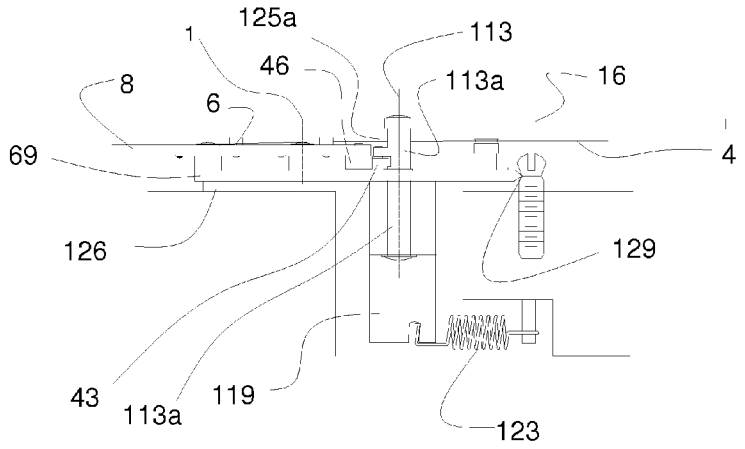

FIGS. 25E and 25F illustrate embodiments where the bend and dive actions are controlled by the interaction between rollers rotating on skewed axes, and where the control arm journal or shaft pivots relative to the dive transport mechanism.

Figure 26A:
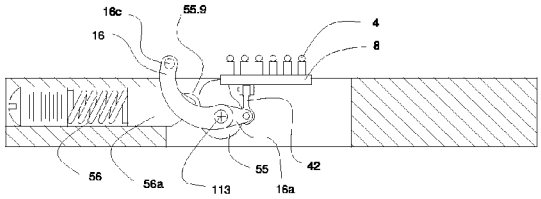

FIG. 26A shows an end view of an embodiment of a vibrato control arm having a rotational axis substantially parallel to the stings, where the body is cutaway to show an embodiment of vibrato connection and biasing means.

Figure 26B:
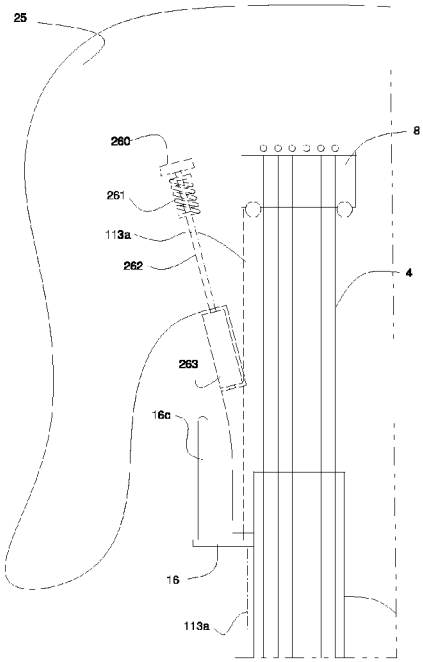

FIG. 26B show a top view of an embodiment of a vibrato control arm having a rotational axis substantially parallel to the stings, and of drum on an axis substantially parallel to the strings for manipulating an electronic rotation sensor.

Figure 26E:
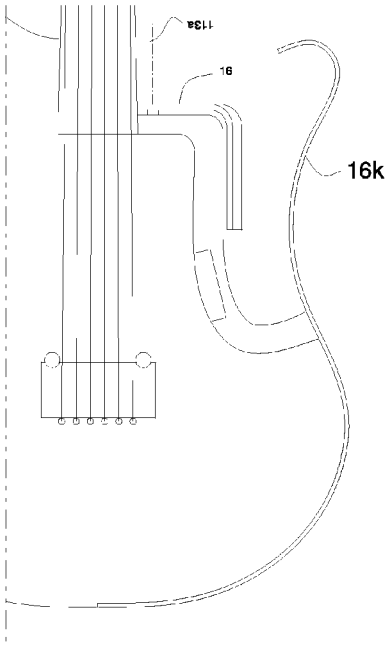
Figure 26C:
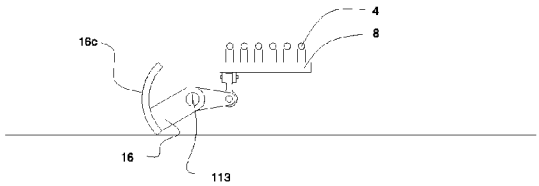

FIG. 26C shows an end view of an embodiment of a vibrato control having a rotational axis substantially parallel to the stings, where the control comprises at least a partially arcuate surface.

Figure 26D:
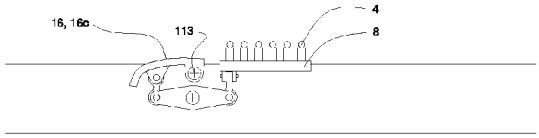

FIG. 26D shows an end view of an embodiment of a vibrato control having a rotational axis substantially parallel to the stings, where the control arm comprises a substantially planar surface FIGS. 27A through 27H and 27J are side views of embodiments of alternative means of moving a string guide 6 through an arcuate path with respect to rotating member.

Figure 28A:
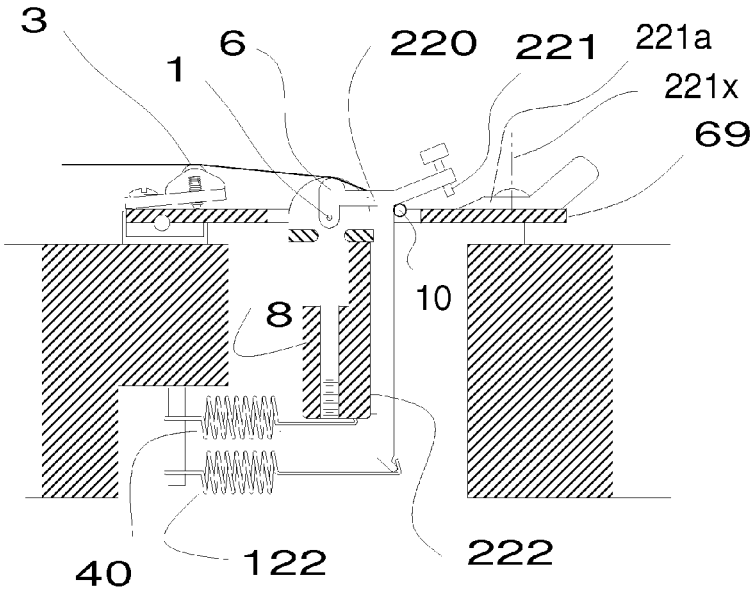
Figure 28B:
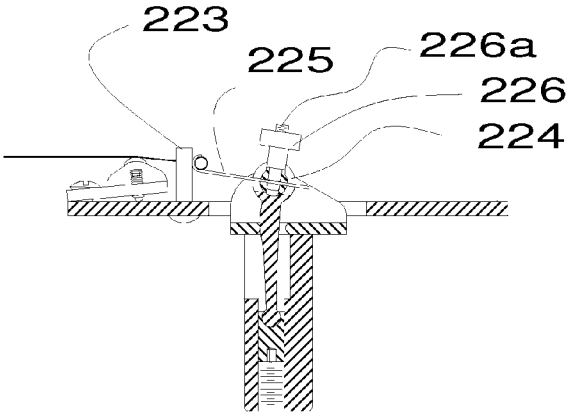
Figure 28C:
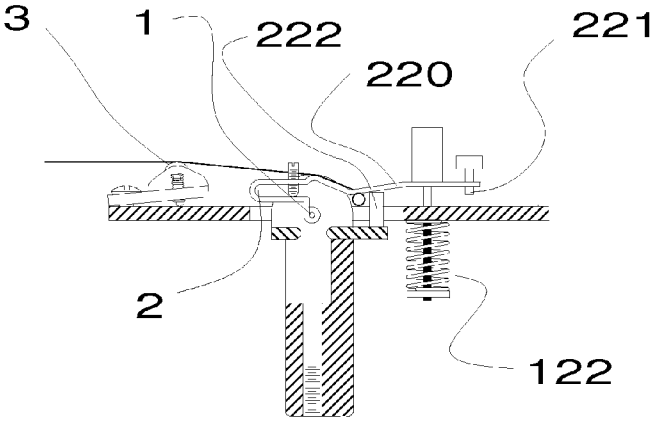

FIGS. 28A through 28C show means of limiting the stretch of the high e string to allow more extreme bends FIGS. 30A through 30H are side views of embodiments of a dual action cam transport rocker having rotational axes substantially parallel to the string plane.

FIGS. 31A through 31H are side and end views of pivot post embodiments.

FIGS. 31J through 31M are side views of improved ends for music strings.

FIG. 32A is a top view of a sting saddle roller.

FIG. 32B through 32H are side views of rollers and saddles illustrating the benefit using string groove offset from bearing center.

FIGS. 33A and 33B show front and top views of mezzanine base means

Figure 34A:
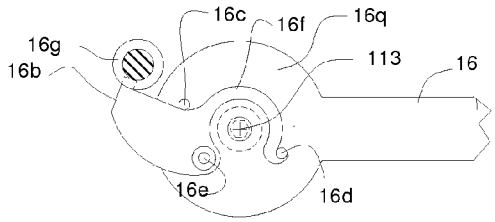

FIG. 34A shows a bottom view of a control arm incorporating a transposing latch engaging a latch receiver.

Figure 34B:
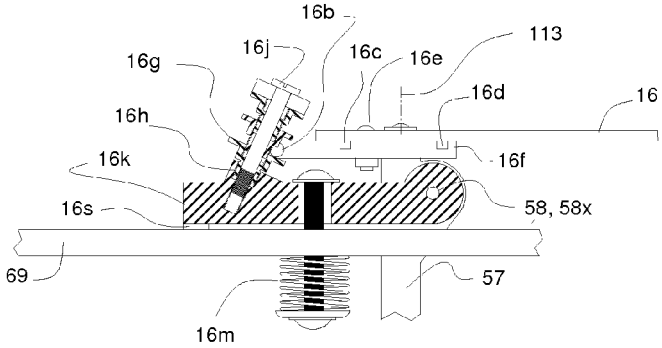

FIG. 34B shows a side view of the transposing latch and receiver embodiment of FIG. 34A.

Figure 34C:
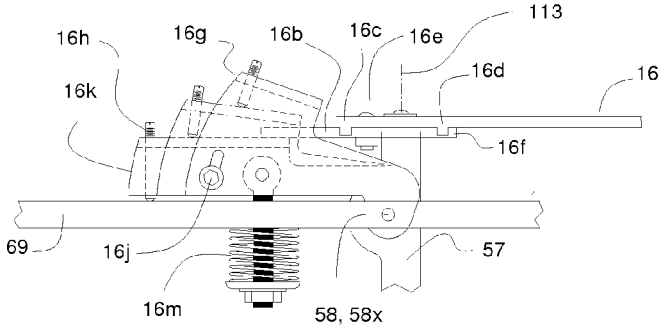

FIG. 34C shows a side view of an alternative latch bolt receiver embodiment comprising flanged stacked plates with flanged upper edges.

Figure 34D:
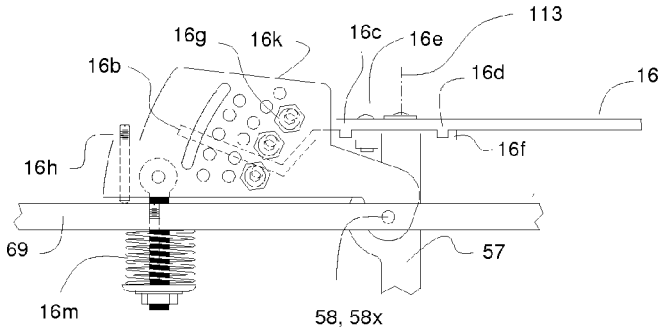

FIG. 34D shows a side view of an alternative latch bolt receiver embodiment comprising multiple pins projecting from a substantially vertical plate.

Figure 34E:
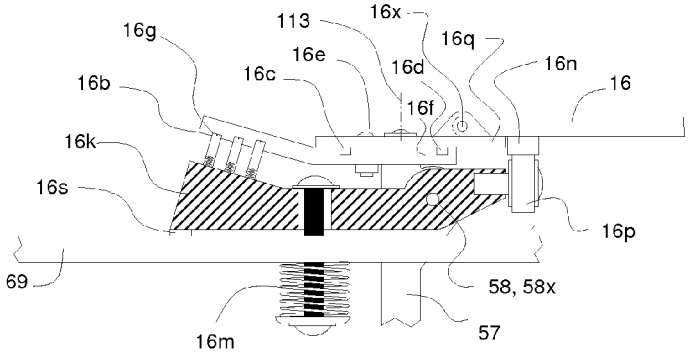

FIG. 34E shows a side view of an alternative latch bolt receiver embodiment comprising adjustable latch pins projecting substantially normal to a string plane.

Figure 34F:
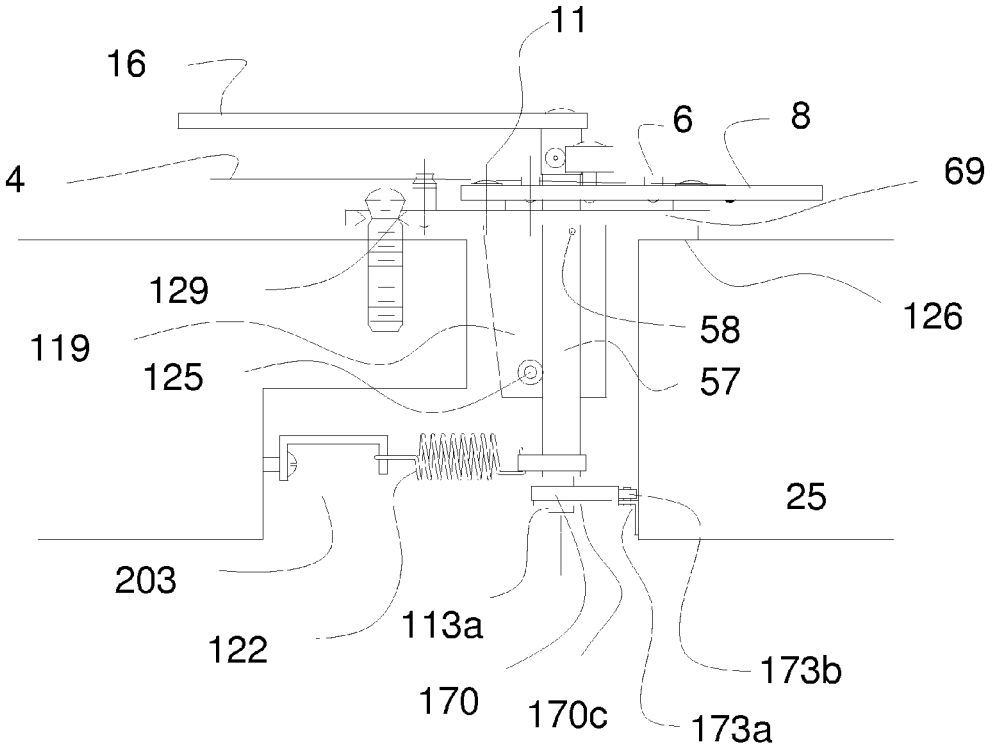
Figure 34G:
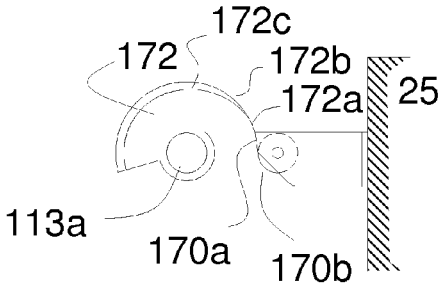

FIGS. 34F and 34G are side and bottom views of a latch device where the bolt or receiver is a cam.

Figure 34H:
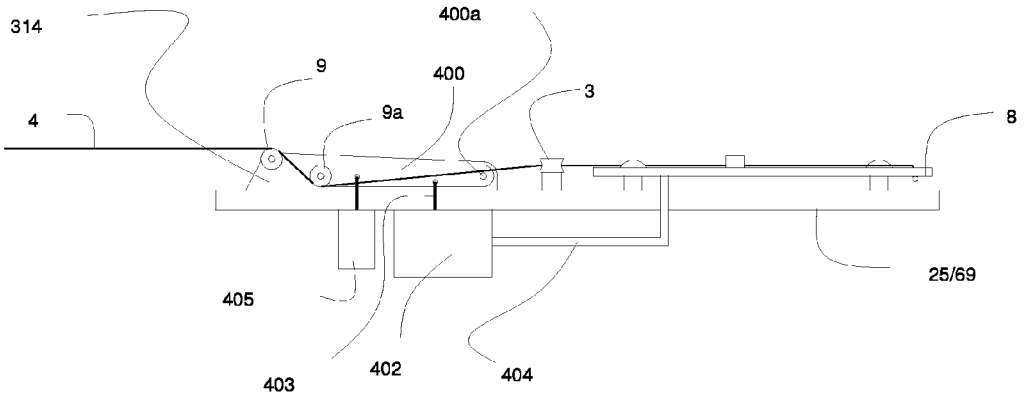
Figure 34J:
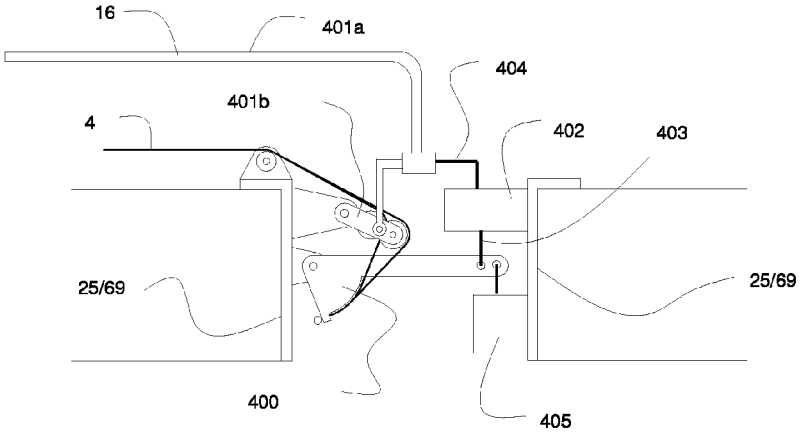
Figure 34K:
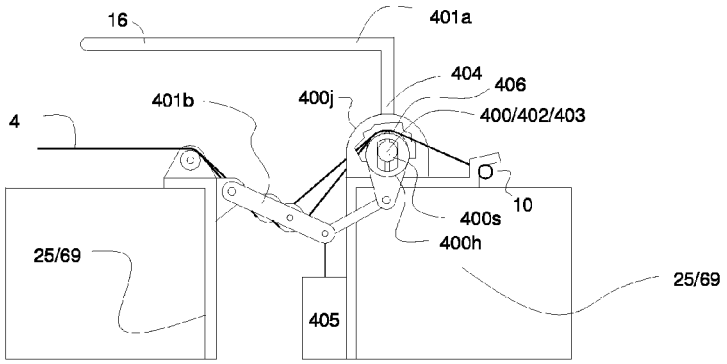

FIGS. 34H, 34J, and 34K illustrate basic elements of flex compensation in examples where the members are string-engaging members are not necessarily articulated.

Figure 34L:
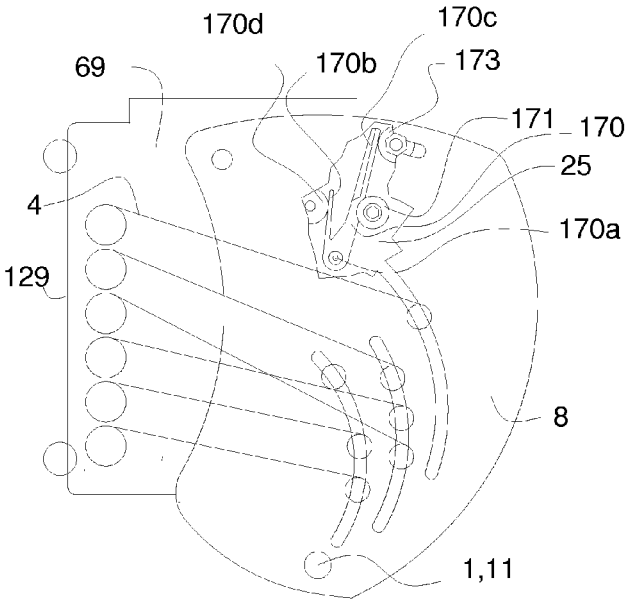

FIG. 34L is a top view of a latch bolt urged into engagement with a latch receiver by a latching spring.

Figure 34M:
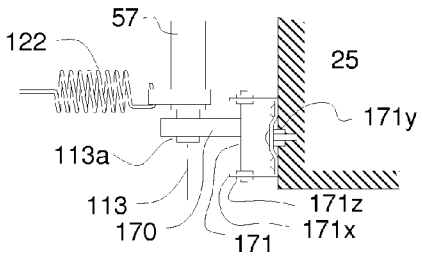
Figure 34N:
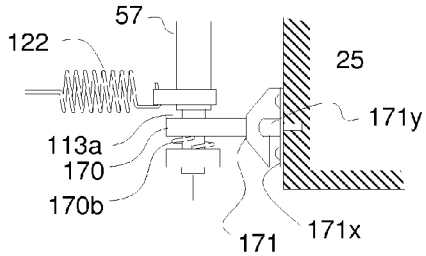
Figure 34O:
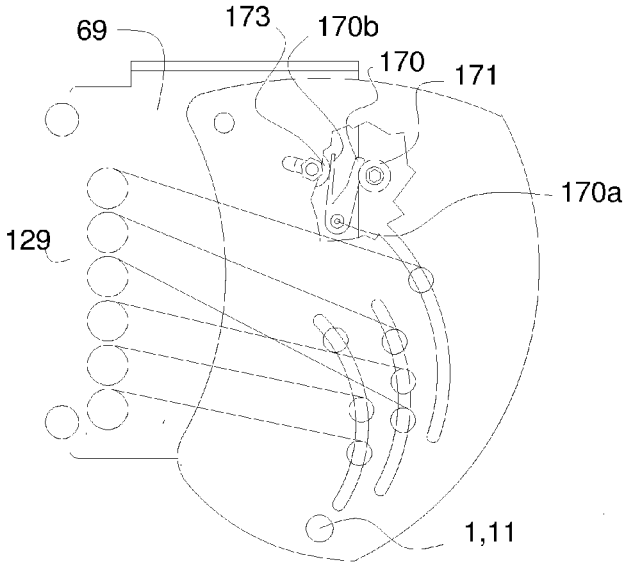

FIGS. 34M and 34N show side views of radial latch embodiments pivotable about a control lever shaft axis.

Figure 34P:
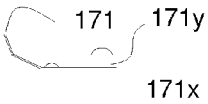
Figure 34Q:
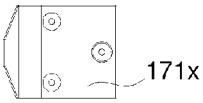
Figure 34U:
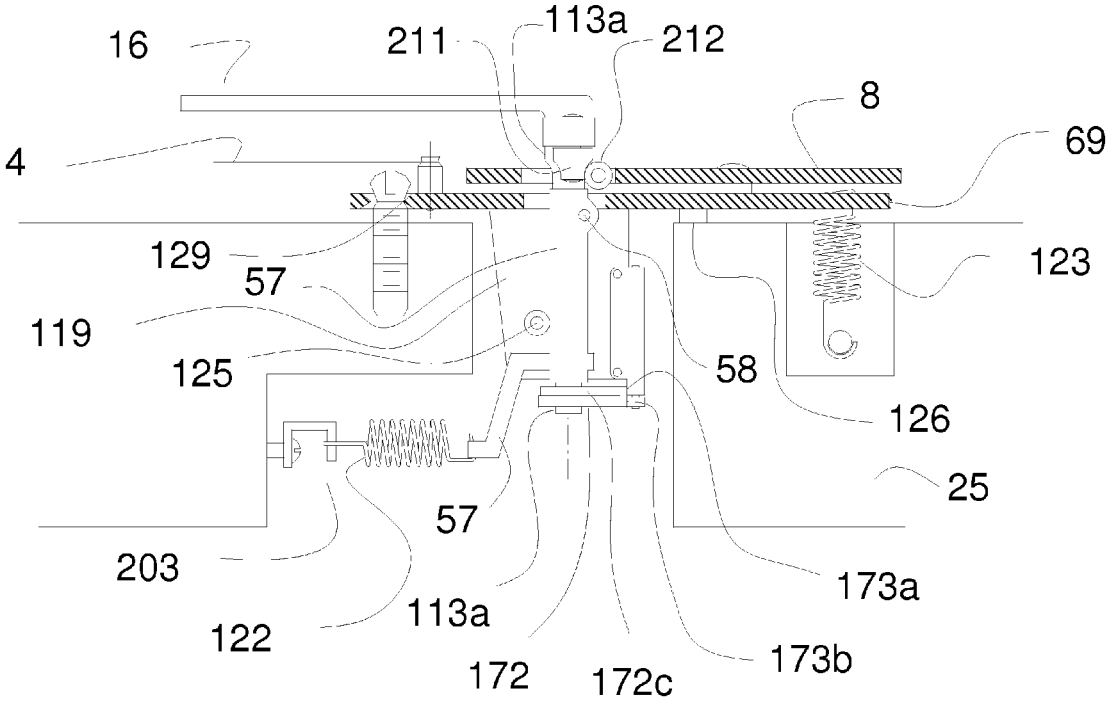

FIGS. 34P and 34Q show side and face views of latch receiver embodiments.

FIG. 34R is a side view of an embodiment of a vibrato device having multiple latch means.

FIGS. 34S and 34T are face views of latch receiver embodiments.

FIGS. 35A and 35B show top and side views of embodiments having boss means providing fulcrum support.

FIGS. 35C and 35D show side and top views of embodiments of pivot fixtures configured to mount to the body of a guitar.

FIG. 35E shows side view of embodiments of pivot fixtures configured to mount to the body of a guitar, and having a preferably formed metal reinforcing member.

FIGS. 35F, 35G, and 35H show the side cross section, and top view, and side view of embodiments of pivot fixtures configured to mount to the body of a guitar.

Figure 36A:
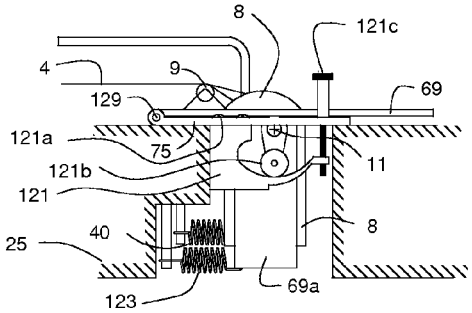
Figure 36B:
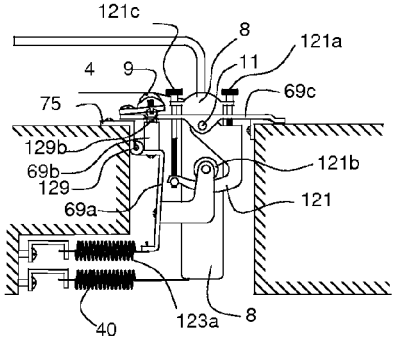
Figure 36C:
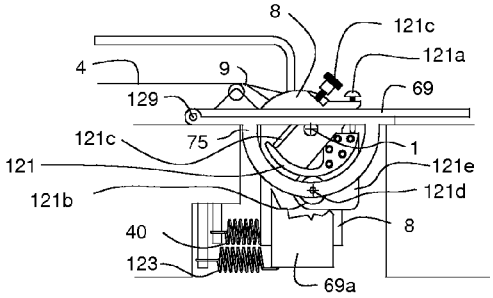

FIGS. 36A through 36C illustrate embodiments of shape-adjustable flex compensation cams applied to a vibrato having a pivot axis substantially parallel to the plane of the strings.

Figure 36D:
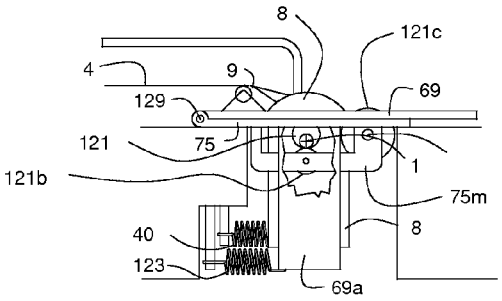

FIG. 36D illustrates a substantially conic flex compensation cam with axial adjusting means.

Figure 36E:
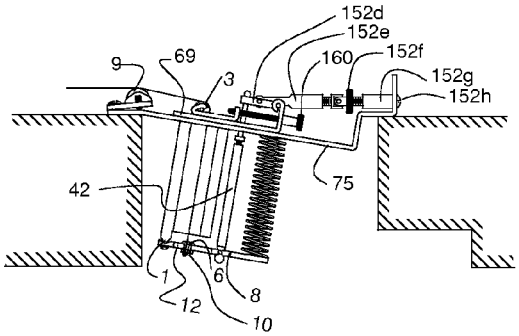
Figure 36F:
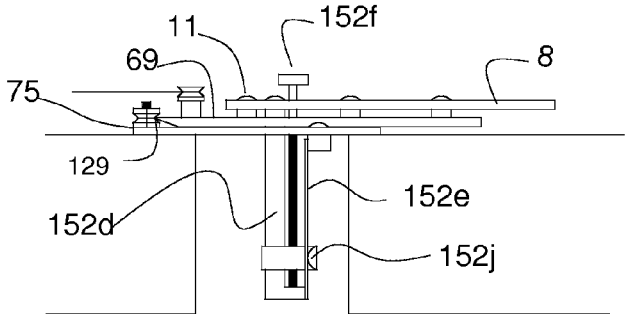

FIGS. 36E and 36F show exaggerated side views of embodiments where flex compensation is enabled by differential placement of the hubs of two connected crank arms FIGS. 37A through 38C illustrate further embodiments having individual position adjustment means for string bearing means and string guide means.

Figure 39A:
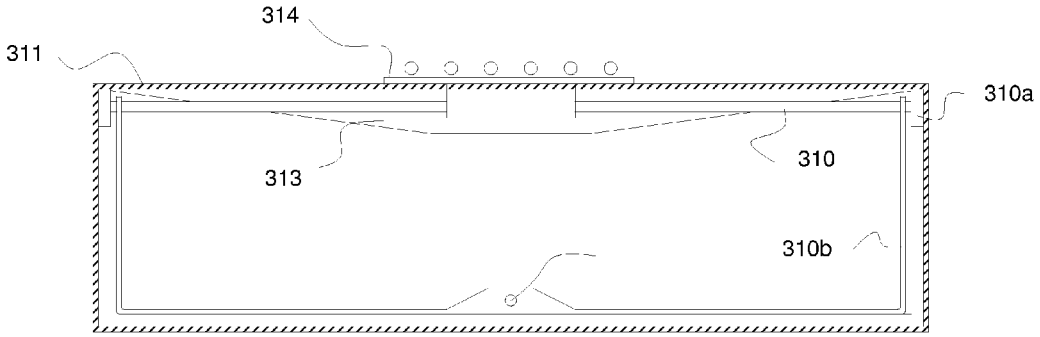

FIG. 39A shows an end view cross section of an acoustic guitar having internal spring.

Figure 39B:
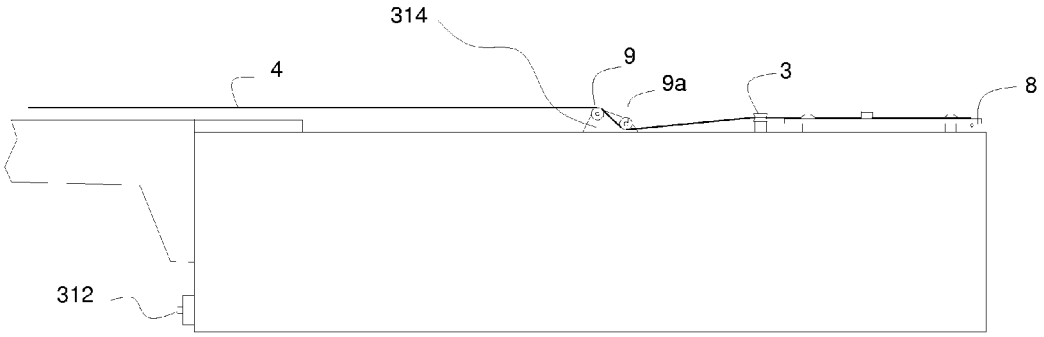

FIG. 39B shows a side view of the body of an acoustic guitar fitted with a vibrato device.

Figure 40:
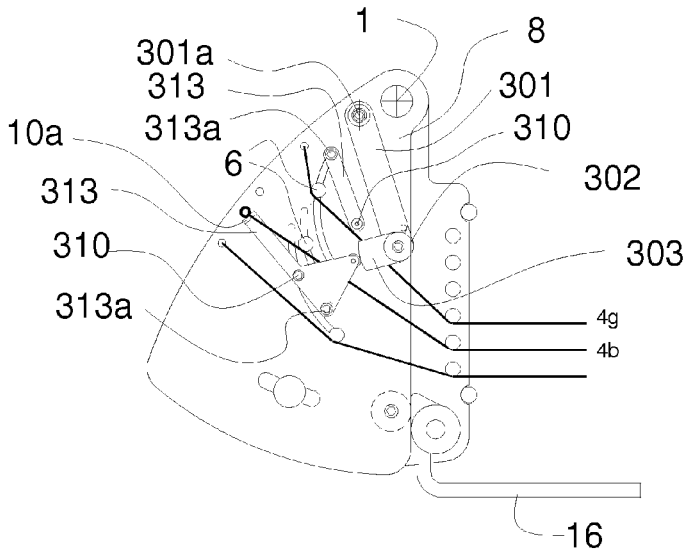
Figure 41:
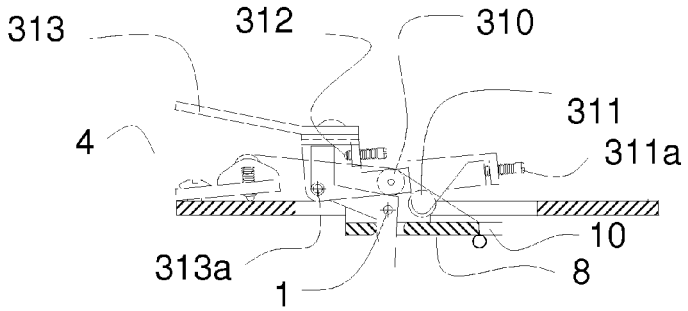
Figure 42:
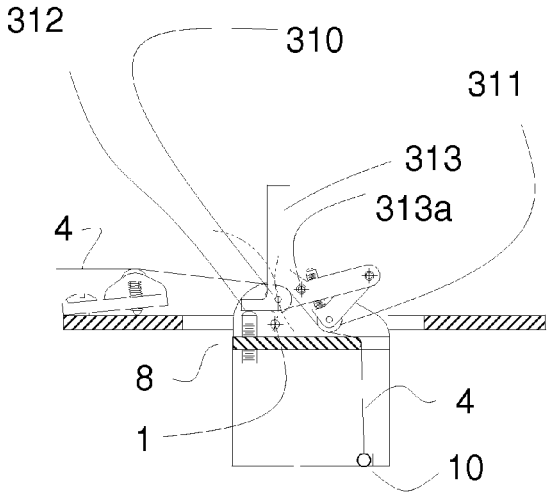

FIGS. 40 through 42 are top and side views of embodiments of vibrato devices having separate benders for individual strings.

Figure 43A:
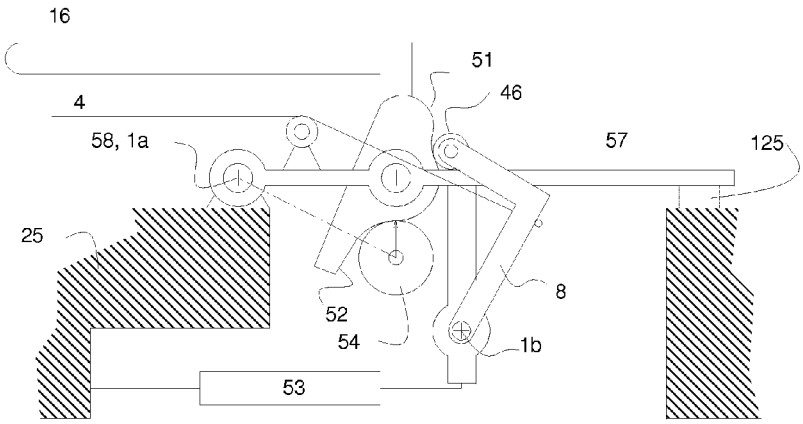
Figure 43B:
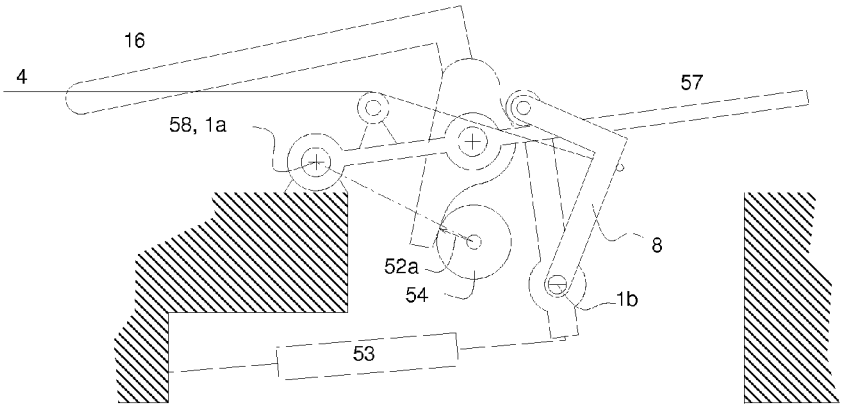
Figure 43C:
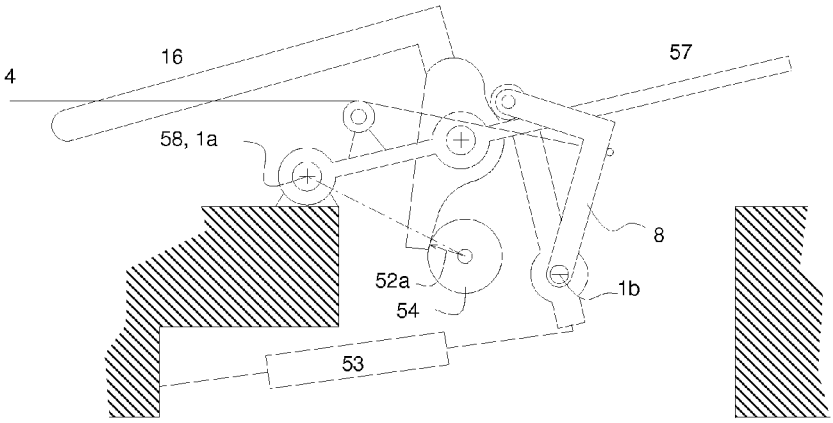

FIGS. 43A through 43C show progressive side views of a vibrato device having a cam enabled dive capability.

DESCRIPTION

In this discussion, traditional, non-transposing vibrato action and components thereof shall be referred to as "standard"; e.g. standard dive, bias, bend, bias stop. Pitch-relative vibrato action and components thereof shall be referred to as "harmonic"; e.g. harmonic dive, bias, bend, bias stop.

Dual Action Transport

A preferred cam configuration in FIG. 9C utilizes separate mechanical means for bend and dive operations. Arm 16, engaging two separate actuation means (for example bend cam 51 and dive cam 52) rotates on axis 113, fixed relative to transport means 57.

In the schematic example, a first cam means 51 has a rest surface 51.2 of constant radius over much of its useable circumference, and sharpening surface means 51.1 of increasing radius.

With string tension on main member 8 pressing cam follower 46 into first cam 51, this first cam means creates increasing pitch when rotated from the root 50.0 in the direction of increasing radius, and no tonal change when moved in the other. Cam means 51 may include the features of upper cam means 50.9.

A flattening cam 52 has an optional rest surface 52.2 of constant radius and a flattening surface 52.1 of increasing radius extending from the meeting of two surfaces at root 52.0

A biasing spring means 53, acting directly or indirectly on transport means 57 pivoting on axis 58, biases cam surface 52.2 against stop 54, thus locating cam 51 at "home position".

Said biasing spring 53 (preferably combined with other spring means) is preferably of adequate spring rate and deflection to maintain force against stop 54 during normal harmonic bends generated by the force of cam 51 on follower 46.

Preferably, rotating control arm 16 in a second direction progressively reduces string pitch by engaging stop 54 with the flattening surface of increasing radius 52.1, thus moving flattening transport means 57, and thereby moving first cam 51 away from "home" position, allowing follower 46 to follow.

The dual action cam, while illustrated with its axis normal to the string plane, may be equally applied to a device with control arm axis or main member axis parallel to the string plane, and is applicable to both harmonic and standard vibrato configurations.

The rest surfaces of bend cam 51 and dive cam 52 may be replaced with sloped surfaces having an equilibrium point substantially identical to the at rest or "home" position previously described. Where both the bend and dive cams are sloped over their entire useable surfaces, the combination of slopes enables cams of lower slope to achieve a higher displacement rate than would result from cams having constant radius sections.

Dual Axis Operation

In the preferred embodiment, said second direction of rotation of control arm 16 is in a different plane (preferably at right angles) from that used to sharpen string tone.

In the preferred embodiment, harmonic bends are implemented by rotating control arm 16 on an axis 113 substantially normal to the sting plane (when at rest), and fixed relative to dive transport 57, as in FIG. 20A, where simple linkage 42 connects main rotating member 8 to crank 16*a* (engaged by control arm 16). Crank may rest with link aligned with arm axis 113, or it may rely on stop means 125*a* to create a more mechanically advantageous rest position.

Arm 16 may optionally rotate freely on crank 16*a* until engaged by crank means 16*a*, for example via stop pin 141, or the arm and crank may preferably be combined into a single component.

Control arm axis 113 is preferably fixed relative to transport means 57 by suitable means, for example rigid shaft and journal means 113*a* and 113*b* in FIG. 19F, or thrust bearing means 113*c* between arm, crank and transport means in FIG. 20A, compressed by shaft screw means 113*d*.

Transport rotation axis 58, preferably substantially parallel to said string plane, may be fixed relative to the instrument body (or base means 69) as in FIGS. 20A and 23A, or it may be fixed relative to main rotating member 8, as in FIG. 18B. Alternatively it may be fixed relative to bend axis 113.

The tensile linkage 42 shown in FIG. 20A is illustrative only, and not intended to limit the scope to the invention. Cam, screw, rocker, or any other suitable mechanical means may be used to similar effect.

The dive transport may alternatively rotate on a shaft or journal centered on bend axis 113, and cantilevered rigidly relative to the base or body, as illustrated in FIGS. 25B-25E and discussed later.

Dual axis operation may alternatively be accomplished without said transport means as shown in FIGS. 21A, 21B, 21C, and 21D, Main rotating member 8 on main axis 1, substantially parallel to bridge means, is engaged by control arm 16 rotating on axis 113 obliquely fixed with respect to rotating member 8, at an angle that maintains arm height above instrument body as arm 16 rotates for a bend effect. Harmonic bias spring means 122 pulls rotating member 8 away from bridge means until stopped by cam 43, crank roller 105, or screw means 43*a*. Cam means 43 may be a simple radial cam as shown, or an axial cam or screw acting substantially tangentially.

Flex Compensation

The performance of any transposing vibrato device will suffer during excursions over multiple tonal steps on a low-modulus instrument, because the effects of neck deflection are non-linear with respect to changes in string tension. An optional feature of the present invention compensates for neck flex and other nonlinear displacements by moving a base means carrying one or more of string bearing means 3 (preferably coinciding with bridge 9) and main rotating component 8, slidingly or pivotably in a direction of reduced string tension. Compensation means, in the form of a cam, wedge, crank, screw, or other means translate motion of the transposing transport 101, the actuator arm 16, or the main rotating member 8, into motion of the tailpiece or bridge assembly to adjust string tension in unison, preferably by adjusting the dimensions of standard bias stop means 126. (see FIG. 19)

In FIGS. 19F, 19G, screw, wedge, or cam, means 121, forcefully engaging standard bias stop 126, one of which components moves with transposing means 101, adjusts the position of bridge carrying base 69 with respect to said bias stop, and thereby compensates for neck flex resulting from transposing action by moving bridge means 9 toward headstock as transposer is tuned to lower pitch.

In FIG. 19H linear cam means 121 and cam follower means 126*e*, with relative positioning means (for example slot 121*a*) translate motion of main rotating member 8 into displacement of base 69. FIG. 19J, illustrates a face view of cam having primary (low slope) and secondary (high or progressive slope) surfaces 154 and 155, where the length of the primary surface is adjustable by slot means 121*a*. In FIG. 19K, the slope of secondary surface is adjustable by set screw means.

Cam 121 in FIGS. 19H and 19L has a range of secondary surface slopes available from low 155*a* to high 155*b*, selectable by angularly positioning the cam with respect to the path of the cam follower 126*e*.

Alternatively, the tailpiece 69 (preferably supporting rotating member 8 and string bearings 3) may be moved pivotingly or slidingly relative to the bridge 9 and headstock to adjust the stretch of all strings uniformly. In FIG. 5B, cam, crank, or rocker means 121 rotating with the main rotating member 8 relative to tailpiece 69 rests compressively on compensation stop means 126*d*. Cam surface shape, or the initial angle of crank is selected to displace tailpiece in a manner matching the nonlinear displacement in the instrument. Slots 77*a* (for example) allow tailpiece 69 to slide under string tension with respect to base 76.

Likewise in FIGS. 5D and 5F, a moving component (for example linkage 42) acts on crank 152 pivoting on crank pivot 153 (in FIG. 5D). Nonlinearity may be enhanced by the shape of cam surface 121 on end of crank 152, or by a preferably adjustable initial gap 154*a* between moving component 42 and crank 152, or both.

Similarly in FIGS. 19A, 19E, 23A, 23B, and 23C, lifter means 150 on rotating member 8 engages rocker end 151 to rotate flex compensator crank means 152 about pivot 153.

In FIG. 19E, rocker end screw 151 adjusts axially to determine displacement of crank 152. The initial delay is adjustable by sliding or rotational positioning of lifter 150. Spring means 152*a* may also be employed to position crank 152.

In FIG. 23B, rocker end screw 151 adjusts the compensation delay, while the displacement rate may be set by positioning of stop 126 or pivot 153, or by adjusting the length or crank 152.

This method of flex compensation is suitable for any embodiment of the present invention, or any alternative transposing vibrato means, whether said bridge carrying base 69 moves angularly or slidingly with respect to instrument body, and whether the force bias on the bridge is toward or away from head stock.

The illustrations show cam and crank configurations where the rate of neck displacement diminishes with increasing pitch. By simple and obvious application of the same principles, the invention may be applied to instruments where the neck deflection rate increases with pitch. (for example by reversing the curvature of the compensating cam from that shown in the figures)

The above examples illustrate a flex compensation mechanism which opposes the force of standard bias springs (or complements string forces). By simple and obvious application of the same principles, cam means may alternatively be configured to oppose string tension, for example on a device having no standard dive bias springs.

Alternative or additional flex compensation may be provided by selecting and adjusting the rate and stroke of the harmonic and standard bias springs, so that force on the harmonic dive bias spring translates into a suitable displacement in the standard bias spring. Individual strings may also be biased.

The apparatus described will compensate for the sum of nonlinear tension effects, including neck, fastener, and hardware motion.

Similar compensation means applied to one or more individual strings may compensate for nonlinearities in the stress-strain curves of music wire.

To prevent or reduce hysteresis in the neck flexibility, truss rod cavity is preferably lubricated or fitted with low friction surface or rollers. Truss rod bow is preferably minimized to reduce friction forces acting thereon.

Improvements Particularly Applicable to a Standard Vibrato Device.

It should be noted that the actuator embodiments described for use in a harmonic vibrator are also useful on a standard vibrato device, and with the proper (uniform, for example) adjustment of guide position, a standard vibrato effect may result from at least some of the described devices.

FIG. 17A shows a simple embodiment, in which a control arm 16 directly engages main member 8, rotatable about pivot axis 1 (for example pivot studs), fixed relative to dive transport 57 or guitar body. When released following a bend, string forces, partially balanced by optional balance spring 40, press main rotating member 8 against bend stop 125*b*, fixed relative to dive transport 57. Dive transport 57 is biased against standard bias stop 126 by a combination of bias spring force 123 between guitar body and dive transport extension 57*a*, and balance spring 40 between guitar body and main rotating member 8.

Bends, performed by lifting arm 16 away from the guitar body, rotate main member 8 off of bend stop 125*b*, fixed relative to dive transport. Dives, performed by pressing arm 16 toward the instrument body, rotate main member 8 and dive transport 57 off of dive bias stop 125.

If said balancing spring 40 is used, it is preferably chosen or adjusted such that any broken string will not change the bias direction at bend stop 125*b*. Balance spring 40 and bend stop 125*b* may be hidden within the guitar body, as shown, or mounted externally for easy access and adjustment.

The present method may be used with either a standard rotating member 8, as illustrated, or a harmonic main rotating member 8.

When implemented on standard vibrato means, the present method preferably utilizes separate axes, 1 for bends (between main member 8 dive transport 57), and 129 for dives (between dive transport 57 and guitar body), substantially parallel to bridge means 9, and offset at least along string axis so as to maintain action height above frets during dives and bends. Harmonic bend and dive rotations are preferably performed on a common axis.

Similarly all other improvements to control action described herein for a harmonic vibrato device may also be used to advantage on a standard vibrato, as illustrated further in FIGS. 17B and 17C.

In FIG. 17B, the bend stop function (limiting return rotation when said device is released from a bend) is served by linkage 42 between main member 8 and actuator crank 16*a*, engaged by arm 16, rotating on axis 113 fixed relative to dive transport 57.

Rotation of arm 16 and crank 16*a* around the control arm bend axis 113, preferably perpendicular to the string plane, pulls the main member 8, away from the headstock, increasing string pitch. As described elsewhere, any mechanical means may be used to transfer this rotary action to the bridge/tailpiece assembly, for instance a crank, roller crank, cam, or linkage as shown. Stop position may be determined as shown by axial alignment of linkage 42 with arm bend axis 113, or optional stop pin described elsewhere.

Rotation of arm 16 around the dive axis, (preferably by pushing the control arm toward the instrument body), causes said bridge and tailpiece assembly to pivot toward the headstock by virtue of the rigidity of pivot shaft, boss, and washers on the bend axis, rigidly mounted to either the first or second movable components.

Where the bend axis is perpendicular to the string plane, optional latch bolt means 170, urged into latch bolt receiver 171, preferably by cam means 172 rotating with arm 16, may prevent stretch of the bias springs 40 and 123 during extreme bends, eliminating the need for excessive biasing spring tension. Cam means 172 preferably has diminishing radius (or less engaging surface) after the moving component has rotated beyond the angle necessary to insert the bolt into the receiver, so as to reduce drag. This method of preventing inadvertent dives during extreme bends may be used on either a standard or harmonic vibrato device. Alternatively, said bolt may rotate directly with arm 16, creating a penalty in bend rotation effort. Alternately, a latch bolt may be similarly engaged with a receiver directly or indirectly by the rotation of main member 8. Said insertion may be directly, or by cam means as described here, or by spring means as described in FIGS. 24*d* and 24E A latch mechanism may be used on either a standard or harmonic vibrato device.

In FIG. 17C, control arm 16 rotates on axis 113 preferably oblique to main member 8. Bias springs 40 hold cam 50 (on shaft 113*a*) stopped against cam follower 46 at rest. Rotation of arm 16 about axis 113 reduces contact pressure on crank or cam means 50, allowing bias springs 40 to pull tension into strings 4 by rotation of main member 8. Pressing control arm 16 toward instrument body rotates member 8 about dive axis 1. At rest. cam 50 and arm 16 are positioned securely in neutral position by suitable return spring means 41, and return stop means 125*a*. (or return spring cam means as described elsewhere)

FIG. 17D illustrates surface relief means useful in any control arm, where arm 16, crank 16*a*, arm pivot base 16*c*, or thrust bearing means 16*d* there between include relief means (16*b*) near axis 113, for example by counter bore means 16*b* or ball race 16*e*, to improve rigidity against rotation except about arm axis 113.

A simple embodiment for latching a dual axis device against inadvertent dives or bends comprises a cam follower of small diameter mounted at the largest possible radius from the axis of a rotating member, and engaging a bolt receiver in the form of a fixed cam of preferably zero slope in an appropriate direction. This embodiment is simpler but less preferred due to its bulk and due to its retarded latch engagement caused by the radius of the cam follower.

Full Floating Effect.

In the preferred embodiment, the ability to bend and dive simultaneously by rotating control arm on separate axes allows the user to oscillate the device about the neutral tone position while using only the inner muscles of the hand and wrist, with no discontinuities caused by stops or flatted cams.

Extreme Bends

Any harmonic vibrato device is preferably configured with stop means to prevent main rotating member or individual strings from exceeding the string wire's allowable strain. Typically the high e-string is the most stressed, and those stresses must be considered when performing a bend, especially a harmonic bend.

Overshoot means may be employed to stop one or more string anchors from rotating past the yield point of their respective strings (for example the high e-string), while allowing one or more stings to continue to bend during normal bend action of the control arm.

This is accomplished in FIG. 16A by providing a limited rotating member 178 for (by way of example) the high E string, biased against a bias stop 176 on main rotating member 8 by separate bias spring means 175, preferably anchored with respect to base 69 or body. A high limit stop 177, rigidly attached to base plate 69 or instrument body, prevents said limited rotating member 178 from over-stretching its during rotation of main member.

Similarly limited rotating member 178 engages crank means for the first two strings in FIGS. 6*b* and 6C. Main rotating cage member 179 engages limited member 178 by bias spring means 175, and unlimited member 178*a* by rigid means 175*a*. Bias stop 176 and high limit 177 are also shown.

Alternatively, after bending rotation of main member is stopped by suitable limit means, an arm bias spring may allow arm to rotate from its bias stop and to further engage separate mechanism to bend one or more discreet strings, for example the b or g string, preferably by simple pulley or crank means.

In FIG. 23D, when bending rotation of main member 8 is halted by stop 177, continued rotation of arm 16 about arm bend axis 113 tilts overbend transport 57*a* to vary the tension in one string.

An embodiment which may be preferred for its low reactive forces employs separate pivot means to allow arm to pivot upwards from body (about an axis parallel to bridge means) and engaging separate mechanism to bend one or more discreet strings, for example the b or g string, or it may pivot the entire tailpiece and bridge assembly about its standard pivot axis, away from head, allowing the g and b strings to bend more than they would in a harmonic bend.

Alternatively, the high E-string may merely be anchored relative to the body or base 69, or adjusted for zero travel, so that its tension is unchanged during harmonic bends, thus allowing higher bends without damage to that string. In the quick change embodiment of FIG. 15, a flat plate rotating member 8 has a mounting slot or hole to accommodate auxiliary guide 6*b*, positioned for reduced pitch increase. The path of the high e string 4*a* around guide 6*a* may be rerouted to path 4*b* around guide 6*b*. Guides 6*a* and 6*b* are preferably of larger diameter to reduce cyclic stress.

Alternatively, the entire device may be simply detuned using the control arm or transposing means prior to the bend, thus allowing wider bend range without exceeding string tension limits.

A simple way to incorporate extreme bends of the b or g string is to allow the tailpiece to rotate back on its standard pivots creating a standard vibrato bend when the control arm is rotated away from the instrument surface.

To accommodate this feature in a stable manner, a first standard bias stop 126 may be separately biased against secondary standard bias stop 56.9 by secondary bias spring or springs 56, as shown in FIG. 21A.

The assembly of bias stop and springs may be secured relative to the rotating standard vibrato base 69, or relative to the instrument body 25 (or sub base).

Tuning Stability

Figure 2D:
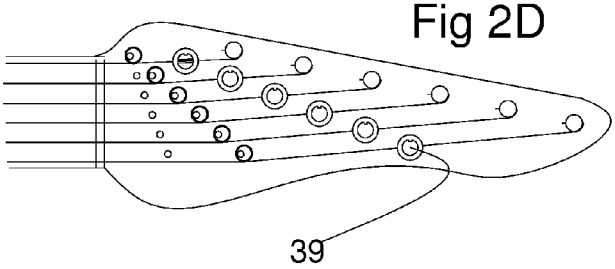
FIGS. 2A through 2H and 2J are top views of various embodiments of tuning heads using zero fret and guide post improvements.
Figure 2A:
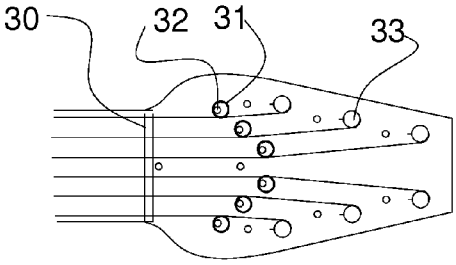

For improved precision and to prevent losing tune after a dive, the present invention may be implemented in combination with clamping of strings at the tuning head nut, as is known, or it may preferably be implemented using a low-friction zero fret 30 or nut means, preferably in combination with string guide means 31, and having locking means at or beyond said guide means, for example, commercially available locking tuners 33 of the type that will tune a string in less than one full turn of the tuning post. (FIG. 2A)

Figure 2E:
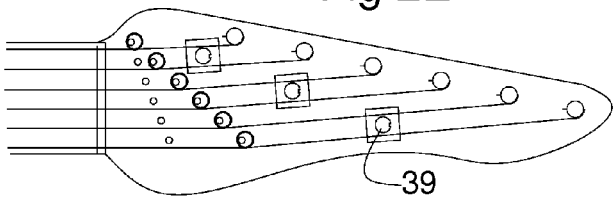

In FIGS. 2A, 2B, 2C, and 2D the guide means 31 preferably has adjustment means 32 for moving parallel to the nut or zero fret, preferably by an eccentric having an axis substantially perpendicular to the string plane. Alternatively guide spacing may be adjusted by pivoting a multitude of guides about a single axis, for instance in the center or at one end of a gang casting 34 as in FIG. 2E, where pivot and locking means may be a simple screw into the tuning head.

The use of a guide means 31 beyond a zero fret 30 provides improved playability, allowing the "string bending" technique to be used with lower effort near the head end of the neck. Means for adjusting the position of guides in a direction parallel to the strings allows adjustment of "bendability". Said adjustment may be, by multiple choice of mounting locations 31.1, or by other means. Proximity to the nut or zero fret reduces harmonic losses.

Alternatively, precisely or adjustably located locking tuners of the type previously described provide some benefits when used in combination with other components of the present invention. For example, tuners may be mounted with the post through an eccentric bushing.

"Action height" In FIG. 7B a zero fret or nut is preferably elastically cantilevered about a bending axis parallel to said zero fret, and is adjustably secured from motion and vibration by compressive set screws 61.1 and tensile hold down screws 61.2.

The cantilever is preferably the extreme end 62 of the fingerboard itself, preferably having interlaminar reinforcement 63 at the line of separation from the neck, for example anchor screws or stitch means substantially perpendicular to the fingerboard.

Retrofit

The present vibrato invention may be made to retrofit onto an existing guitar by bolting baseplate means 69 or 76 to the guitar body. Alternatively, base means 69 or 76 may be the guitar body itself.

Figure 2B:
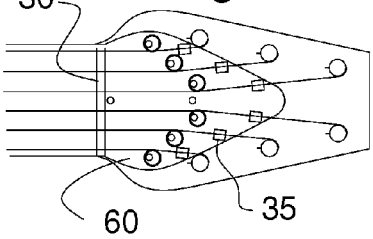
Figure 2F:
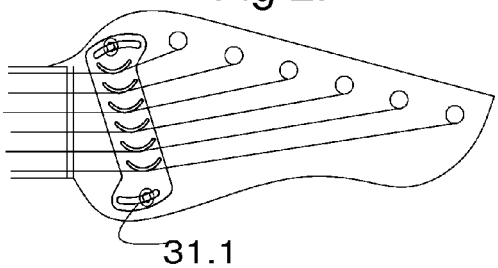
Figure 2C:
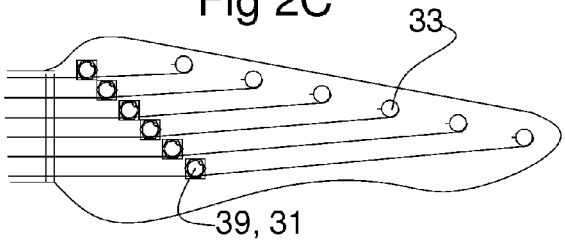
Figure 2J:
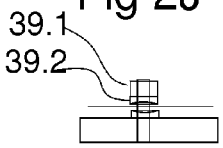

A preferred retrofit tuning head flange assembly in FIG. 2B, for example to fit to a highly raked tuning head, includes a flange 60, preferably of flat metal or composite, to which is attached string bearing means 35 to reduce string angle across zero fret or nut and string guides 31 preferably having adjustment means 32 to adjust string spacing, A nut or zero fret 30, preferably with vertical adjustment means, may also be incorporated onto said flange. Attachment means may include molding, or machining, or forming a combination of flange 60, guides 31 and bearings 35 from a single solid mass, preferably at comprising low friction material or coating.

Figure 2G:
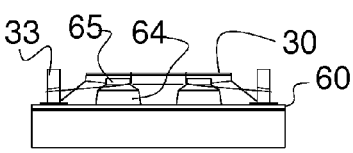
Figure 2H:
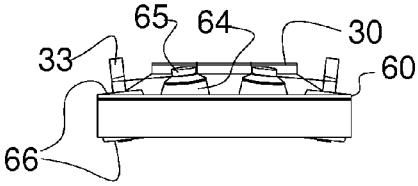
Figure 3A:
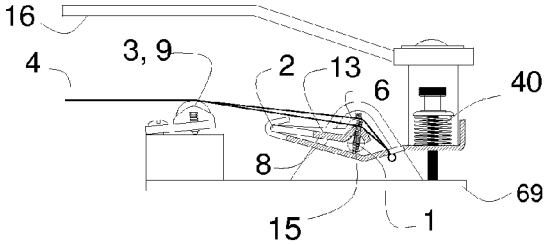
FIGS. 3A and 3B are side views of a vibrato mechanism with rotational axis substantially parallel to the bridge.
Figure 3B:
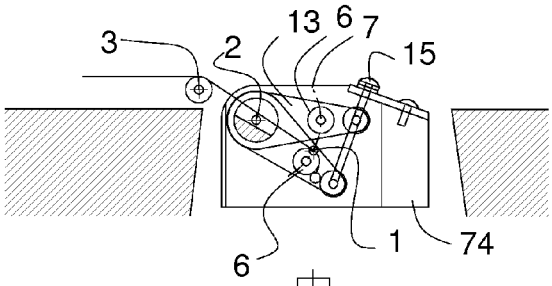
Figure 3C:
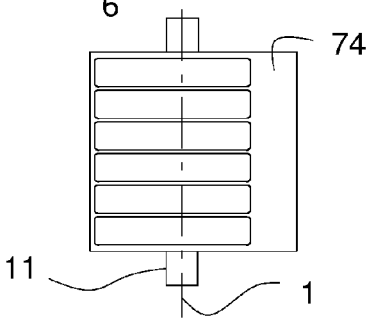
FIG. 3C is a top view of a vibrato housing with rotational axis substantially parallel to the bridge.

For retrofit of flange 60 onto severely raked tuning heads, as in FIGS. 2G and 2H, string bearing means 35 and string guide means 31 are preferably combined into a single roller 66 for each string, preferably having lateral adjusting means, for example eccentric or slotted mounting means. With a beveled flange on said roller 66, boss 65 aligned with bearing axis may be normal to head face as in FIG. 9H, or preferably canted, as in FIG. 9G., with axis substantially normal to the plane of the string path. Tuning machines 33 are preferably mounted with axes normal to string plane at tuner, for example using beveled boss 67 to align tuning machine 33 to guide roller 66. Flanged roller 66 is preferably countersunk into flange 60 or boss 65 to reduce required precision during restringing.

Control arm 16 preferably has separate outer arm 16*b*, positionable by adjusting means 16*c*, for example opposed flanges compressed by screw means as in FIG. 12A.

Arm may have control surfaces engageable by players fingertips substantially normal to each major direction of motion, as in FIGS. 9A and 16H. In an alternate embodiment, one or more projections 73 extend substantially radially from an arcuate control arm 16. as in FIG. 12A. A preferred embodiment of a control arm comprises a handle 73, extending inwardly from a lever having a shape which circumscribes an area typically populated by electronic controls, and further includes fastening means for securing said lever to a moveable member of a pitch change device.

FIG. 12B shows an alternative embodiment wherein control arm extends under pick guard or other solid surface means 79. Control end 73 may extend in any direction from arm 16. Alternatively, arm may be bent to desired shape by user.

Any alternative means of engaging vibrato device may be applied, for example a footpedal with flexible cable coupled to the control cam, or coupled directly to the main rotating member.

Rotation of control arm in two planes may be used to perform 2 differing tonal adjustments, for instance bending the b-string or some other subset of strings may be assigned to rotation in one plane, while rotation in the other plane affects the entire string complement.

Alternatively rotation in one plane may be used to set and release locking mechanism or brake for the rotation in the other plane.

An optional second adjustable stop means 49 (preferably a manually adjustable cam and follower) in FIG. 9A (between rotating vibrato member 8 and instrument body) may act as a low pitch stop, so that when control arm 16 of an unbiased device is released, main rotating member will come to rest on said stop.

In a preferred embodiment shown in FIG. 25A, rotation of the arm downward about an axis substantially parallel to the bridge results in a standard dive, while rotating the arm toward the stings about an axis substantially normal to the sting plane results in a harmonic bend. By simple modification, for example using means described in this disclosure, the range of rotation on both axes may be modified to include both dive and bend.

Float about Neutral Position.

It is desirable on any vibrato mechanism that biasing forces be maximized at rest while providing for smooth easy travel of the arm during dives and bends. It is further desirable in a device having a dual axis control arm mechanism that rotation in one axis not cause, for example, inadvertent deflection of dive biasing spring due to increased string tension during a bend.

String force during a harmonic bend with a the described device is less than a maximum bend with a standard device, due to the reduced stretch on all strings except the high E string.

A preferred embodiment uses mechanical means having nonuniform purchase to generate a dive when the transport means is tilted. The high purchase at rest resists inadvertent dives due to increasing string tension, while the lower purchase when activated provides both increased response and more constant effort over the dive range.

An example of such mechanical means shown in FIG. 25C, uses two rollers having axes in substantially perpendicular planes, one mounted to the control arm shaft or journal 113*b*, and the other mounted to the main rotating member 8. One of the rollers preferably has an axis substantially parallel to the dive pivot axis 58, and the other preferably has and axis substantially parallel to the bend pivot axis 113.

One or both rollers may be axially contoured to improve the feel and reduce effort in bend and dive action. The roller mounted to the main rotating member 8 is nominally the cam follower.

Pivoting said control arm in a bend direction about said bend axis causes forceful separation of said cam follower and said bend axis. Tilting said dive transport about its dive axis allows string tension to reduce said separation, by controlled travel of cam follower across the axial contour of said roller. (Note said contour may alternatively be solidly fixed to said rocker, eliminating said roller, with a mild penalty in required bend effort.

The bend and dive functions may be performed by two separate mechanisms, and in another embodiment of the invention, the dive mechanism uses a cam surface or crank to vary the purchase with the travel of the main rotating member.

FIGS. 25A through 25D illustrate examples of control arms having journals 113*b* rotating on shafts rigidly cantilevered from the base 69.

In the simplest embodiment, FIG. 25A, the journal includes a circularly cylindrical outer surface against which rotating member 8 or separate (preferably resilient) stop material 125*a* rests when arm is inactive. Said stop acts as a brake against said cylindrical surface when inactive, to hold control arm 16 in playing position or away from playing position. Separate rocker, or cam, or roller means 43 presses against roller or follower 46 to rotate main member 8 in a direction to increase string tension, when control arm is rotated about its axis 113 in a bend direction. When control arm is pressed toward instrument body, the rigidity of said cantilever rotates base 69 away from stop 126 to generate a standard dive. When released, standard bias springs 123 (preferably pulling on spring block 119) return base 69 to its at rest position.

In FIGS. 25B, 25C, and 25D said journal 113*b* includes pivot bearing means 58 to support dive transport lever means 57, said transport biased against said journal by harmonic dive bias spring 122.

FIG. 25B illustrates the application of such a transport to a simple tensile linkage between said transport 57 and said main member 8.

FIG. 25C illustrates the application of such a transport to a control mechanism wherein two rollers rotating on (preferably perpendicularly) skewed axes allow low friction rotation of control arm 16 about either the bend axis 113 or the dive axis 58.

In FIGS. 25C, 25D, and 25E the master roller 211 drives slave roller 212.

In FIG. 25D, one of the 2 skewed rollers is axially contoured in order to increase the torque on control arm 16 generated by string tension as the arm progresses through a dive, thus partially compensating for increasing torque generated by bias spring(s) 122, and improving the feel of the device.

FIG. 25E shows a similar contoured roller configuration wherein transport 57 comprises a journal rotating on a shaft 58*a* cantilevered from (preferably)) a plate 69*a* projecting from base 69.

From FIGS. 25D and 25E, force vectors and moment arms about transport dive axis 58 may be compared for two dive positions. The string force vector 210*a* at rest is high but its moment arm from the dive pivot axis 25 is short, leading to stability at rest. When displaced in a dive the string force vector 210*b* diminishes, but its moment from axis 58 increases, reducing manual effort necessary to overcome the torque of dive bias spring 122.

The shafts cantilevered from base 69 or 69*a* in FIGS. 25B to 25E may alternatively be cantilevered from said main moving member 8. Transposing means as described elsewhere herein may also be incorporated into said embodiments, with master or slave rollers displaced by transposing mechanism.

Skewed rollers may be implemented with any suitable arm and transport configuration.

In a pair of skew rollers, the roller not associated with the control arm is preferably skew to the control arm bend axis, and is long enough for to engage the outer surface of the control arm journal, so that part of said roller may act as both a "stop" and a "shaft brake" similar to that described in the discussion of FIG. 25A.

An alternative embodiment applicable to standard or harmonic bends includes a dive lock bolt mechanism (as shown in FIG. 17B) to prevent inadvertent dive during extreme bends. Slight rotation of the control arm in the bend direction causes the bolt to engage the receiver, preventing the transport from rotating in the dive direction. Actuation of said bolt means by said arm rotation is preferably via cam means, with cam radius diminishing or constant during further rotation after said actuation, to avoid restriction of bending motion.

Isolation

Harmonic dive bias springs anchored relative to body or sub base may prevent inadvertent standard dive by increasing the net standard force bias away from the tuning head, particularly if said harmonic bias springs are oriented normal to the string plane, and the harmonic dive pivot axis is located a substantial distance from the standard pivot axis in the direction of the harmonic dive bias springs. In this instance, downward pressure on the control arm creates downward force at the harmonic dive pivot axis as a multiple of the harmonic dive bias spring force, and that downward force prevents unwanted rotation of the base about the standard pivot axis.

Therefore, at least part of the harmonic dive bias spring set should be anchored relative to the body (anchored to the body or subbase) rather than to the base. In this configuration, depending on the placement of the harmonic dive pivot axis, and the bias spring force direction, little or no standard biasing spring may be necessary.

In FIG. 24B a connecting rod extends through the body (perpendicular to the string plane) from the harmonic dive transport (pivoting on an axis substantially parallel to the string plane) to a bellcrank 204 within the body, and in turn connected to bias springs extending substantially parallel to the string plane. Typical bias spring and claw configuration of the prior art may be connected to the bell crank, for example.

By redirecting the force of the standard bias springs, the bell crank provides the following benefits: 1) High bias spring tension (desired by some musicians to improve tone) does not create excessive stress on standard pivot posts, as in the prior art. 2) springs may be located away from magnetic pickups to prevent unwanted signals, and 3) rod connection may be located at an oblique angle from crank axis so as to provide variable purchase as crank rotates, thus reducing required spring tension.

Alternatively, said harmonic bias spring may extend normal to the string plane, thus eliminating the bellcrank, or a crank (integral with said harmonic dive transport) may extend through the body substantially parallel to a standard spring block as shown in FIG. 24A.

For musicians who prefer high bias torque at rest in a quest to maximize sustain, this embodiment allows maximizing bias torque at rest. This configuration allows reduced effort along with increased sustain.

In a preferred configuration, a combination of bias springs would exert forces both parallel and normal to the string plane.

Bias Force Adjustment During a Dive.

Harmonic dive transport bias springs are terminated on the body of the instrument (or sub base) rather than the base plate, thus reducing the required tension on standard bias springs, and minimizing playing effort.

In FIG. 24B, the bias spring (in either a standard or harmonic device) anchored to the body 25 engages a variable purchase device, for example a bellcrank 204 on bellcrank pivot 204*a*, as shown, said bellcrank in turn engaging a connecting rod 57*a*, in turn connected pivotingly to the harmonic dive transport 57.

Bellcrank is preferably configured to reduce the purchase of said bias spring on said connecting rod as the transport rotates from its stop 125 about transport pivot 58. This configuration allows a lower spring force to effect higher biasing torque on the base 69 when at rest, while creating less force on pivots 129 parallel to said strings. Said pivot surfaces are preferably angled to resist downward force on said base On a standard vibrato, the connecting rod may connect to a dive transport or directly to the main rotating member 8, or to a block extending from said member 119, as illustrated in FIG. 17F.

Multiple bias springs according to more than a single embodiment described herein may be implemented in a single instrument, to achieve the desired effect.

For musicians who prefer high bias torque at rest in a quest to maximize sustain, the embodiments of FIG. 24B (and to a lesser extent FIGS. 17E and 24A) maximize the bias torque at rest without excessive bias torque during a dive.

Bias Force Adjustment while Bending.

In FIG. 17E, a bend return spring(s) 201, acting through bend return crank 200, induces torque in control arm 16, opposing the torque induced by bias spring(s) 123 and follower 202, preferably fixed relative to body 25. Arm bend shaft 113*a* rotates on axis 113, with axis preferably fixed relative to main rotating member 8, substantially perpendicular to the string plane 4.

Rotation of control arm 16 about bend axis 113 reduces force between follower 202 and crank 200, allowing the force of bias springs 123 and return spring 201 to pull the strings to higher pitch by rotating vibrato rotating member 8.

Bend stop 114 limits the return rotation of return crank 200 when at rest. (It is shown as a pin for schematic purposes only, and may be of any functional form. One of the stop surfaces is preferably of a resilient material.)

Separate standard bias spring 123 and return spring 201 are preferably separately adjustable, for example by separate claws 203, as are common in the art.

Similarly In FIG. 24A the same method may be used to prevent inadvertent harmonic or standard dive during an extreme harmonic bend, when the bend axis is substantially perpendicular to the string plane.

Simulated Dual Axis Operation

Still another alternative embodiment of the invention simulates dual axis control by extending the control arm from pivot means having a pivot axis substantially parallel to the strings.

Rotation of said arm toward the strings engages the vibrato device through suitable mechanical means to generate a bend effect, while rotation away from said strings and toward instrument body generates a dive effect. Said device preferably includes one or more biasing means to provide a free floating or a stable floating effect about the neutral position.

FIGS. 26A and 26B illustrate an example where the pivot means is a shaft 113*a* rotating on axis 113, preferably substantially below and parallel to the strings. An arm 16, preferably curved to provide suitable neck and body clearance, radiates from said shaft, having a handle 16*c*, also preferably parallel the strings 4.

The shaft engages the vibrato unit by suitable means, for example by a connecting rod 42 pivoting on crank arm 16*a* extending from the shaft 113*a*, and attached to a movable member 8, as illustrated in FIG. 26A.

The device may utilize any biasing means, eg simple bias springs (not shown) connecting the rotating member 8 or a crank from shaft 113*a* to the instrument body 25.

In the example shown in FIG. 26A, the biasing means for the vibrato rotating member 8 is provided by return spring 56 pressing cam follower 55.9 toward cam 55, also rigidly attached to shaft 113*a*. The angle of contact of the cam with the follower is preferably adapted generate forces opposes to the string tension Preferably a slight change in angular contact at the neutral position provides tuning stability when the return spring 56 is properly adjusted, as previously disclosed.

The cam follower 55.9 rotates on a shuttle 56*a* (or alternatively a rocker) providing stable contact between cam 55 and cam follower 55.9 by confining the cam follower to a linear or arcuate path, and resisting unwanted tangential motion of cam follower about the cam.

The actuation arm 16*c*, substantially parallel to the strings in FIGS. 26A and 26B may alternatively have the shape of a cylindrical control surface (not shown), preferably coaxial with shaft 113*a*, and of sufficient radius and surface friction to enable a rolling action with the palm side of the fingers while playing.

In examples of alternative embodiments, the combination of arm 16, shaft 113*a*, and handle 16*c*, take the form of a full or partial drum surface as in FIG. 26C, or a contoured or substantially planar surface (for example a pickguard) hinged along an axis substantially parallel to the strings, as in FIG. 26D.

In alternative embodiments, the biasing means includes a cam and follower, at least one of which is moveable relative to a base, where rotation of the arm 16 is associated with relative motion of said cam and cam follower, such that rotating the arm 16 in one direction (preferably downward, away from the strings) alters the bias position of the main member 8 in a direction of increased bias spring force, for example similar to the device described with respect to FIG. 9C. Shaft 113*a* may connect directly or indirectly to said one or more cam, and may be configured to bend or swivel or link to intermittent arm or shaft means.

Muting

A preferred stringed instrument configuration includes a volume or muting control having a preferably cylindrical control surface moveably in a direction substantially tangential to an axis substantially parallel to the strings, for example a finger wheel 263 as shown in FIG. 26B.

This surface is associated (preferably by a shaft 262) with an electronic sensor 260 (preferably a potentiometer) wired, for example as a volume control, or as a separate muting (or gain) control, with the control surface immediately adjacent the strings, and with shaft axis substantially parallel to the strings.

Typically the volume control on an electric guitar comprises a potentiometer of high resistance relative to the pickups, wired as a shunt parallel the pickups. The main volume control pot is sometimes used as a mute by dragging the edge of the small finger against a knurled knob. A present embodiment improves control by exposing a preferably cylindrical surface 263 to the inner surface of the fingers as shown. This pot may be used as the main volume control pot, or it may be a separate dedicated muting pot, preferably parallel to the first.

An embodiment of a pot used for muting is illustrated in FIG. 26B, and preferably includes a return spring 261 or a detent (not shown) associated with shaft 262, returning the pot preferably to a high shunt impedance after use, or preventing inadvertent rotation. The spring is preferably of a non magnetic material to prevent interference with magnetic pickups. Alternatively, the shaft 262 between the finger wheel 263 and the pot 260 is long enough to effectively isolate the spring from the pickups, as illustrated. The muting pot preferably generates essentially infinite resistance at rest (when used for muting) and may preferably be rotated to drop to zero resistance.

In one embodiment the muting pot may be switched (preferably by simple electrical switch means) from a muting function to a controller function as described with regard to an electronic vibrato arm. The device may alternatively be adapted to control other functions or effects without regard to muting.

In another embodiment a device (such as a pot) connected to a single wheel when rotated one direction serves one function (such as muting), and when the wheel is rotated in the opposite direction from neutral the same device or a separate device connected to the same wheel serves a second function (such as control of an internal or external effects controller by connection thereto)

In another embodiment multiple control surfaces (for example wheels or paddles) rotating on concentric or parallel shafts connect to separate (preferably resistive) devices to control multiple functions. An embodiment includes a separate return spring associated with each of one or more wheels or paddles.

Connection to an external effects controller is, for example, by any of the means described with regard to an electronic vibrato arm sensor.

The at rest resistance of a resistive device used to control an external device is preferable switchable (for example by reversing the connections on a pot to change the direction of operation) and configurable (for example by connection to a parallel characterizing pot to adjust the rate or range of operation.) In another embodiment any of multiple resistive devices associated with the same control surface are switchably interchangeable in a common circuit.

The body (FIG. 26B) preferably has sufficient open area to allow clearance for manipulating the control arm 16 or control surface 263, or both. To enhance the open area in an embodiment shown in FIG. 26E, a cantilever knee rest 16*k* of high strength material, for example steel or composite, is fastened to a body of a generally weaker material (eg wood) by suitable means, for example wood screws or adhesive resin. In alternative embodiments a reinforcing material is molded into or attached to a body having a cantilevered knee rest portion.

It should be understood that in at least one embodiment, either of the shafts 113*a* or 262, or the actuator drum 263 of FIG. 26B engages an electronic sensor (for example a potentiometer) configured to or switchable to provide a (preferably resistance) signal to an effects processor for the pu.

Additional Flex Compensation Crank Embodiments.

In FIGS. 36E and 36F flex compensation adjustment is accomplished by adjustment of location of the pivot points of two articulated crank arms.

In FIG. 36E transposing base 69 supporting string bearing 3 slides, rolls, or pivots on sub base 75 in the sting direction. Crank arms 152*d* and 152*e* are connected pivotingly at their endpoints to each other. Compressive arm 152*d* pivots from its hub on transposing base 69. Arm 152*e* pivots from a universal joint rigidly attached to axial adjuster 152*f*. threads on both sides of the adjuster are identical, so that rotation of the adjuster moves the location of the u-joint axially, without changing the combined length of tensile arm 152*e* adjuster/u-joint assembly 152*f*, and tensile base 152*g*.

Vertical location of base 152*g* may also be adjusted by lock screw 152*h* connected through a slot in preferably arcuate end plate of sub-base 75.

Control push rod 42 engages one or both crank arms and main member 8, so axial motion of pushrod results in rotation of main member 8 about main axis 1 to change sting pitch, and further results in sliding motion of transposing base due to the induced rotation of arms 152*d* and 152*e* about separate pivot points.

In FIG. 36F a compressive arm 152*d*, rigidly connected to rotating member 8, extends downward to connect to the end of preferably flexible tensile leg 152E, connected on its other end to sub-base 75. Rotation of main member 8 about main shaft 11 in a dive direction causes an increase in tension in leg 152*e*, lifting ling 152*d*, main member 8, and base 69 arcuately about pivots 129. Adjustment of jack screw 152*f* moves lower pivot point 152*j* upward or downward, thus changing the effective of movable tensile arm 152*e*.

Additional Examples of Flex Compensation Cams

In the embodiment shown in FIG. 36A a main rotating member rotates on shaft 11 with an axis fixed relative to base 69 and base extension 69*a*. to change the pitch of stings 4. Cam follower 121*b* mounted directly or through separate crank means to, for example, main member 8 rotates about the same axis, and engages cam 121, mounted to sub base 75. Engagement of cam 121 with follower 121*b* opposes the (tensile in this example) force of bias springs 123 between base extension 69*a* and instrument body 25.

In the example, cam 121 has a preferably substantially circular concavity defining the cam surface. On the end adapted for attachment to the subbase 75 (or body) the cam is substantially rigid (with respect to the forces encountered in the application The position of cam 121 is adjustable in a direction substantially parallel to the at-rest line of tangency (in the string direction) between cam and follower, for example by using lock screws 121*a* in horizontal slots through sub-base. Said adjustment enables a setting a slight eccentricity between cam concavity and main shaft 11, preferably to compensate for neck deflection by allowing the bias springs to pull the base 69 downward during a bend, for example.

The side of the cam opposite neutral pitch contact point is preferably a flexible extension as shown. Dive compensation set screw 121*c* pulls (in this example) the flexible cantilevered portion of cam 121 to a suitable shape to compensate for neck deflection throughout a dive.

In creased pressure between cam 121 and cam follower 121*b* during a dive causes base 69 to rotate counterclockwise about pivot point 129. Relaxed cam pressure allows bias springs 123 to move base 69 in a clockwise direction.

FIG. 36B shows an embodiment of a pivoting base comprising two main components articulated at pivot 129*b*, an upper plate 69*c* from which the main member 8 rotates about shaft 11, and a lower component 69*a* pivoting relative to the instrument body (or separate intermediate components). ("Upper" and "lower" designations are only for identifying components in the figure.) In the example, standoffs 69*b* are used to enable setting the height of typical pivot posts, but any pivot means may be employed. Rotation of lower member 69*a* from its biased position causes bridge 9 to move upward and toward the tuning head, uniformly reducing stretch of the strings, while minimizing the differential effect of intonation and action height on the displacement of individual strings, but while still raising the strings to reduce likelihood of fret buzz at the lowered tension.

In embodiment shown, the tail of upper base 69*c* slides over a cam surface to elevate it from the deck during forward motion. In the simplest embodiment it drags straight across the deck or a separate skid component. In a more complex embodiment the upper base 69*c* is articulated on separate crank arm or arms which rotate with the rotation of lower base 69*a*.

FIGS. 36B and 36*c* illustrate embodiment having a cam 121 having set screw means 121*a* and 121*c* to adjust both the eccentricity and shape of the cam.

In FIG. 36B the cam body pivots on preferably the same axis as shaft 11 of the main rotating member 8. The concave cam surface 121, substantially circular, has an axis preferably offset from the axis of shaft 11, and preferably elevated therefrom. Correctly adjusted opposing tension on setscrews 121*a* and 121*c* (extending from main member 8) positions and shapes the cam 121 for flex compensation in both bend and dive situations. Alternative embodiments of a convex cam surface similarly mounted utilize opposing compression on the two adjusting screws.

In the articulated base embodiment of FIG. 36B, rotating main member 8 in a dive direction (counter clockwise about shaft 11) causes cam 121 rotating with main member 8, to pull follower 121*b*, which inturn results in rotation of lower base 69*a* about pivot 129 on subbase 75 from its biased position. Upper base 69*c* lifts on pivot 129*b* and moves toward the instrument neck. Rotation of main member 8 in the opposite direction has the opposite effect.

In the embodiment shown in FIG. 36*c*, cam 121 is attached to or contiguous with cam base 121*e*, pivoting on an axis 121*d* approximating the at rest location of the axis of cam follower 121*b* when at rest. In the example, the cam is attached relative to the main rotating member 8, and the cam follower attached to lower sub-base 75.

Adjustment of cam 121 about axis 121*d* (using setscrew 121*a*) thus has little or no effect on displacement of base 69 when at rest.

Adjustment of opposing compression on the two adjusting screws 121*a* and 121*c* positions and shapes the convex cam 121 to move base 69 correctly in response to rotation of main member 8.

In an alternative embodiment, an example of which is shown in FIG. 36D, cam 121 comprises a conic shape, preferably having one edge parallel to the main member axis of rotation 1. Cam follower 121*b*, is preferably mounted to sub base 75, with an axis parallel to main axis 1, and adjustable parallel to axis 1, for example by set thumbwheel 121*c* means or set screw means engaging a moveable bracket 75*m*. Axis 1 of main rotating member 8 is fixed preferably relative to base 69 such that changing pressure on cam surface cause rotation of base In embodiments shown and not shown, a cam and follower are attached, one relative to a rotating member, and the other relative to a relatively fixed component. One or more adjusting means engages the cam or the cam follower or both to change the cam shape, or the relative position or orientation of cam and follower at rest, such that rotation of the rotating member causes displacement of a component, displacement of which causes a more uniform change in the stretch of the strings than the does rotation of the rotating member alone.

In embodiments shown and not shown, displacement means engage both a moveable component and a relatively fixed component such that motion or rotation of the moveable component causes positive or negative displacement of a third component (depending on the direction of motion or rotation of said moveable component) displacement of which causes a more uniform change in the stretch of the strings than the does motion or rotation of the moveable component alone.

Additional Flex Compensation Means

In FIGS. 37A through 38B (as well as FIG. 5E) the positions of the string bearings 3 is adjustable so that the at-rest deviation from tangency of each string relative the main pivot axis 1 at the string guide 6 is individually adjustable.

The guides of the lower pitched strings are preferably adjusted so that, as the main member 8 rotates in a dive, the stretch on those strings diminishes at an increasing rate. In the figures shown, such an adjustment would result in the guides 3 being adjusted closer to the bridge 9 than if adjusted for a instrument having absolute rigidity. Proper device adjustment of such an embodiment requires an iterative adjustment of the guide and bearing positions until proper transposition and compensation are both achieved.

Figure 37A:
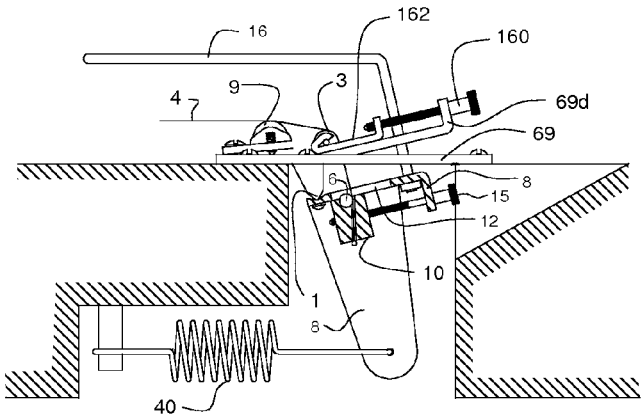
Figure 37B:
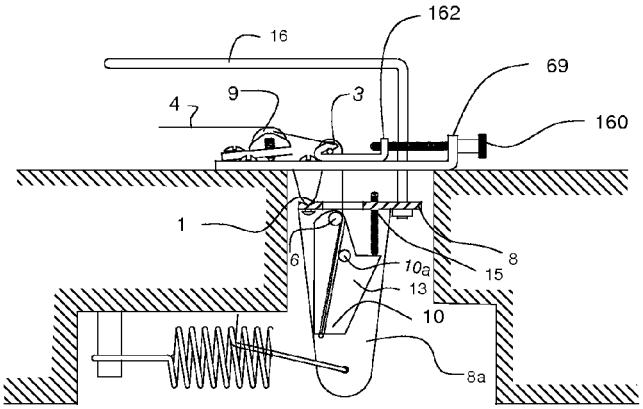

In the examples shown in FIGS. 37A and 37B, the string bearing 3 is supported by a carriage 162 riding on slotted base 69 (or base extension 69A in FIG. 37A, preferably angled from base 69 to improve access to guide adjusting setscrew 15). The carriage is preferably held in place by the opposing forces of string 4 tension, setscrew 160 tension, and base plate 69 support.

The position of either the bearing 3 or guide 6 may alternatively be adjusted angularly. In the embodiment shown in FIG. 37B setscrew 15 adjusts the angular position of string anchor block 10 about axis 10*a*, preferably defined by a common pin between the two extensions 8*a* of the main rotating member.

In FIG. 37A the radius of string anchor block 10 (comprising guide string guide means 3) from main pivot axis 1 is adjustable by setscrew 15. Anchor blocks 10 in FIGS. 37A and 37B are preferably tall enough to isolate guide 3 from contact with the ball end lashing of commercially manufactured strings.

In FIGS. 6D and 6E a degree of flex compensation may is obtained by adjusting the pivot anchors 22.2 and 8.2 of tie rod 24 (for each string) to achieve proper deviation from tangency at rest so that rotation of main member 8 in a dive, for example, results in a properly changing rate of string tension. Again, proper device adjustment of such an embodiment requires an iterative adjustment of the tow pivot anchors for each string until proper transposition and compensation are both achieved.

Figure 37C:
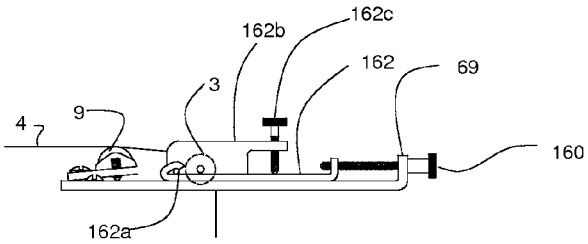

FIG. 37C illustrates an example of guide adjustment carriage 162 incorporating a separate fine tuning block 162*b* preferably pivoting on pivot means 162*a*. String bearing means 3 is supported by the fine tuning block 162*b* Adjustment of finetuning setscrew 162*c* enables fine tuning by raising or lowering the finetuning block from the carriage base, while adjustment of carriage adjustment screw 160 separately enables string angle adjustment for transposing and flex compensation.

Figure 38A:
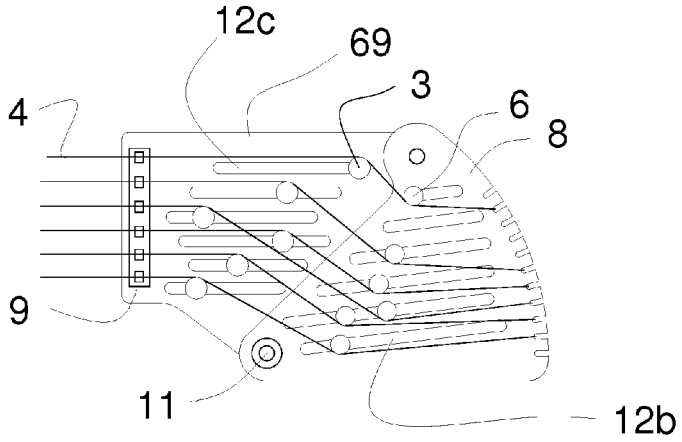
Figure 38B:
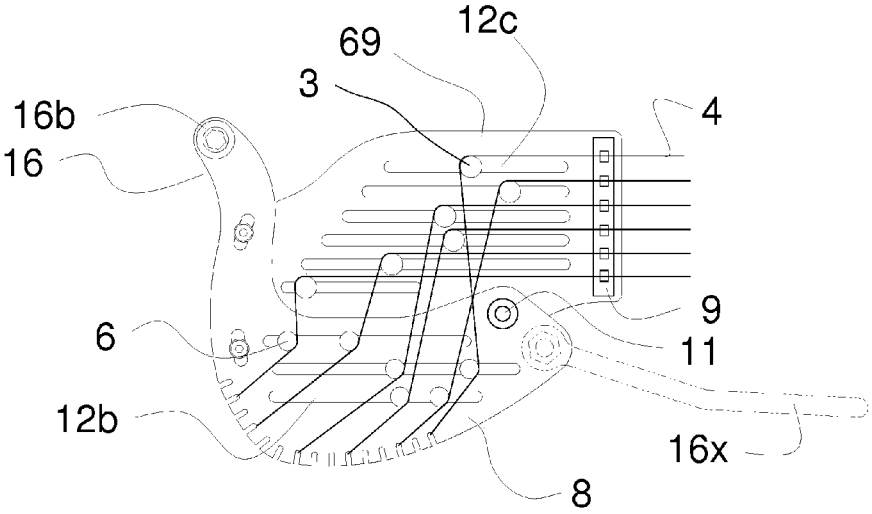

FIGS. 38A and 38B show examples of an embodiment having adjustably positionable string bearing means. In the example, string guides 6 and string bearings 3 are independently positionable on in tracks 12*b* and 12*c* respectively. Using an iterative procedure as describe above, the position of guides and bearings is adjusted until, rotation of main member 8 results in pitch relative change of pitch of all (connected) with minimum effect of neck deflection.

In FIG. 38B, the location of the pivot shaft means 11 on the opposite side of the strings from other embodiments allows simple direct connection of a control arm 16*x* in the traditional location, or economically integrated rear control arm 16, preferably having a (for example cylindrical) forearm rest 16*b* extending perpendicularly from the face of the arm.

Figure 38C:
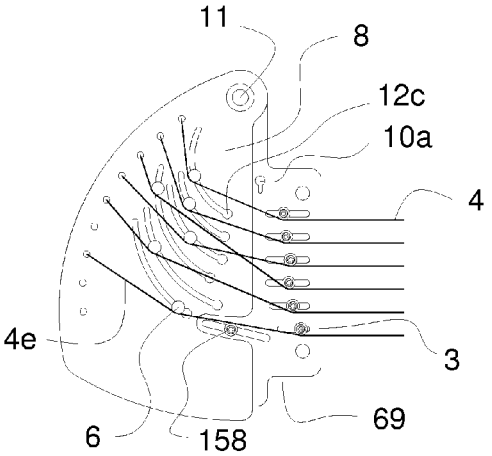

FIG. 38C describes a less preferred embodiment where the effects of neck deflection are reduced slightly by retarding the detuning of the high e-string 4*e* relative to rotation of main member 8. By inserting an impediment guide 158 (preferably mounted adjustably in a slot in base 69) in the path of string 4*e* the rotating member 8 is forced to rotate further to detune additional halfsteps, thus giving the lower other strings a chance to detune further than would otherwise be the case.

Also shown in FIG. 38*c* is an expanded slot opening 12*c* at the end of each slot 12 allows easy insertion and removal of screw heads used for securing guides or other devices to the rotating member 8.

While the preferred embodiment comprises a harmonic vibrato tailpiece rotating relative to a substantially standard vibrato tailpiece, in order to simply and economically take advantage of the elevation of the strings during a dive, any separately movable tailpiece component, movement of which causes substantially uniform changes to the stretch of the strings, may, when combined with a harmonic vibrato device be used for flex compensation if actuated at the proper rate.

For example the string anchors 10 may be mounted to a flex compensation base which in turn moves relative to harmonic main rotating member 8.

Or, for example, the string bearings 3 may be mounted to a base 69, with base 69 and rotating member 8 both rotating about a common sub base 75.

Any combination of components substantially equivalent to the combination of a standard vibrato tailpiece and a harmonic vibrato tailpiece may be used to create a flex compensated harmonic vibrato device. (A tailpiece may be redirecting, and need not have its own anchors)

The compensated device preferably includes machinery to elevate the bridge during a dive, to reduce string buzz. In the preferred embodiment, the bridge elevation machinery is associated with the flex compensation machinery, as disclosed elsewhere in this document.

Flex compensation as disclosed here and as illustrated in the figures comprises an operatively associated combination of devices for simultaneous harmonic displacement and substantially uniform displacement of multiple engaged strings. Each of the two displacement devices engages a common set of strings directly or indirectly, and displaces the string in the region of engagement so as to change the elongation and tension of the string.

Each of the harmonic and uniform devices preferably displaces strings by rotation of anchors or guides about an axis.

The two devices may be articulated, so that one pivots relative to the other, or they may be separately connected to a base or instrument body.

FIGS. 34H, 34J, and 34K illustrate basic elements of flex compensation in examples where the pieces are not articulated.

The string anchors may be, for example, on a standard vibrato tailpiece, a harmonic vibrato tailpiece, a base, a separate fixed tailpiece, or the instrument body.

(The substantially uniform displacement device may provide separately adjusted or fixed nonuniformity of displacement to compensate separately for slight variations in string modulus, for example by providing guides or anchors adjustably positioned relative to a pivot axis)

The combination involves associating the motion of a characteristic moving harmonic displacement member 401 (for example a rotating tailpiece, control arm shaft, or transposing hub) with the motion of a substantially uniformly displacing member 400 by way of compensation machine 402.

The compensation machine 402 is preferably or adjustably characterized to match the motion of the harmonic and uniform devices in such a manner that for any string displacement by the harmonic member 401, the string displacement by the uniform member 400 will substantially cancel the string displacement due to instrument deflection under varying string tension.

Compensation machine 402 (which may include any characterizable machine or combination of machines, for example a flexibly adjustable cam, an eccentric, a crank, a rocker, a lever having adjustable length and engagement delay, or a screw) is shown in FIG. 34H as a black box engaged by a rotating harmonic tailpiece 401 (via engagement means 404) to make a slight adjustment to the uniformly displacing member 400 (via engagement means 403).

Some or all of the compensation machinery may be inherently incorporated into one or both of the string displacement devices.

In FIG. 34K, for example, the machine may comprise string-bearing idler sheaves 406 mounted eccentrically relative to a shaft or journal, where the degree of eccentricity and at-rest angle of engagement with the strings are preferably separately adjustable. The shaft may be activated for example directly by the control arm 401*a*, and output from the machine may be directed to the harmonic tailpiece 401*b*. The eccentric assembly itself may be considered both part of the uniform tailpiece 400 and the compensation machine 402. In the example of the figure, the eccentricity of shaft 400*s* is adjustable within a slotted hub 400*h*, rotating in journal support 400*j*, preferably fixed relative to base 69 or body 25, as are string anchors 10. Uniform displacing member 400 may share a common bias spring with harmonic tailpiece 401*b*.

In unshown examples, the sheaves 406 may be replaced by cam or cams engaging the strings or separate moveably tailpiece(s). The anchor 10 may alternatively be fixed relative to said cams or said shaft, and the cams may for example be pressed into sheet stock pivoting on a knife edge fulcrum.

For simpler use of cams in compensation machine 402, in a preferred configuration, bias spring means 405 preferably opposing string tension, urge the uniform tailpiece in a direction limited by compensation machine 402. In this configuration, the radius of a cam follower is less likely to interfere with the cam dimensionally. However, machine 402 may exert force in either direction, and no bias spring is required.

Machine 402 and bias spring means 405 are preferably configured to engage base 69 or body 25, as shown. But may alternately engage an intermediate base as previously described or a moving component as a reference structure.

It should be noted that at least one embodiment comprises separate devices for flex compensation in each of the bend and dive directions, either or both of which is adjustable.

It should be noted that at least one embodiment comprises in combination a moveable member, motion of which causes a harmonic change in string pitch of at least two strings, an another moveable member, motion of which causes a substantially non harmonic change in string tension, said members mechanically associated with each other such that motion of one causes motion of the other, where the degree of association is configured or configurable to compensate for flexibility of the instrument to which the device is attached.

String Modulus Compensation

For most guitar applications, the effects of neck modulus will outweigh the effects of variations in tensile modulus of the music wire in the strings, or the combination of neck and string modulus will be compensable by the same means as neck modulus alone, so that string properties may be largely ignored. However, for strings which have extremely non uniform behavior, or for extremely wide pitch variations, further compensation may be desired.

Another embodiment of the claimed flex compensation mechanism includes a rotatable flex compensation base 269 having string bearings 3 or anchors 10 attached at adjustable radii from the rotational axis, allowing slightly non uniform changes to the string deflection to be introduced by rotation of the flex compensation base. This configuration allows adjustment to account for both the neck deflection and any nonlinearity in the stress-strain curve of string wire. Rotation of this flex compensation base may be relative to body 25 base 69, subbase 75, or harmonic rotating member 8. If the flex compensation base 269 is adapted to vary the anchor position, it is preferably mounted relative to the rotating member 8.

As in the preferred embodiment, motion of a characteristic component of the harmonic device translates into motion of the flex compensation base 269.

The alternate configuration may be used alone or in combination with a separate mechanism which raises the action height during detuning as in the preferred embodiment, or it may be simply combined with the preferred embodiment.

Alternatively, in the preferred embodiment, the bearings 3 may be individually positioned along a linear or arcuate path so that the proximity of the bearing 3 to the guide 6 causes significant change in the angle of engagement of the string with both the bearing and the guide during angular changes of the main member 8, and those changes cause string tension to increase or decrease as necessary to compensate for variations in relative modulus.

Similarly, individually adjustable impediment guides 158, preferably adjustably fixed relative to the subbase 75, may be inserted between the string bearing 3 and separate bridge 9. Rotation of base (to which each of bearings 3, rotating member 8, and bridge 9 is preferably mounted) changes deflection of the strings and their angle of engagement with impediments 158 in a manner compensating for variations in string modulus.

Simple means of compensating for both neck flex and string modulus is described in the discussion of FIGS. 6D, 6E, 38A and 38B (and 5E).

Separately Biased Stop.

In a floating vibrato design where the control arm pivots about a single axis, it is desirable to force the device to seek its neutral position precisely when released. This is achieved by stop means, preferably resisting relaxation of the string, and separately pressed against secondary stop means by separate spring means, as previously described in FIG. 17A. With proper selection of balance spring 40 and bias spring 123, failure of a string will have no effect on neutral position of the device. Stops and springs may be located at any convenient location, and provided with adjusting means accessible to the performer.

In FIG. 21A, stop 126 is pressed against secondary stop 56.9 by stop bias spring 56. In the event of a broken string, spring force may be adjusted by spring adjuster 56.1 to maintain a good feel to the device, and prevent bias springs 123 from overpowering stop bias spring 56.

Transport Separate from Device

It should be noted that any part or all of the control arm and transport combination may be mounted apart from the other components of the device and connected by linkage above, below, or through the body of the instrument.

For example, mounting the control arm pivot axes farther toward the tuning head allows good tactile response due to the improved angular purchase, while avoiding clutter on the face of the body.

Hidden Mechanism.

It should further be noted that the disclosed device may be fabricated with any part or all of the actuation mechanism concealed within the instrument (or for example, below a pick guard), including control arm pivot, transport means, and transposing means, and associated springs.

Said device may be implemented as a retrofit unit or built into an instrument. Said instrument body may act as the base or sub-base previously described.

In particular, the control arm shaft or shaft extension may extend below the hub or a cam or rocker may be extended from the control arm hub through the base to engage the spring block below the face.

Ball Cup Pivots

Ball cup string anchors may be slotted to allow string to exit said anchor at a non-stressful angle, with ball rotating within said anchor. Said anchors may be located so as to center the ball or the string axis at the characteristic guide radius.

Bias Force Adjustment while Transposing.

To maintain playing ease, mechanical means may be provided to modify the force of balance springs, bias springs or dive bias springs when transposing to a lower key.

In one simple embodiment, the transposing hub is threaded onto a screw to adjust the compressive force of the dive bias spring or of an opposing dive helper spring.

In another embodiment, rotation of said transposing hub moves the fulcrum point of a biasing leaf spring to change both the force and the spring constant of said bias spring.

Pivot Post Improvements

Pivot posts may be improved as shown in FIGS. 31A through 31H.

Machining, grinding, molding, or forming straight sided grooves into the post as in FIGS. 31A and 31B reduces the stress concentration of the post on a straight knife edge of a pivoting component such as the base 69 shown in previous figures. Adding a flat surface parallel to the centerline of the posts (FIG. 31C) allows two such posts to be misaligned without binding on the knife edge. Further cutting to expose more flat surface on either side of the center of the flat allows greater misalignment of posts while still retaining the knife edge in position along the axis of the post. (FIGS. 31E and F)

Rounding the edges (for example by machining, grinding, or stamping) as shown in FIGS. 31G and 31H, reduces wear on the knife edge component when pivot post is rotated, for example to adjust action height.

Pivot post may be externally threaded as shown, or may be alternatively fit around a preferably threaded fastening component.

Where two pivot posts are used to support straight-edged vibrato base, string alignment with neck is preferably fixed by placement of an alignment pin or screw into the instrument body or a lower base through a slot in base 69 parallel to the strings (for example the adjustment slot for the G-string saddle), the engagement of the pin with the walls of the slot preventing movement of said base along the axis extending between the two pivots.

Alternatively, a preferably nylon retainer bar is fitted loosely between the two posts (or about one post) and secured to base 69 so that the heads of the pivot post(s) engaging the bar retain the base in position relative to the neck, while allowing precise pivoting about the pivot axis. Fastening to base 69 is preferably by machine screws extending upward through intonation slots in base and through perpendicular slots in retainer bar, and capped preferably with crown nuts or allen nuts.

FIGS. 35C and 35D show the side and top views of an embodiment of a pivot fixture configured to mount to the body of a guitar. Pivot posts 280 having preferably internal threads and preferably allen heads rest against preferably milled or stamped concave surfaces 282 on projection or projections 281 (preferably a flange) extending from a base 284, where the projection is of adequate strength and rigidity to resist combined tension of the strings and bias springs (if any) without excessive deflection, and to remove the lateral load from the studs 283 on which the posts are threaded. Base 284 preferably includes slotted holes 285 to allow fit and lateral adjustment on guitars of uncertain trem screw hole spacing. The pivot posts preferably include grooves or flanges of appropriate size and angle for the application. Studs are preferably threaded, pressed, or welded into the base, preferably a steel plate. An alternative embodiment shown in FIG. 35H includes an extension 286, preferably a flange, configured to extend into the body of the instrument, for example within a standard trem routing. The flange is preferably of adequate strength and rigidity to resist the combined tension of the strings and bias springs without excessive deflection.

A concavity in projection 281 may enclose more than half the circumference of the post, thereby retaining the post laterally, while leaving the pivot groove 289 exposed for access on one side to a knife edge of a vibrato plate. In another embodiment, for example as in FIG. 35G, a concavity 282*b* and post 280*b* may be of a matching non-circular preferably cylindrical shape so that a central shaft 283*b* is a simple setscrew 283*b* threaded through the post, and, for example, pressing against the base or swivelinly connected to the base may be used to elevate the fulcrum of a tremolo (or pivot groove). Alternatively a slot preferably normal to the string plane (for example 282*c* in FIG. 35D) may constrain a post 280*c* (configured to fit the slot) against turning while the post is vertically adjusted by suitable means, preferably a setscrew 283*c*.

In alternative embodiments shown in FIGS. 35F, 35G, and 35H, in lieu of a threaded internal shaft, the post 280*a* has external threads engaging internal threads 283*a* within concavity 282*a*, said post preferably having slotted top, allen socket, or other means to facilitate height adjustment.

Concavity 282*a* in projection 281 preferably encloses more than half the circumference of the post, thereby retaining the post laterally, while leaving the pivot groove 289 accessible on one side to a knife edge of a vibrato plate.

Posts are preferably manufactured using typical processes on a screw machine, preferably from a material harder than the knife edge with which they are associated.

Base may be any structural material of suitable strength and rigidity, for example tempered aluminum, extruded to net or near net profile. FIG. 35E shows an example of a base 284 and projecting flange 281, preferably stamped or otherwise formed from preferably work-hardenable sheet stock. The depth of curvature around concavity 282 further enhances the rigidity of projection 281. Projection 281 may extend the full width of base 284, or it may be project from the base over a shorter spam, for example the immediate proximity of the posts.

These example embodiments utilize a base having a cantilevered projection in compressive contact with a height-adjustable fulcrum component.

An adjustable fulcrum component, preferably has a groove to receive a knife edged vibrato device. Whether that fulcrum component is an internally or externally threaded post, or a block sliding relative a track, or to a slot, or to a matching concavity in the projection, the support provided by the projection allows a strong, rigid, low-profile, adjustable pivot device without excessive stress on a wooden instrument body, as is common with a typical twin post vibrato, especially one with excessive bias spring tension.

As shown in FIGS. 35E, 35G, and 35H, a structure adjacent the fulcrum post, for example the projection 281, may extend in a direction parallel to the strings to the proximity of the fulcrum, so that a knife edge slipping out of the fulcrum groove 289, for example when restringing, will be caught by the adjacent structure, and not slide under the post 280.

The groove 289 in post 280 is preferably not centered vertically on the post, so that the post can be inverted to alter the range of adjustment.

These embodiments of pivot fixtures enable a low profile vibrato mounting with high strength while enabling a full range of action height adjustment.

A preferably flat plate base for the pivot fixture may extend as necessary to serve as a base to support, for example a bias spring or flex compensation device for a transposing vibrato device. The plate my be alternatively anchored to the body by a tie rod through the trem routing of an existing instrument. It may extend beyond the routing, having an opening to permit penetration by one or more spring block components. It may be flanged along the sides substantially parallel to the strings to stiffen it in the direction weakened by the opening.

Strings

Strings for guitars and similar instruments typically have "ball" ends. That is, a metal or polymeric ball or barrel shaped end piece is typically lashed to the end of the string using string wire or other wire. On the heavier wound strings, the stiffness of the lashing can be substantial, and its elasticity can interfere with the pitch of the string during detuning, particularly if it bends elastically around tight radius surfaces of a ball cup, for example.

Replacing the lashed ball with a crimped ball is often impractical, due to the unreliability of the joint and the necessity to damage the wire of the string itself in the crimping process, thus weakening the string at the end.

One solution (FIG. 31*k*) is to put (for example) a 90 degree bend 4*a* in the end of a lashed string 4, plastically deforming the lashing and the wire, thus largely eliminating the elastic stresses that cause tuning problems, but leaving adequate strength in the combination of string and lashing A more preferred and economical solution is to terminate each string 4 with a crimped ball (spherical, cylindrical, or other deformable shape, as in FIG. 31J through 31M) adjacent to a (preferably 90 degree) bend in the string. The distance from bend 4*a* to ball 4*b* and the radius of bend 4*a* is preferably matched to the dimensions of a ball anchor comprising a slotted plate.

The bend in the string takes most of the load off of the joint between wire and ball and transfers the string tension to the slotted plate, thus providing a more secure connection and better control of tone, while allowing a more economical ball attachment to a lower specification.

Balls may be of any shape, and the string may pass through a center hole, or be fed laterally from the side, as in the preferred example FIG. 31M, where ball (and string) may be fed from continuous stock and crimped, sheared from the feed stock, formed, and trimmed with a single die operation.

As an alternative to crimping, balls or preferably tapered bullet shapes may be cast onto the wire by injecting molten metal into a preferably water cooled cavity containing the wire or wire end. The preferably differential thermal contraction of the ball and wire secures the ball to the wire end, and allows the wire end to be fully encased.

Roller Saddles

FIGS. 32A, 32B, and 32C are top, side, and sectional views of a ball bearing saddle roller where the alignment of the radial force of the string on the bearing is offset from the radial forces on the ball race sufficiently that the resulting torque about an axis substantially normal to the bearing axis puts the balls and the race in a bind that tightens the fit of the balls and race without significantly increasing friction, thus limiting opportunities for rattle and buzz in the saddle.

Ball race preferably contains three equally spaced balls (preferably spaced by a tight-fitting resilient polymeric retainer within the race), which number further stabilizes the bearing against noise by assuring that all balls are bound against the race by string tension at all times. Hub of bearing is preferably pressed securely against a support surface, preferably by an axial machine screw.

The journaled saddle roller in FIG. 32D benefits similarly from the offset alignment of the string groove and axial journal position. al opposing radial forces on shaft and journal, where radial force vector of the string intersects the shaft outside the region of contact between the journal and shaft.

FIGS. 32C and 32D show exaggerated angular displacement to illustrate the effect of the offset.

In FIGS. 32F through 32H the rollers are assembled into saddles using machine screws to pull the roller tightly against the saddle. FIG. 32H describes the preferred embodiment where the head of the machine screw is under the base 69, and the screw extends upward through a standoff, preferably into a flanged allen nut fitting within the bore of the bearing. (alternatively the bore of the bearing itself is threaded, having for example allen head or hex base to enable wrenching. Screws (preferably comprising square shoulders or locking heads) extend upward through intonation slots in base 69 (or mezzanine) where a nut is preferably countersunk into top face of roller hub to tighten hub firmly against standoff, without requiring wrench access to the screw head, and allowing use of a narrower intonation slot than would be necessary with a t-nut.

Mezzanine Bridge

FIGS. 33A and 33B show front and top views of mezzanine base means for elevating and shaping saddle rollers to conform to the shape of the bridge. A combination of tensile and compressive screws between base 69 and mezzanine 69*m* set the action height and shape. Tightening the tensile screws against preferably adjacent compressive screws (FIG. 33B) locks the position of the mezzanine 69*a* along bridge position slots 69*s* (in either base or mezzanine) to improve, for example, alignment of strings with neck, and allowing for changes in saddle roller diameter.

Mezzanine preferably includes at least one slotted anchor hole 10*a* for isolating one or more strings (eg the high E string) from at least the bend action of the vibrato device.

Acoustic

FIG. 39A shows an end view cross section of an acoustic guitar having internal spring to stabilize the soundboard against creep-related deformation under string tension.

The spring is preferably a torsion bar 310 parallel to the face 311 of the instrument and extending across the width in close proximity to the face 311.

It is preferably attached to the bridge 314 or tailpiece or to the face opposite the bridge or tailpiece, and rotates with or without stabilizing bearings 310*a*. Crank arms 310*b* connect the spring to static adjusting means, preferably in the form of one or more tensile or compressive rods 312, illustrated here as a single hole to receive a tensile rod extending toward the neck, as shown by example in FIG. 39B (where the rod terminates in an adjusting nut, for example).

The low mass of the torsion spring 310 (of any suitable spring material, for example steel, titanium, or bias-wound carbon composite) and the rigidity of the crank eliminates tonal effects from the mass of the crank between the bar and the adjuster. A transverse stiffener 313 (preferably of suitable wood or rigid composite) preferably maintains the height of the bridge 314 relative to the neck and body, while suitable longitudinal or radial stiffeners (or arched top) translate vibratory rotation of the bridge 314 into vibration of the face 311 or sounding board.

FIG. 39B shows an example embodiment of an acoustic guitar fitted with a moveable vibrato tailpiece 8. Bridge 314 in the example rigidly supports upper and lower bridge saddle bearings 9 and 9*a*. The differential height of the bearing surfaces, in contact with vibrating string mass, creates a significant vibration moment, transferred rigidly to the soundboard 311. Lower bearing 9*a* and/or tailpiece 8, may alternatively be located in a recessed area of the face 311 of the instrument, not shown. The bridge is preferably stabilized by spring means as in FIG. 39A.

Individual String Benders

A harmonic vibrato may be enhanced by adding a bend or drop capability to an individual string.

Typically a bender increases the pitch of a string by a fixed interval. For example a b-bender typically stretches the b sting until it hits a stop at an (unfretted) c-sharp. A drop D lever typically reduces the tension on an E string so that its pitch at the stop position changes to D.

The present disclosure improves on the state of the art by adding compensation means to a bend or drop lever so that the lever not only changes the pitch of the string by the desired interval, (when rotated to its stop), but also alters the guide position so that rotation of the main member of the vibrato device will maintain relative pitch of multiple strings after the individual bend or drop. For example when a b-bend lever is rotated to its stop in the proffered embodiment, the pitch of the unfretted b-string will have increased to C#, and the guide will have been moved to or inserted at the correct radius for a string tuned to C#.

An embodiment comprises preferably a single lever associated with mechanical means to both alter the pitch of a given string (or subset of strings) and alter the guide radius (radii) from the main pivot axis 1 such that relative pitch is maintained when the main member 8 is rotated.

Thus the bend or drop (BOD) device for an individual string comprises a BOD lever associated with means to engage the string to alter string tension and means to alter the string guide location, both means activated by rotation of a single lever. Said means preferably include a BOD guide adjuster to set the new guide radius from the main pivot axis 1 of the device, and a BOD pitch adjuster to change the pitch of the string by the desired interval.

The BOD guide preferably serves as the vibrato guide when the BOD device is not activated. Alternatively it may be a separate guide that engages the string only when the B OD lever is rotated toward its stop.

The tension adjuster of the BOD device may be, for example, a BOD string bearing 311 located on the lever 313 generally between the BOD guide 310 and the anchor 10, as in FIGS. 41 and 42. Alternatively the tension adjuster may comprise a separate anchor 10 located on or engaged by the lever 313, for example as is associated with string 4*b* in FIG. 40. Rotation of the BOD lever directly by the musician, or through engagement with an intermediate activating lever, rocker, cam, or screw, is accompanied by movement of the BOD string anchor 10 or BOD string bearing 311 to effect the desired change in string tension. Alternatively single bearing (as is associated with string 4*g* in FIG. 40) may serve as a tension adjuster and string guide.

Depending on the initial radius of the guide from main axis 1, and the tension of string, the tension adjuster will be configured to increase or decrease the string tension relative to the increase or decrease in tension created by the BOD guide position adjuster. That is, a bending guide at a large radius from the main pivot axis will likely need negative pitch compensation when engaged, because the large change in guide radius from the main axis.

Where a string bearing is used as the compensator, it may engage the string throughout the rotation angle of the BOD lever, or it may engage the string only when the device is engaged or alternatively disengaged by the user.

Shown by way of example in FIGS. 40 through 42, are BOD guide 310, and BOD compensator 311, compensator adjuster 311*a*, and bend limit stop 312, main axis 1, string 4, lever 313, and lever axis 313*a*.

In the embodiment of FIG. 40, where first and second benders (represented by levers 313 pivotable about axes 313*a*) are used on a single instrument, one of said levers or a separate lever 301 may be fitted with a vertical (substantially normal to the string plane) rotatable cylinder 302 associated with a selecting cam 303, which when lever 301 is rotated about lever axis 301*a*, may be positioned to engage a chosen bender. By brushing the forearm against cylinder 302 the musician may rotate cam 303 to select one or both benders for actuation. The at rest positions of lever 301 and cylinder 302 are preferably maintained by spring means (not shown).

Alternatively the bender for an individual string may engage a control arm rotating on dual axes as previously described. Cam, rocker, or other engagement means may be used to displace the string bender during rotation about one axis. Rotation of the arm about the other axis may be used to displace, for example, the main rotating member of a harmonic vibrato, or a bender for another individual string. The bender in such a configuration may be biased as described, if desired, to allow both bends and dives on individual strings.

In at least one embodiment a BOD lever 313 may be rotated to its limit by connection to a separate bender actuator, for example by linkage to a crank associated with a guitar strap. In a preferred embodiment, the external actuator is configurable to be displaceable to a separately adjustable limit. Preferably tensile spring means between the external actuator and the BOD device enable the main vibrato member to rotate within a useful range while not causing motion of the shoulder strap crank. In one embodiment, when pulled to its limit, a shoulder strap crank (or an intermediate crank) is configured to rotate to an angle reducing or eliminating the mechanical advantage of string tension on the crank, so that the strap is effectively isolated from string tension at the end of the bend. Separate return spring means urge the crank from its isolated angle when the bend is released. By similar methods, other actuator means may be used to engage a string bender.

It should be understood that under certain circumstances, the guide function and pitch compensation function may be performed by engagement of a single guide with a string, particularly if the BOD guide is configured to interact with an existing guide of tailpiece, for example by increasing string wrap around the existing guide, or by disengaging the string from said guide.

Cantilevered Guide

In FIGS. 27A through 27J, for one or more strings an adjuster (preferably a screw 15 in a lower block 8*b* of main rotating member 8) is used to push guide 6 on the end of guide extender 6*x* away from main pivot axis 1. Guide extender is preferably a column extending through a preferably slotted base plate plate 8*t* (in FIGS. 27A, 27B, 27D, and 27E), where the slots 12 are preferably sized to prevent passage of lower end of extender 6*x* when unstrung.

Figure 27A:
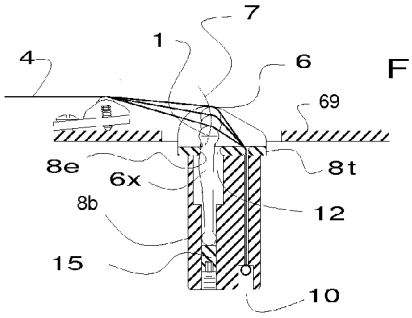

Shape of front edge (toward bridge) of extender 6*x* and location of front edge 8*e* of slot 12 are preferably matched to position guide 6 along a suitable arcuate path 7. Extender may be straight, as shown in FIG. 27C or curved as in FIG. 27A. FIG. 27C also shows an alternative embodiment where guide extender 6*x* comprises bulbous adjuster screw 15 engaging preferably flat or convex threads in at least one side wall of the socket, allowing column to tilt as it extends, with the upper end resting against the top lip of a socket. Side wall threads are preferably provided by a threaded rod inserted into an adjoining socket.

In a preferred configuration, side walls of a slot for an individual guide column 6*x* are provided by parallel packing of adjacent guide columns into position.

Figure 27E:
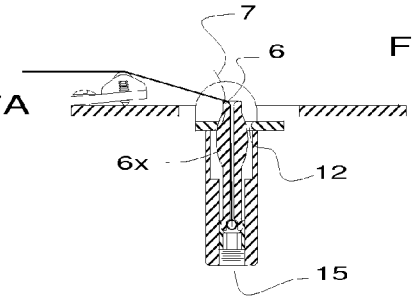
Figure 27B:
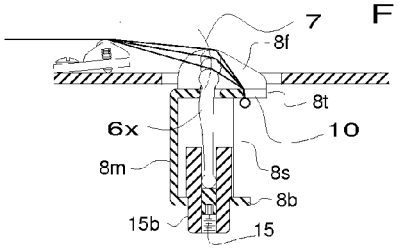
Figure 27F:
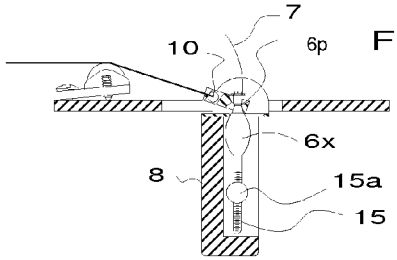
Figure 27C:
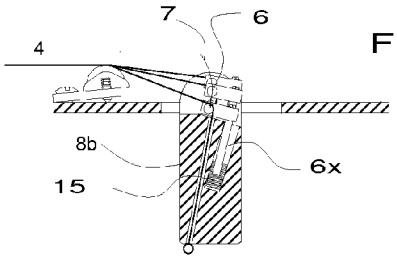
Figure 27G:
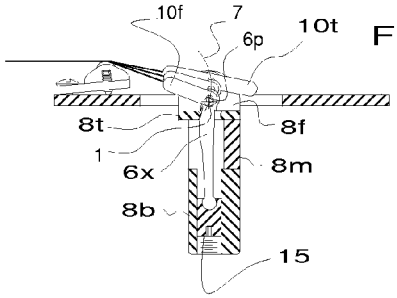
Figure 27D:
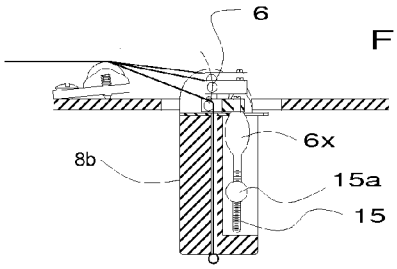

In the examples of FIGS. 27C and 27D, guides 6 are preferably pivotingly cantilevered from a cantilevered column 6*x* to resist string tension. The column in the 2 examples preferably comprises a threaded shaft with straight cylindrical or contoured surface.

In FIG. 27D, a transverse rotatable cylinder 15*a* rotates about a fixed axis in block 8*b*, being threaded to adjuster screw 15 on the end of guide extender 6*x*.

In FIG. 27E column 6*x* may be turned to shape (for example on a screw machine) with internal string path and anchor 10, with swiveling ball and socket connection on adjuster screw 15 to resist axial motion of the column, and preferably with machined flats on the sides to resist rotation in slots 12.

FIG. 27F shows a string anchor (for example a ball cup) suspended in tension, and pivotable about 2 axes relative to a cantilevered guide support column, for example suitable for connection to a cantilevered column modified from those shown in FIG. 27C, 27D, or 27E. Connection in the example is by a countersunk knife edge riding in a turned groove.

FIG. 27G shows a string anchor (for example a ball cup) suspended in tension, and pivotable about 1 axis, preferably centered on arcuate guide path 7, for example suitable for application to a cantilevered column modified from one shown in FIG. 27A, 27B, or 27E. In a preferred configuration, pivoting anchor 10 has includes a tail 10*t* enabling balancing of the anchor by finger pressure during loading. A ball cup or string slot may be in either end of the extended anchor.

In FIGS. 27F and 27G the guide position adjuster 15 preferably includes retaining means (for example a ball socket in a setscrew in FIG. 27G) to prevent motion of the column in either axial direction from the adjusted position.

Similarly (for example in FIG. 27H) an anchor (for example a combined fine tuner 10*d* and string clamp 10*c*, adjustable by setscrews 10*a* and 10*b*) may be attached to one or more guide columns. The fine tuner preferably pivots about the focus of a preferably cylindrical guide 6. String engaging surface of guide 6 may be fixed relative to the cantilevered column, or it may comprise a revolving sheave. Column adjuster 15 includes means to prevent axial motion of the column, for example a ball retainer as shown, or for example dual opposed setscrews, not shown.

In FIGS. 27A, 27B, and 27G, keying means between guide column 6*x* and rotating member 8, for example parallel slots in top plate 8*t* shaped to fit columns 6*x* having rectangular cross section, preferably substantially resist rotation of column 6*x* about its longitudinal axis.

In Fix 27A through 27H, cam follower means, for example, top plate edge 8*e* positions the cam face of cantilevered guide support column 6*x*. Alternative follower embodiments comprise roller or shaft means Preferably a flange 8*f* extends from the block 8*b* or the top plate 8*t* to support pivot means for the tailpiece 8 to rotate about main axis 1. A flange 8*f*, for example, comprises a journal hole, a cantilevered shafts, or a knife edge fulcrum component positioned to enable pivoting of main member 8 about main axis 1 (pivot means not visible)

Figure 27H:
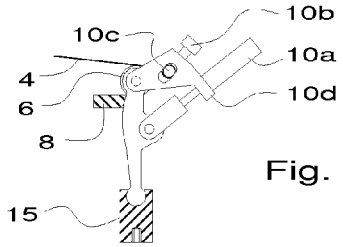
Figure 27J:
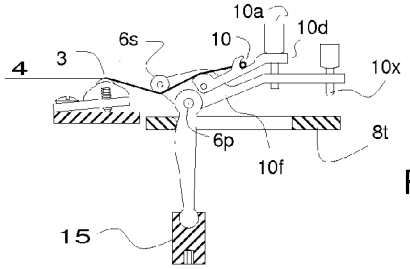

In the embodiments of FIGS. 27F, 27G, and 27J, string guide 6 is a pivot for a string anchor, so that the tension of the string acts to align the string with the guide pivot axis 6*p*.

The guide axis itself is preferably adjustable along an arcuate path 7 substantially as previously described in the present text or the parents, where the string axis intersects the guide axis at a defined angle relative to a ray from main axis 1, about which first member 8 rotates.

FIG. 27J illustrates an example of an anchor fixture 10*f* pivoting freely on guide 6 about guide pivot axis 6*p*. The fixture is preferably associated with a guide surface 6*s* (preferably a smooth convex shape or a roller) configured to engage the string 4 between the string bearing 3 (a bridge saddle in the example) and the string anchor 10, preferably with string 4 wrapping slightly about guide surface 6*s*. The string tension urges surface 6*s* angularly about axis 6*p* in opposition to the urging of string anchor about axis 6*p*, thus urging alignment of string 4 with guide pivot axis 6*p*.

In and example shown in FIG. 27J, anchor fixture 10*f* is associated with a fine tuner. A fine tuner associated with an anchor fixture may take any suitable form. In the example, the fine tuner is a lever 10*d* pivotable relative to fixture 10*f* and comprising an adjuster 10*a*. In the example, the fine tuner lever 10*d* supports a string anchor 10, illustrated, for example, as a ball cup.

In an alternative embodiment anchor 10 further comprises a string clamp, for example as illustrated in FIG. 27H. In an alternative embodiment, a fine tuner engages a string between guide surface 6*s* and anchor 10. In another embodiment, the fine tuner adjusts the position of guide surface relative to the anchor fixed relative to an anchor fixture. In another embodiment, an anchor fixture comprises a guide surface and an anchor with no fine tuning adjuster.

In the configurations of FIG. 27F, 27G, or 27J pushing either direction on an individual anchor 10 or anchor fixture 10*f* (directly or with a lever extended for that purpose, for example a palm lever) enables bending an individual string to a higher pitch. In one embodiment, a bend limiter, for example limit screw 10*x*, in FIG. 27J, allows bending a string a desired interval by rotating fixture 10*f* in one direction, while allowing greater rotation in the opposite direction. Configured as shown, rotating fixture 10*f* beyond its limit causes rotation of the entire main member 8. Additional improvements not shown in the figure are a separate lever to improve the mechanical advantage or rotating the fixture towards its limit, to reduce the urge toward premature chord bend during an individual string bend, and compensation to effective guide radius from main axis 1, during a string bend.

In the discussion of all FIG. 27, it is understood that main rotating member 8 describes the combination of all of members 8*b*, 8*e*, 8*t*, 8*m*, and 8*f* that exist in that figure.

In at least one embodiment of devices illustrated (for example FIG. 27G) moveable member 8 is fabricated from a stack of sections (for example a top plate 8*t*, a bottom block 8*b*, and a middle block 8*m*) fastened together preferably by tie rods or screws (not shown). Any of the 3 sections may be fabricated by any one or combination of, for example, extrusion, cutting, drilling, boring, milling, broaching, and tapping. In a simple embodiment a lower section 8*b* is extruded having only round holes, some of which are tapped to receive an adjusting screws 15. Others (for example string anchor holes or FIG. 27A) are preferably counterbored with a tapered shoulder to reduce stress on ball end lashing. Other extruded holes enable tierods or. An embodiment of the middle section is preferably a slotted extrusion, or an extrusion of slots and string holes, or it may comprise multiple simple standoff means between upper and lower sections. In one embodiment the upper section is a slotted plate, but in another it is a continuation of the slotted extrusion, machined to include pivot means (for example bearing shaft bores) centered at main axis 1, for pivotably engaging base 69.

FIG. 27B illustrates an alternative embodiment where flanges 8*f*, bottom plate 8*b*, middle plate 8*m*, and top plate 8*t* are cut and formed preferably from a single sheet of metal, preferably by simple stamping operation. The configuration preferable comprises at least one stiffener 8*s* (preferably a standoff between top plate 8*t* and bottom plate 8*p*), and adjuster bosses 15*b*, fastened to the formed plate, for example, by pressing, welding, peening, or screwing. Bosses 15*b* are preferably fabricated by screw machine. In alternative embodiments boss 15*b* is formed and threaded into base plate 8*b*, or adjusting screws 15 threaded directly through a flat bottom plate 8*b*.

The discussion of FIGS. 27A through 27J has centered on features related to rotating member 8 and string guides 6. Other optional or necessary components to a device are not shown in the figures.

Bend Limiter

In the embodiments of FIGS. 28A and 28C a separately biased guide crank 220 is provided for at least one sting. It preferably rotates on a common axis 1 with main rotating member 8, and rests against a stop 222 relative to main member 8. As main member 8 rotates in a bend direction, guide crank 220 rotates with it under the force of separate bias spring 122, until preferably adjustable (by an adjusting screw, for example) stop 221 engages base 8. In the example, crank 220 comprises string anchor means 10, for example a slot positioned to enable string 4 to wrap over the surface of guide 6. In a preferred embodiment, a quickly changeable adjuster, for example a sloped or stepped axial cam 221*a* in FIG. 28A between stop 221 and base 69 (pivotable about an axis 221*x*), enables a user to quickly select from among 2 or more bend limits during a performance. The range of adjuster 221*a* preferably is sufficient to enable adjusting the limit to totally prevent bend (sharpening) motion of crank 220 relative to base 69. Adjuster 221*a* preferably comprises knob or lever means as shown to enable quick adjustment.

The separate crank 220 preferably includes string anchor means separate from the main member, for example a slot for receiving the ball end of a string, as shown, preferably far enough from the guide 6 to isolate the guide from the stiffness of ball end lashing. Main member may optionally be partially biased by separate balancing spring 40.

The radius of guide 6 from axis 1 may be adjustable, for example by set screws on a flexible guide bracket 220, as illustrated in FIG. 28C, or it may be fixed, for example as illustrated in FIG. 28A. A single fixed guide permits all other guides to be adjusted relative to the fixed guide to accomplish tuning of the device. Actuation effort may be adjusted by modifying the purchase of the actuator mechanism between the control arm and main member (not shown).

In FIG. 28B one or more guide means may be equipped with locking slide means, for example a string anchor 225 adapted to slide through or around a modified guide 224 and biased by string tension against a stop 223. Locking means, for example a thumbwheel 226 (or cam, lever, or latch), associates modified guide 224 with sliding anchor when desired. In one embodiment thumbwheel 226 is threaded onto a threaded shaft 226*a* through cylinder rotating within a guide cavity, with anchor means 225 extending through the cylinder and the threaded shaft. Tightening said thumbwheel pulls anchor against interior of cylinder. When disengaged rotation of main member 8 has no discernible effect on pitch of the disengaged string.

FIGS. 30A through 30H are side views of further embodiments to illustrate the dual action cam transport rocker as described in FIG. 9C, having rotational axes substantially parallel to the string plane. Similar component numbers apply.

Figure 30A:
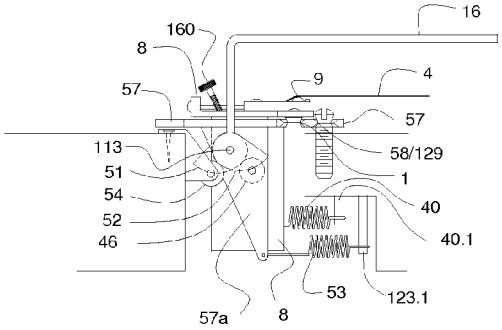
Figure 30B:
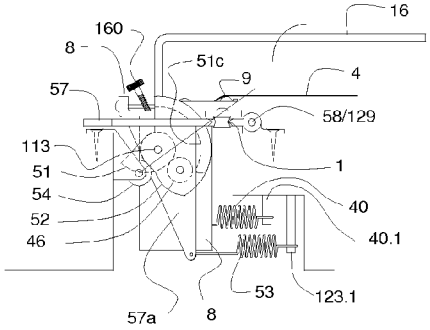

FIG. 30B shows an embodiment where a third cam surface, retainer cam surface 51*c*, acts as a retainer to prevent optional balancing spring from interfering with the dive.

Said retainer cam 51*c* may act on main cam follower 46 as shown or on a separate cam follower mounted on the main rotating member.

Dive cam and cam follower are preferably configured to increase their moment arm as the dive progresses.

Figure 30C:
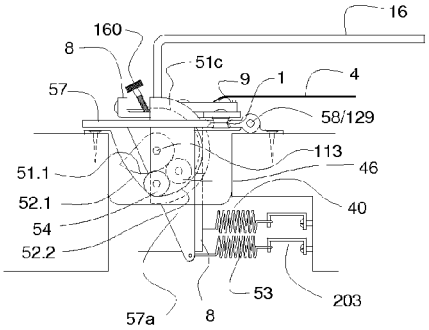
Figure 30D:
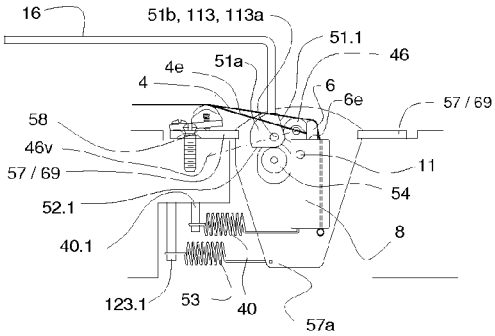
Figure 30E:
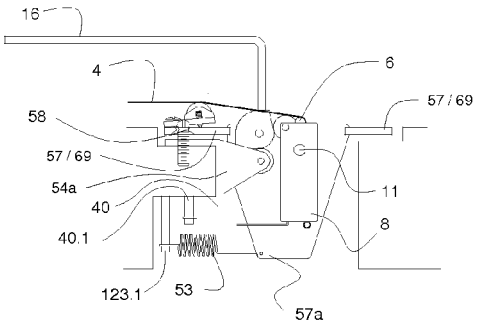
Figure 30F:
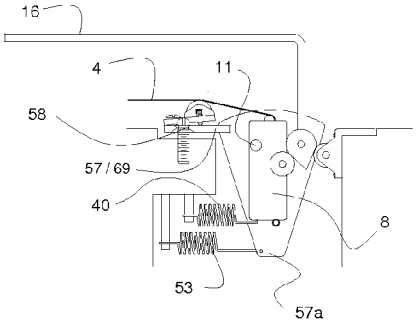
Figure 30G:
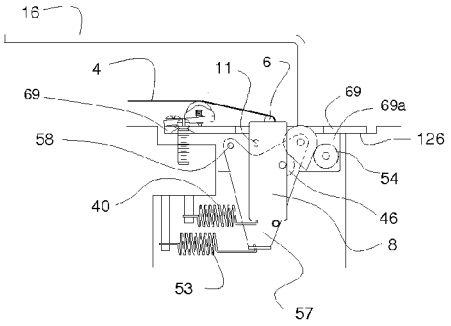
Figure 30H:
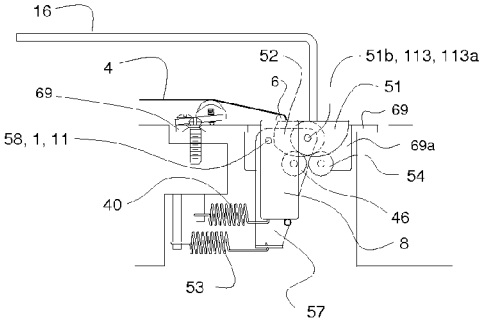

FIG. 30D illustrate the resultant force vectors and moment arms for example of one such a cam configuration. In this embodiment main member 8 pivots on pivot shaft/journal combination 11 relative to dive transport 57*a*. When arm 16 is lifted to perform a bend, cam surface 51.1 presses follower 46 on the main member in a direction to cause increase in string tension. When arm 16 is rotated downward, the entire assembly rotates on dive transport pivot axis 58, illustrated for example as a knife edge fulcrum.

Figure 4A:
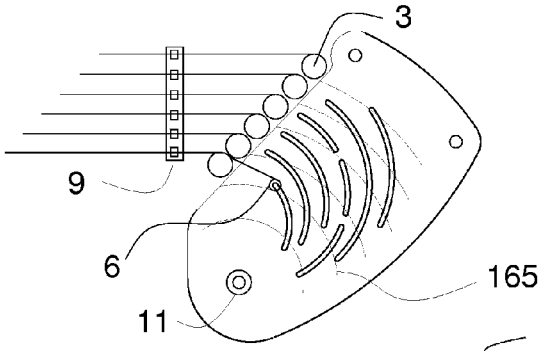
FIGS. 4A and 4B are top views of a vibrato mechanism with rotational axis perpendicular to plane of strings.
Figure 4B:
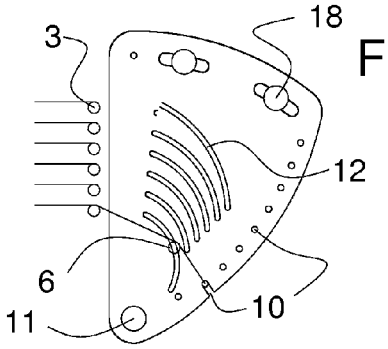
Figure 4C:
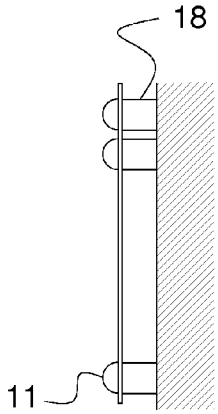
FIG. 4C is a side view of a flat plate vibrato mechanism with rotational axis perpendicular to plane of strings.

FIG. 30C shows an example of an embodiment where the dive cam follower 54 rotates about the arm axis 113, preferably attached to one face of a bend cam plate. Preferably concave dive cam 52 (having a dive surface 521 and a neutral or bend surface 52.2) in the example is preferably substantially fixed or articulated relative to dive transport axis 58. (Fixed in FIG. 0F4)

FIGS. 30E through 30H operate substantially as described in the discussion of FIG. 9C, where the main axis 1 and the bias transport axis 58 is substantially parallel to the bridge.

In FIG. 24D control arm shaft 113*a* extends through journal means associated with transport (rocker) 57 extending below the instrument upper surface. Bias spring 122 holds transport against stop 125 associated with base 69 by way of lower base extension 69*a*. Thus base 69 is biased against stop 126. Base 69 may alternatively, for example, be fixed to the deck of the instrument body or separately biased.

Rotation of arm in a bend direction causes shaft key 172*a* to engage latch bolt 170 (preferably through intermediate spring 172*b*, or alternative cam), rotating it on axis 170*a* into the path dive-preventing latch receiver 171, preferably adjustable relative to the body or base.

With the latch engaged, extreme bends may be performed without need for high bias spring tension to avoid inadvertent dives.

Latch bolt 170 returns preferably under force of separate return spring 170*c* (or alternatively insertion spring 172*a* or separate cam) preferably includes springs 170*b* and 170*c*

A simpler latch would involve a combination of cam and cam follower, one rotating with a moveable component of the device, and the other fixed to a relatively fixed component. Proximity of the cam follower to a void in the cam surface would allow dives, for example. The benefit of the presently described latching methods is that the radius of a cam follower does not interfere with the responsiveness of the device.

FIGS. 34F and 34G illustrate an embodiment of the simple cam latch, where a bolt cam 172 preferably engages first a preferably sharp-edged skid cam follower 173*a* on engagement surface 172*a* and then a roller cam follower 173*b* on roller surface 172*b*. The skid support preferably doubles as a mounting bracket for the roller, as both are anchored to the body 25 or other base structure. The tight dimensions of the skid allow a responsive device with bias springs 122 adjusted for minimum force. As the shaft 113*a* rotates further, cam surface 172*c* recedes under the skid to reduce friction as pressure increases. First the skid and then the roller apply force to a substantially constant radius cam surface to prevent the rotation of transport 57 about dive axis 58 in a dive direction during rotation of shaft 113*a* in a bend direction. The device of FIGS. 34F and 34G, may also be operated with only a skid or only a roller. The device as shown has less rotational friction than the device without a roller, and requires less bias spring tension while engaging the roller on bends, and therefore more manual effort on dives than the same device without the skid.

The shape of bolt cam 172 is (or the shaft 113*a* in contact with stop 125, for example) may deviate from constant radius, if necessary, for example to compensate for instrument deflection. The structure or mounting of the latching mechanism is preferably rigid enough to resist string tension during a bend without preventing flex compensating motion, for example, of base 69. The mounting for a latch receiver or for a latch cam follower may alternatively comprise resilient means to nonrigidly increase the biasing force against transport 57, for example spring 171*y* in FIG. 34*m*. 34N, 34P, and 34Q. Latch means may be employed to prevent unwanted relative motion between any two components, for example motion of transport 57 relative to base 69 or extension 119 as in FIG. 34F or relative to body 25 as in FIG. 34G.

FIG. 34F shows an example of skew roller actuation where the master roller 211 on an axis associated with and substantially parallel to shaft 113*a* is contoured to present a substantially common angle of contact with slave roller 212 as transport 25 rotates (counterclockwise) in a dive about pivot 58. Separate bias spring means 123 biases base 69 against stop 126, where stop is preferably adjustable by flex compensation means not shown.

In an embodiment illustrated in FIG. 34M, the dive latch cam follower 171 comprises a slender shaft cantilevered from or suspended between bearing means, for example ball bearings 171*z* in housing 171*x*. The small radius enables adjusting bias springs 122 to lower tension for easier dives.

In an embodiment illustrated in FIG. 34N, radial dive latch bolt cam 170 engages a dive latch follower skid 171 to prevent rotation of transport 57 during a bend. Rotation of arm 16 in a bend direction causes displacement of actuator spring means 170*b*, which in turn urges dive latch bolt cam 170 (preferably rotating freely on control arm shaft 113*a*) to rotate into blocking engagement follower/skid 171. Further rotation of arm 16 deflects spring with or without further rotation of cam. Preferably the same spring retracts the cam bolt from engagement with skid 171 when arm 16 returns to neutral position.

In embodiments illustrated in FIG. 34L a bolt 170 is urged into engagement with a latch receiver 171 by a latching spring 170*b*.

In the figure, an actuator 173 (preferably a roller, preferably adjustably positionable) fixed with respect to a moving component (for example main member 8) engages latching spring 170*b* more forcefully as member 8 moves in a bend direction about pivot axis 1. The spring in turn forces latch bolt 170 into engagement with latch receiver 171 (preferably a screw head axially adjustable relative to body 25 or other base). The latch bolt 170 and spring 170*b* preferably rotate about bolt pivot 170*a*, relative to base 69.

Movement of main member 8 in a bend direction causes engagement of the bolt and receiver to prevent rotation of base 69 (or alternatively a dive transport) about dive pivot 129.

In FIG. 34L, static spring stop 170*d*, preferably fixed relative to base 69, urges latching spring 170*b* in a latching direction. Actuator 173, preferably adjustably fixed relative to, for example, moveable main member 8), engages bolt 170 (rotatable about a bolt pivot 170*a*) either directly or through unlatch spring 170*c* (for example if bolt 170 is cut along phantom line) to disengage bolt 170 from receiver 171. Springs 170*b* and 170*c*, are preferably of sufficient rate and stroke to maintain adequate spring force on both actuator 173 and spring stop 170*d* to prevent buzz from string vibration.

In the two examples, the opposing axial forces of bolt pivot 170*a* and base 69 on bolt 170 act as a lever having an axis normal to the axis of pivot 170*a*, to hold base 69 firmly in place relative to latch receiver 171.

FIG. 34R shows an example of an embodiment having latches to prevent unwanted motion or resistance to motion of the transport 57 in a dive direction and the main member 8 in a bend direction.

In the example, a rocker or cam 50 on control arm shaft 113*a* engages follower 46 associated with main member 8 to generate a bend when arm is rotated about axis 113 in a bend direction. Shaft 113*a* is preferably journaled in transport 57, rotating on an axis 58, preferably relative to base 69. (axis 58 coincides with main axis 1 in the example, so the transport and main member may share a common shaft 11). Transport bias springs 122 bias the transport against bias stop 125. Tension of strings 4, optionally opposed by balancing springs 40, bias shaft brake 125*a* (associated with main member 8) against shaft 113*a*, retaining control arm 16 in playing position when arm is not rotated in a bend direction. Base bias springs 405 and flex compensation device 402 are preferably included, as described elsewhere.

In the example, bend latch bolt 170, rotatable relative to transport 57, for example on latch pivot 170*a*, is configured to engage latch receiver 171 (preferably an adjustable plate or disk associated with base 69) when urged in that direction by the force of lifter 173 (preferably fixed relative to main member 8) on latching spring 170*b* during a bend. Latch bolt return spring 170*c* associated with spring stop 170*g* opposes spring 170*b* to disengage the bolt from the receiver when the position of lifter 173 allows.

An optional dive latch is shown, useful during a dive to oppose excessive tension in an optional balance spring 40, but locking main member 8 to transport 57, for example. In the example, dive latch bolt 170*e*, rotatable relative to transport 57, for example on dive latch pivot 170*g*, is configured to engage latch receiver 171*e* (preferably an adjustable plate or disk associated with main member 8) under the urging of dive latch spring stop 170*f* on dive latch spring 170*h*, (170*f* is preferably fixed relative to transport 57). When in neutral position, actuator 173*e* engages (for example) cam surface 172*e* on bolt 170*e* to disengage the bolt from receiver 171*e*.

In the example, bolt 170*e* includes means to retain itself in position when not engaged by lifter 173*e*. In FIG. 34R, spring 170*h* wraps around stop 170*f* to act as a retainer. Other alternatives include two stop posts on either side of a single leaf spring or two leaf springs on either side of a single post.

The radial bolt force (compressive or tensile) of either of the two latches of the present example is preferable to the axial forces of FIGS. 34E and 34L, in that a radial latch requires less precision of fit.

Either a bend latch or a dive latch may be engaged by an actuator configured either to engage or disengage the latch bolt from a receiver. The actuation may be by spring means, or by cam means, or both, or other means. The need for a dive latch may be reduced by means to vary the purchase of the connection to balance springs 40 during a dive.

Latch receiver plate 171 in FIGS. 34R and 34S for example may be an eccentric adapted to be rotated into position and locked preferably by screw means. It preferably includes means for adjusting, for example a screwdriver slot accessible from below, or notches accessible through a hole in base plate 69 above.

An alternative receiver example in FIG. 34T is a simple plate adjustable toward or away from the bolt by a drift tool (for example a scratch awl or an allen wrench) inserted through matching holes in the base plate 69 and receiver plate 171, and wobbled to achieve desired positioning prior to being secured, preferably by screw means through a slotted hole.

It should be understood from the examples that any moving component may be latched directly or indirectly to prevent unwanted motion relative to another component. For example in FIG. 34R, the transport 57 is latched to the base 69 during bends, and the main member 8 is latched to the transport 57 during dives. Latches are preferably disengaged near neutral position.

In FIG. 24D, Pivot shafts 58 and 212*a* are preferably retained in slots in a plate by washers compressed by machine screw means to each side of the plate. Washers (such as those retaining slave roller shaft 212*a*) may be slotted to accommodate extra diameter if necessary, or the washers may be eliminated in lieu of the head and nut of a machine screw or rivet.

Figure 24G:
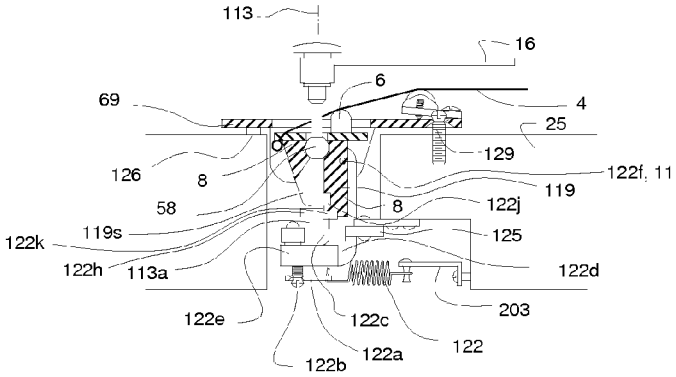

In FIGS. 24F and 24G control arm shaft 113*a* engages a preferably spherical ball or bushing or a cylindrical bushing constrained within a slotted housing, for example a lower block 119 having a receptacle to constrain shaft 113*a* and ball or bushing while allowing rotation about shaft axis 113 and about dive axis 58.

Shaft optionally includes cam or rocker means 122*c* engaging a cam follower extending from lower block 112*e* on arms 122*d* pivoting from base 69 or block 119 at pivot means 122*f* (In FIG. 22G, pivot 122*f* may be coaxial with main member pivot 11). Bias springs 122 acting through lower block 122*e* oppose string tension to bias shaft 113*a* against stop bearing 125 in FIG. 24F or stop 122*j* in FIG. 24G.

Cam follower or roller may alternatively be mounted to rocker 122*c* to engage a flat or shaped surface on lower block 112*e*. (not shown)

In FIG. 24G stop 125 preferably comprises a bearing surface engaging preferably cylindrical surface associated with and concentric with shaft 113*a* (for example a cylindrical back surface of the cam or rockier 122*c*. Springs 122 bias shaft 113*a* toward stop 125.

Rotation of shaft 113*a* in a bend direction increases force on bias springs 122 while rotating main member 8 in a bend direction by means of cam or rocker means 122*h*, acting on stop bearing 122*j*, or preferably on separate cam or follower surface 122*k* associated main member 8, where said cam preferably allows the device response to be characterized according to the taste of the user, and allowing stop 122*j* to function as a shaft brake.

In FIG. 24G base 69 may be fixed to body 25 or pivoting as shown. If pivoting, it is preferably urged toward body 25 by separate spring means not shown.

Alternative Transposing Latch for Control Arm with Dual Axis Control.

FIGS. 34A through 34D show an embodiments of latching mechanisms enabling the key of the instrument to be changed by, for example, by rotating the control arm out of playing position, and then depressing the control arm while moving it into playing position. In this embodiment, the dive axis is substantially parallel to the bridge, and the bend axis at rest is substantially normal to the string plane.

When the control arm 16 is rotated into playing position about its bend axis (the axis normal to the string plane) a latch bolt 16B engages a receiver surface 16*g*, selected from by the degree of rotation about the dive axis 58. So long as the arm remains in playing position, stop 16*d* engaging spring means 16*f*, preferably integral with the latch bolt 16*b*, gently urges the bolt (preferably rotating on pivot means 16*e*, preferably having an axis parallel to bend axis 113) toward engagement with receiver. When arm is rotated about its bend axis out of playing position, stop 16*c* on control arm hub engages bolt 16*b* and rotates it away from contact with receiver 16*g*.

Pivot means 16*e* preferably provides axial support, for example machine screw head and nut, so that during a dive, the bolt 16*b* is rigidly cantilevered from the arm hub so that at rest the force of the receiver 16*g* on the bolt holds the arm at the desired angular position about its dive axis 58.

FIGS. 34B through 34D show various embodiments of latch receivers 16*g* combined in a preferably rigid assembly 16*k*, preferably pivoting on an axis 58*x* (preferably coaxial with dive axis 58 about which dive transport rocker 57 rotates).

When arm 16 is pressed toward the instrument body to dive further from selected at-rest key, the receiver 16*g* rotates about its axis 58*x*. This rotation may be accomplished by separate bolt, but is preferably enabled by bolt 16*b* engaging the back side of the next receiver in line. Bolts and receivers are preferably machined with suitable taper to prevent generation of a disengaging force by engagement of bolt with front or back side of receiver. A return spring 16*m* exerts preferably light torque on assembly 16*k* to return it to its at rest position when the arm is released.

In FIG. 34B latch receivers 16*g* comprise flanges extending from internally and externally threaded bodies 16*h*. The threads allow the receivers to be stackable and adjusted to achieve proper spacing. Preferably a tiebolt 16*j* compresses the adjusted receiver stack against the base 16*k* to hold them rigidly in place.

In FIG. 34C a series of stacked plates rotating on a common axis include receiver means 16*g*, preferably in the form of a flange extending from the top edge. Adjusting means, preferably in the form of screws 16*h* threaded through a flange, enable adjustment of the distance between receivers. A tie bolt 16*j* in a common slot locks the adjusted plates together into a rigid assembly.

In FIG. 34D an alternative embodiment of a latch bolt receiver assembly comprises multiple pins 16*g* projecting from a substantially vertical plate 16*k*. The pins preferably extend eccentrically from screws, preferably threaded into an array of holes in the plate 16*k*, and locked preferably with jam nuts. Alternatively pins may extend coaxially or eccentrically from screws inserted through slots in receiver base 16*k* into nuts.

The arm preferably includes pivot means to elevate the tip of the arm while the device is detuned, to allow the same positioning and expressive effect as when the device was not detuned. In the embodiment shown schematically in FIG. 34E, the receivers 16*g*, preferably simple set screws of varying height, preferably ordered in angular increments about axis 113, create successive steps onto which the bolt 16*b* may be positioned substantially as in the prior embodiments. As the arm 16 is rotated further toward playing position a (for example) cam 16*n* and cam-follower 16*p* engage to lift the arm relative to transposing base 16*k*. The arm pivots vertically relative to the hub on an arm pivot 16*x*, preferably near the dive pivot axis, but shown at a location allowing simplicity of illustration. The cam and follower also preferably serve as the means of torque coupling between the arm and the dive transport (preferably by way of the receiver 16*g*, bolt 16*b*, hub 16*q* and a shaft and journal centered on axis 113). Light torque supplied by spring 16*m* urges transposing base 16*k* against base 69 or preferably discrete intervening stop 16*s*, of preferably resilient material. Other numbered components illustrated in FIG. 34E preferably perform substantially as previously described.

Said elevating pivot means may alternatively be a flexible material, for example a metallic leaf spring, rigidly associated with both the hub 16*q* and arm 16*m*. Said spring preferably allows cam and follower to elevate said arm, but preferably applies a moment urging said arm toward a lower stopped position relative to said hub.

Receivers 16*g* and cam 16*n* and follower 16*p* may be located at any angular position about arm axis 113, or at any angle about dive axis 58. Cam or follower may be on associated with arm, and follower may comprise a roller or simple skid of preferably low-friction material.

In a less preferred alternative embodiment, not illustrated, the means enabling lack of relative rotation during a dive between the latch bolt 16*b* and receiver 16*g* includes pivot means by which latch bolt 16*b* is rotatable about an axis approximating the transport rocker dive axis 58, where the receiver assembly 16*k* remains stationary.

It should be noted that, where spring 16*m* is schematically shown as a compressive coil spring, it may preferably be a simple leaf spring lightly engaging the base 69 so as keep transposing base 16*k* in place without excessively increasing the effort required on the arm during a dive.

Additional Notes on Bend Limit

A preferably adjustable (to the point of disengagement) bend limit or dive limit may be provided by any suitable mechanical means (for example those relating to provide a hard stop for a musician seeking to raise the pitch of the strings by a fixed musical interval.

An adjustable bend limit in one embodiment is provided by a preferably stepped cam rotatable relative to the main member 8 or the base 69, where rotation of main member in a bend direction is limited by engagement of a user selected surface on the cam with a stop surface associated with the base or main member.

The individual steps may be adjustable, for example by set screw, or the stop may be adjustable, or the cam steps and stop may be fixed, relying on proper positioning of the guides on the main member to achieve a stop at the proper pitch. A typical stop would be at ½ step and 1 step.

Method

The settings of the string guides of the disclosed device typically do not need readjusting after replacing strings, adjusting the truss rod, or even changing instruments, so long as strings of similar mass ratio are consistently used. In many cases, the only adjustment necessary is to one or two flex compensation set screws. As a result, the present device is suitable for application to a family of strings having a substantially uniform mass ration (the ratio of total mass to core wire mass) (assuming uniform tensile modulus among all strings) Although adjusting the presently disclosed device is believed to be simpler than adjusting devices of the prior art, the motivation to totally avoid adjusting at all may provide a motivation to use strings from a common family. A method comprising some or all of the following steps is therefore advantageous. The preferred method includes choosing a string family with a substantially consistent mass ratio, and configuring the device for use with that string family upon shipment, or providing instruction for such configuration. Instructions may comprise a flat (for example paper) template or jig (preferably with perforations at the guide positions) for locating string guides on a flat plate embodiment of the presently disclosed vibrato.

Alternately, a device may be manufactured to enable harmonic vibrato with only a given string family, for example by fixing string guides permanently to a main rotating member at correct positions, resulting in a device having no adjustment or having only flex compensation adjustment means.

Single Adjuster

Figure 1A:
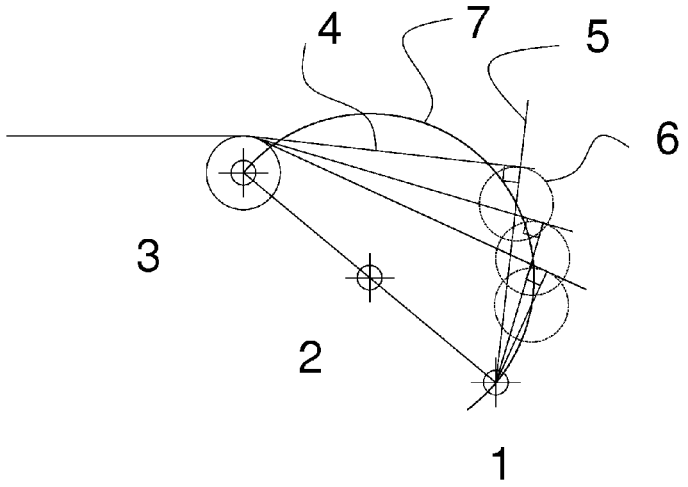
FIGS. 1A and 1B are schematics showing geometric construction of string guide path.
Figure 1B:
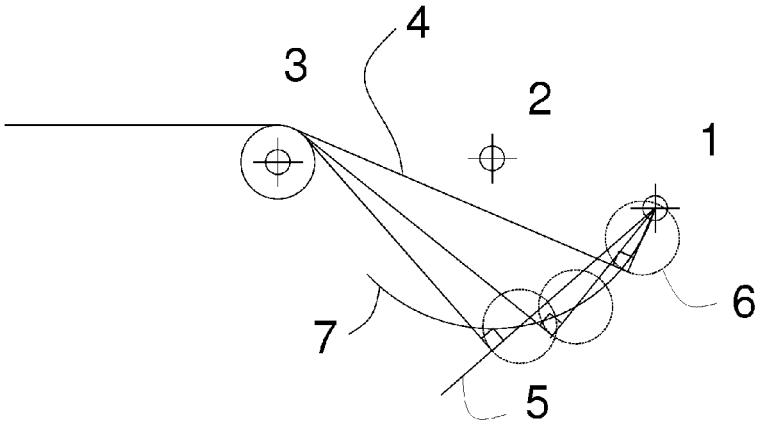

An alternative embodiment of the present invention comprises preferably two rotating members 8*a* and 8*b*, the first engaging solid strings, and the second engaging wound strings, each preferably actuated by a common lever, where the purchase between the lever and at least one of the members 8*a* and 8*b*, or between the members themselves, is adjustable to accommodate changing to wound strings of a different family without having to adjust the guide positions of all wound strings. Guides are preferably arranged on the rotating members according to the configuration of FIG. 1a in Application 668, and may be adjustable or fixed. Alternatively pivoting string anchors may pivot from fixed positions on the each of the rotating members. The complete device preferably includes common flex compensation means. Using this configuration with two well tuned harmonic rotating members of the type described in the parent application, so long as string mass rations are uniform among string families, the only adjustments made when changing string families are to the purchase ratio between first and second rotating members, and the flex compensation device.

Transposing Idler Brake

A transposing link 100 or idler 120, for example as disclosed in FIGS. 16H and 19G of the parent, may be associated with both a combination of shaft brake 125 and a cam 43, or cam follower 46, for example as disclosed relative to FIG. 25A.

Figure 25G:
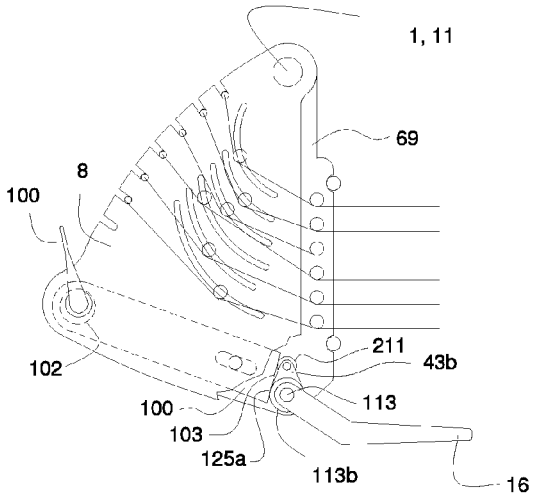
Figure 25H:
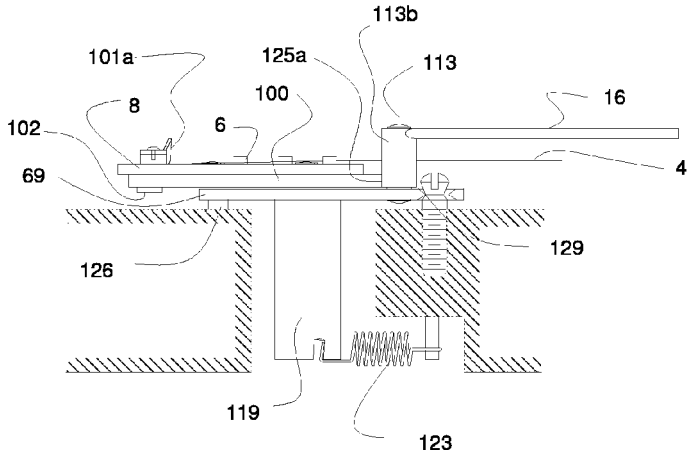

FIGS. 25G and 25H show an example embodiment in a face and side views of a device having a transposing idler bar 100 actuated by, for example by an eccentric 102 associated with transposing handle 101*a*, rotation of which handle causes bar 100 to slide relative to main member 8, changing the rotation angle of main member about main axis 1 by compressive contact with control arm shaft or journal 113*b*. Idler is guided, preferably by a pin in a slot, to present face 103 as a shaft brake and as an expressive surface for contact with roller rocker 43*a*. Alternatively, for example a roller having may be mounted to idler 100 to engage a cam or roller associated the control arm.

Figure 25J:
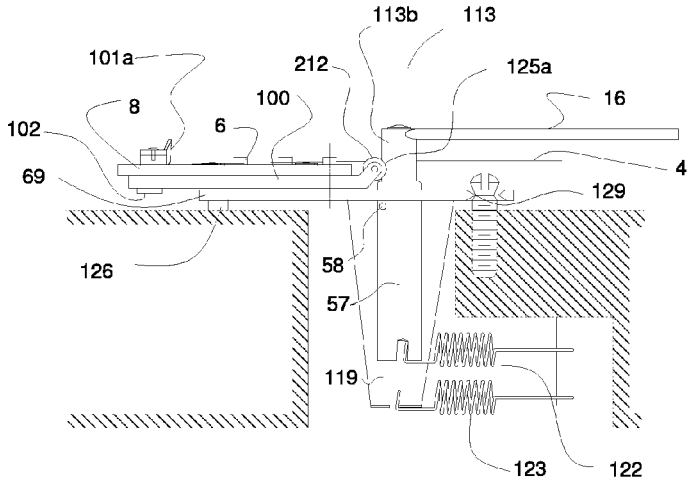

FIG. 25J shows a side view of an embodiment similar to FIG. 25H, but configured to utilize skew rollers as an actuation mechanism. A slave roller 212 on an axis askew to control arm axis 113 acts also as a brake on control arm shaft or journal 113*b* when the arm is not rotated in a bend direction (as in FIG. 34F). Master roller 211 as in FIG. 25G engages slave roller 212 when shaft is rotated in a bend direction. When arm is tilted in a dive direction about dive pivot 58, for example stretching bias springs 122, slave roller 211 rides forward on shaft or journal 113*b* to reduce string tension.

Any mechanism may be used to move the idler, with any means of indexing. Idler may be sliding as shown in FIG. 25G, or pivoting as described elsewhere.

Idler is preferably metal or a self lubricating polymer, but may be any substantially rigid material or combination of materials suitable for use as a shaft brake and as a cam surface or roller mount.

Bias Crank

Figure 25K:
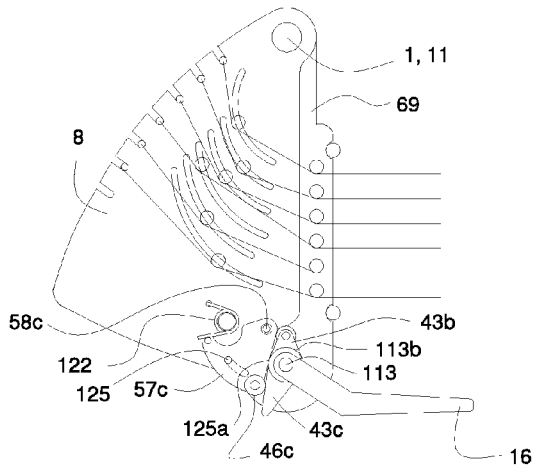

In FIG. 25K a crank 57*c* biased relative to main moveable member 8 presents a limit surface 125*a* against a stop fixed relative to base 69, where the stop is for example, control arm shaft or journal 113*b*. Bias spring means 122, bias stop 125, and crank pivot 58*c* preferably engage main member 8, while arm 16 rotates about axis 113 relative to base 69. Arm 16 rotating in a bend direction engages the main member or bias crank by cam or rocker means to rotate main member 8 about axis 1, separating limit surface 125*a* from shaft 113*a*. In the example a roller on a rocker 43*b* engages a surface near the hub of crank 57*c* during a bend.

Shaft 113*a* and crank 57*c* are configured to engage (for example by rocker 43*c* and roller 46*c*) when arm 16 rotates in a clockwise direction. Said engagement greatly increases the moment arm about crank pivot 58*c*, preferably enabling string tension to deflect bias spring 122 with motion of crank 57*c* away from its stop 125. Said motion enables rotation of main member 1 in a counterclockwise dive direction, limited by the presence of stop 113*b* in the path.

At-rest angular orientation of dive cam or rocker 43*c* (or equivalent cam for example) relative to axis 113 may be as in FIG. 25K, where, for example, string tension alone is the actuating force on main member 8 during a dive. Alternatively dive cam or rocker preferably engages crank 57*c* actively move in a more aligned with the force or torsion of the strings.

Figure 25L:
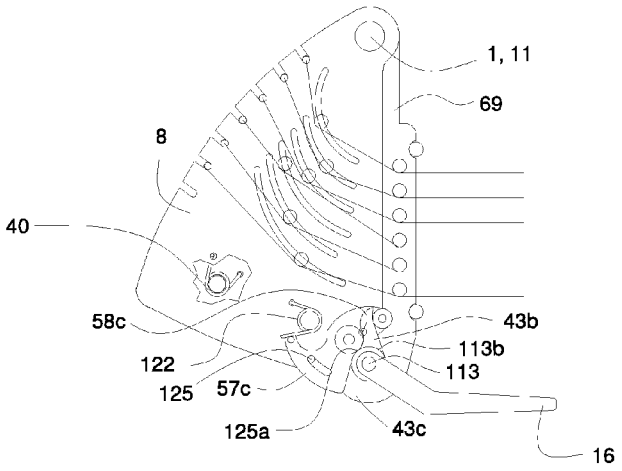

Dive cam or rocker 43*c* may be discrete from bend cam or rocker 43*b*, or the two may share a common roller, or cam follower, or lobe, or engage a common cam follower or lobe on crank 57*c*. In FIG. 25L, a single cam having bend and dive surfaces 43*b* and 43*c* extending from control arm hub 113*b* engages dual cam followers 46*b* and 46*c*. The cam preferably maintains contact with follower 46*b* during a dive (clockwise rotation of arm 16) to create a torsion on bias crank 57*c*. Bend cam surface 46*b* preferably engages follower 46*b* at a small or negative radius from pivot axis 58*c* relative to bias stop 125 to allow main member 8 to be biased with low (preferably adjustable) force or torsion from bias spring 122, particularly if optional balancing spring 40 is employed (between main member 8 and base 69, for example) to oppose the force of string tension on main member 8.

The movable elements of the figure may alternatively be fabricated for example with axes parallel to the bridge, rather than normal to the string plane as shown.

Any of the main members described in FIGS. 27A to 27G may be configured to accept fine tuners, for example sliding string tubes as previously described, adjusted by set screws against a lever associated with a cam or lever against an end or shoulder of said tube. For any embodiment illustrated showing simple string anchor means, it should be understood, that at least one alternative embodiment includes fine tuners and/or string clamping means.

It should be noted that in various embodiments not shown, a separately biased bend limit device (for example 220 in FIG. 28A) is biased relative to main movable member 8, or (fixed or moveable) base 69, or to the body or a sub base, or a combination thereof, preferably by spring means.

Latching

FIGS. 35A and 35B illustrate a top and side view of flat plate examples of various embodiments. The vertical projection 281 in the example is a substantially cylindrical boss with one side cut away to allow the knife edge 129 (associated with base 69, relative to which main member 8 rotates on pivot post 11) to engage the post 280*a*. Boss is preferably pressed from or welded to base plate 284. Automated resistance weld or TIG is preferred, with boss preferably turned to fit a precise hole in plate prior to welding.

The base 284 extends parallel to the string plane a suitable distance and with suitable rigidity to support a first latch component 170 adapted to engage a second latch component 171 attached to or integral with the moveable first member 8. In the example, the first component preferably comprises an axial thrust bearing 170*t* compressed against a rod end flange 170*f* (preferably a head of a screw held in compression against standoffs 170*a*), while the other second is a hard edge (preferably the edge of a slot), one end of which is preferably shaped to conform to the shape of the first mechanism so that slight movement of the main member in (in this case) the bend direction will engage the two latch components. The relative positions of the two latch components is preferably adjustable by an adjuster, for example slot 170*b*, shown in base plate 75/284. In another embodiment the position of the edge component is adjustable relative to (for example) the moveable member 8.

In other embodiments the first mechanism is the edge, and the second is the thrust bearing. The thrust bearing shown may be a simple low friction washer, a ball or roller bearing, or a simple low friction material integral with or coated upon one or both latch components.

Knife edge 129 in an embodiment illustrated is offset vertically from base 69, further reducing the bias spring tension required to maintain a non-diving position during a bend. In the example, the knife edge 129 is preferably machined into a mezzanine plate 69*a* supporting bridge saddles 9. The mezzanine plate is attached to base plate 69 preferably by machine screws, and the height is adjustable, for example by insertion of shims or washers between plates 69 and 69*a*.

In FIG. 35A, a dive stop associated with main moveable member 8 acts as a shaft brake 125 against control arm shaft or journal 113. A cam follower 46 associated with main member engages cam 43 associated with control arm shaft or journal 113. In an alternative embodiment cam follower is associated the control arm and the cam surface is associated with rotating member 8.

Bias means for FIGS. 35A and 35B is not shown.

In an embodiment of the example of FIGS. 35A and 35B not shown, flex compensation means opposing said bias means is configured to engage when latch components 170 and 171 are disengaged.

In an alternative configuration (not shown) first latch post 170 is biased against base 284 to relax in response to flex compensation force.

In an embodiment not shown, dive transport 57 may pivot flexibly relative to, for example, a body, a base 69 or the main member 8. The transport device may be a rigid mass connected via a flexible plate, or the device may consist largely in a flexible plate. The flexible plate, preferably bending in a plane substantially normal to the string plane, is preferable of a spring material suitable to provide adequate torque to bias at least the harmonic device against string tension. Spring rate and setpoint may be adjusted by positioning of a fulcrum and adjusting set screws against a tail preferably distal the fulcrum from the control arm connection.

It should be noted that for each latch embodiment comprising a latch mechanism forcibly engaged by motion of a major component of a vibrato device, an alternative embodiment (not shown) comprises a latch mechanism engaged by spring means, said engagement enabled by motion of said major component from a latch disengaging position.

Bias Limit Cam Notes

In an embodiment of the cam and follower of FIG. 9*c* of the 028 application (see also discussion of FIGS. 30A-30H), at least a part of the cam surface 52 is configured to engage follower 54 at a location opposite a ray between the follower axis and the transport axis 58 from the hand position on the control arm. Said location allows a small rotation of the control arm to effect a relatively larger displacement of transport 57. In a preferred embodiment of this feature, the engagement crosses said ray during the initial rotation of the arm, thus changing from a light touch near neutral position to a large tonal change near the end of the arm stroke. In at least one embodiment, axis 58 of said FIG. 9C is substantially parallel to the string plane, or to the bridge.

More generally, in FIGS. 43A, 43B, and 43C, a transport 57 biased in opposition to tension of strings 4 by spring means 53 pivots on an axis 58 relative to a base 25. As shown in FIGS. 43B and 43C, at least a portion of dive cam surface 52 is configured to engage follower 54 in alignment with a force vector 52*a* generating a torque about axis transport axis 58 in opposition to the desired direction of rotation of the transport about the axis, and in opposition to the torque of the lever 16.

In such a configuration, and in other configurations, the cam and follower (regardless of whether they act as a bias stop) act to limit the rotation of the arm in a way that shortens its stroke and reduces its purchase, while enabling a greater rotation of the transport device than would be possible even if the arm were locked to the transport. Such contact between cam and follower enables the transport to rotate through a greater angle than the arm itself.

In the example, the movable tailpiece member 8 is urged by string tension to engage a bend cam follower 46 with a bend cam 51. A bias limiter comprising a dive cam 52 and follower 54 may optionally employ a fixed stop 125, for example in addition to or in lieu of a constant radius dive cam surface to oppose bias spring force at rest or during a bend. Similarly a fixed stop may supplement the bend cam and follower. Dive cam follower 54 preferably rotates about an axis fixed relative to a base, for example base 25.

In the example, the movable tailpiece member 8 pivots about axis 1*a* relative to base 25 during a dive, and pivots about bend axis 1*b* relative to biased transport 57 during a bend. (presuming engagement of a zero-slope dive cam surface during a bend, and a of zero-slope bend cam surface during a dive) In alternative embodiments, either of said bend and dive axes 1*a* and 1*b* are associated with a biasing transport, or a base, or another moveable member.

It should be noted that at least one embodiment includes the dive cam so described, without association with the bend apparatus of the figure.

Alternatively separate arms (preferably extending oppositely) may be provided for dive and bend cams, for example the cams of FIG. 9C or 43A. Said cam axes are preferably not concentric, and said axes are preferably parallel to the bridge.

Electronic Vibrato

An electronic embodiment of the control means of the present invention, shown schematically in FIGS. 10 through 10D, provides an arm 16 rotatable about one or two axes 135 and 136 with respect to a mounting fixture, with rotation resisted by spring means 132*a* and 132*b*, and force sensors 130 or position sensors 131 measuring rotation in each free axis. Sensors may be of any type, for example piezoelectric, strain gage, potentiometer, inductive, magnetic, or capacitive sensors, and may generate analog voltage, analog current, digital, or frequency signals when connected to a suitable power source, or simple resistance values. (Analog is preferred for this discussion)

In one embodiment, the sensor itself (or a control circuit internal or external to the stringed instrument, in communication with the sensor) presents to an external controller a variable essentially resistive load. The sensor itself may be a simple potentiometer, or for example, the output from a power supply feeding a strain gage connected in a bridge configuration (with or without amplification) may feed the LED of an opto-isolator or an illuminated photocell.

The power supply, in its simplest form comprises the instrument's magnetic pickups themselves, which generate an oscillating current which can be used to drive op amp inputs through a bridge and strain gage combination, on a separate conductor, without significant signal loss. Alternatively, an internal or external power supply may be used.

Particularly if the sensor is not a simple potentiometer, the associated circuitry (not shown) preferably includes scale and shape correction to condition output to simulate a linear or audio taper potentiometer of the correct resistance to match the resistance of an "expression pedal" of a commercially available effects processor, such as those available from Boss, Line 6, or Digitech. (a 100 k linear potentiometer is typical). This embodiment has the added advantage of being suitable for use in controlling variable musical effects other than pitch (for example wah effects), as might otherwise be implemented by use of a pedal having variable resistance, thus allowing a performer to move about freely while using variable expressive effects.

In one embodiment, an example of which is illustrated in FIGS. 16F and 16G, a control arm 16 comprises a round shaft (preferably bent from the same bar stock as the arm) having a flatted (or otherwise keyed) length at the shaft's extreme end, and further having a detent near the interface between the round and flatted (or keyed) lengths.

A lower block 119 attaches to the underside of a flanged metal tailpiece, preferably by means of machine screws though holes in plate anchored into tapped holes in the block. (as the spring block on a Fender Stratocastor or similar standard vibrato tailpiece).

The block comprises a preferably machined hole in its top surface to receive a rotatable bushing having an internal diameter matched to receive the arm shaft, and further including key engaging means and displaceable detent gripping means.

Circuit preferably includes adjustments for threshold and/or zero in one or both directions to reduce hysteresis effects. A single ended analog output may be accompanied by appropriate switched output (eg, ttl, digital, npn, pnp, having amp comparator trigger), for example to signal the direction of pitch change to a controllers having only single ended inputs capability.

In the embodiment, a rotatable cylinder 137*c* inserted into the block 119 comprises a receiving socket matching the dimensions of the preferably flatted shaft 137*b*, and further preferably includes retainer means, preferably in the form of a formed spring plate 137*e* engaging a detent on said shaft.

Alternatively, in the embodiments illustrated by way of example in FIGS. 11D and 11E, a non-rotating block insert 137*c* rests against one or more force sensing means 130*a* in or on block 119, with control arm shaft hub 143*a* rigidly secured to the insert, for example by axial screw means 137*b*. Said insert my be at the top or bottom of said block, with annular shaft 143*c* extending through and preferably supported radially by plate 137. Arm 16 is rotatable about shaft hub 137*a*, with spring means 16*d* (for example a leaf as shown, or a coil within shaft ub) creating a tactile motion in response to user force against arm 16.

Analog or digital signal processing means 133 uses the signal from said sensors to proportionally modify the pitch of the signal from the string vibration sensing pickups 138. Processing may be performed onboard or externally. If external, the vibrato sensor signal may be transmitted by wireless means, or by a second conductor in a coaxial cable to the signal processor, or by a signal on a non audible or filterable carrier frequency transmitted on the main cable, or preferably by adding a filterable DC voltage bias to the music signal on the main output.

In the embodiment shown in FIGS. 11A, 11B and 11C, the device is mountable to a standard vibrato 137, preferably by way of an existing threaded vibrato arm socket 137*a*. Harmonic dive transport 57 is lightly biased against bias stop 125 by preferably adjustable harmonic bias spring 132*b*. Pressing arm 16 toward body generates a dive effect electronically until transport 57 engages harmonic dive limit 124 (preferably adjustable by cam or screw means). Continued rotation of arm 16 toward guitar body rotates standard vibrato 137 on pivot axis 129 from its biased position, generating a standard dive effect mechanically.

Further in the preferred embodiment, rotation of arm 16 counterclockwise about vertical axis 135 (normal to string plane) generates no effect until the arm engages stop means 141. With further rotation (resisted by preferably adjustable spring means) processor means 133 generates a bend effect using signals from vertical axis sensors and pickups 138.

In the simplest embodiment, the arm 16 has only a single sensor 130*a* or 131*a*, measuring rotation relative to an axis substantially normal to the string plane, with the processor 133 using the signal therefrom to modulate harmonic dive and bend effects. The arm's rotation axis 135 is fixed relative to the standard vibrato device 137, so that rotating the arm toward or away from instrument body generates a standard dive or bend effect. Arm preferably includes detent or locking means to allow rotation out of playing position when not in use, and spring means 132*a* to provide rotational resistance about said axis when in use.

In a simple signal flow chart in FIG. 10E, signals from pickups 138 and arm sensors 130 (or 131) are digitized at first conversion stage 139. Digital signal processor 133 changes pitch of the entire sample in discrete overlapping time slices, preferably by simply compressing or expanding the sample, and then feeds the result to secondary conversion stage 140, which feeds one or more amplification stages 134.

Alternatively, both standard and harmonic vibrato effects may be generated electronically with the described arm motions feeding preferably dual axis data to said processor. Harmonic dive limit 124 is preferably replaced by simple switch contact means which signal processor 133 to shift to standard dive, either by separate means or by, for example, biasing or reversing the combined analog signal from the two rotary sensors. Lifting control arm 16 from the instrument body may optionally generate a standard bend.

Alternatively, digitized arm position signal may be processed into a MIDI signal and forwarded to a MIDI controller having pitch shift capability.

Auxiliary Pickup Piezo electric, magnetic, or inductive sensors may be implemented to sense vibration on any of the components of the present invention for amplification with or in place of traditional pickups.

In FIG. 11H, preferably cylindrical insert 137*c* comprises, for example, cylindrical band 137*h* to retain one or more blocks, for example shaft flat (or key) retaining insert 137*f* and detent spring retainer 137*g*, in preferably milled groove means in side of insert 137.

Insert 137*c* in FIGS. 11H and 11J preferably includes cam or rocker means 130*c* to engage sensor directly or through intermediate lifter 130*b*. Sensor in the example of FIGS. 11F, 11G, and 11H is shown by way of illustration as a strain gage means 130*a* mounted to a cantilevered leaf spring 130.

Insert 137*c* may be configured to measure displacement or torque, for example by fixing insert rotationally within block 119 against force sensor or sensors 130, for example as illustrated in FIGS. 11D and 11E. Sensors may alternatively be configured, for example, as strain gages mounted to the surface of said insert.

Alternatively insert 137*c* may be configured to rotate freely, for example as in FIG. 11F, preferably retained in playing position by, for example, gage spring 130, or by separate spring means, for example a torsion spring 137*j*, or a separate leaf spring (not shown) acting as a drag brake on the insert 137.

In a preferred embodiment in FIG. 10F, the device communicates with a device controller over a 3 conductor cable. The device preferably shares a ¼" female stereo connector mounted on the instrument body with the instrument pickups, preferably using a common ground. Pickup contact on the connector is preferably on the tip, so that a standard cable may be plugged into the instrument without problem when device is not in use.

The cable is a preferably a high quality coax cable having ¼" stereo male connectors.

The device controller preferably includes a matching ¼" stereo female input connector.

The device controller expresses the music signal unchanged, preferably by means of a standard ¼" female output connector 242, to which the device controller may be connected to an effects controller or an amplifier. Alternatively, the music signal may be split from the stereo cable with a simple "Y" splitter prior to the device controller, with only the device signal fed into the input connector of the device controller, and maintaining a common ground on the resulting 3 cables.

The device controller conditions the signal from the device and expresses it as a resistor, for example through a ¼" female connector 243, which may be connected by suitable cable to the expression pedal input of said effects controller.

If the device signal is bipolar, the positive and negative signals may be each be expressed as separate resistors accessible through separate jacks, if the targeted controller so requires.

The device controller preferably comprises a (preferably external) floating dc power supply P, with common 240*c* preferably connected to the common of the input cable 241 (and directly or indirectly the music output cable 242). Positive or negative output from power supply feeds an amplification circuit A and a bridge circuit B. The power line to the bridge circuit preferably includes a voltage reducer V, for example a series of diodes, reducing bridge input voltage to preferably less than one volt. Power supply P and/or device controller 240 preferably include suitable filters and voltage regulation to provide smooth operation of the device without interference to the music signal.

The bridge circuit may be a single fixed or variable resistor or series of resistors, preferably matched to the range of the device, or it is preferably a wheatstone configuration as shown.

The input end of the bridge is preferably connected to the device conductor 241*b* on the input cable connector.

The bridge circuit is preferably tapped at suitable points across a resistance leg, and those taps used to feed the input of preferably an opamp circuit A powered by the power supply P.

Output from an op amp is fed through a preferably logarithmic multiplier back to its input, or to the input of another op amp, to condition the amplified signal in a conditioning circuit C for modulating the variable resistance device R as needed to shape the output resistance to the position of arm 16. The resistance device R may be any suitable coupling device, for example one or more illuminated photocells as shown, or field effect transistors, or isolating integrated circuits.

In FIG. 10G An input device located externally to a guitar, for example, may connect to the main input cable 241 via an external cable splitter 244 having, for example a female connector 244*f* receiving input cable 241, and a male connector 244*m* which in turn connects to the guitar pickups through a the standard ¼" connector on the guitar. Connection between male and female connectors may be a rigid assembly or a flexible cable connection.

FIG. 10G also shows, by way of example, a simple potentiometer 130*a* in housing 130*b* connected to the shaft of a control arm 16, rotating on axis 135, preferably substantially normal to the string plane, with pot housing 130*b* preferably fixed to a mechanical vibrato assembly.

In this embodiment the electronics within the described controller 240 may optionally be eliminated, so that the controller essentially becomes a cable splitter, as shown in FIG. 10G, with all inputs and outputs sharing a common ground 240*c*. This configuration takes advantage of the fact that the music and resistance signal cables 241 and 242 will generally connect to a common effects processor having a common ground for the tow cables.

More Notes on Electronic Vibrato

A vibrato arm having electric or electronic output is suitable for use in a number of configurations.

It may be a standalone input to another device.

It may be an input device associated with an onboard electronic effects generator.

It may be an input device associated with a remote electronic effects generator.

It may feed an onboard circuit to preprocess its signal for use onboard or remotely or both.

One or more circuits receiving electronic output associated with rotation of an arm about multiple axes are preferably configured (for example through simple switching or logic devices) to control a separate digital effect or a separate device with rotation about each axis.

A control circuit, preferably a programmable logic device, preferably further includes a logic module capable converting rotation (or torsion) of the arm into a discrete signal (for example switch closure, digital pulse, or toggle of switch or digital output) for example for activating effects in an onboard or remote effects generator.

A rotation or torsion sensing device may generate an absolute or incremental signal. An absolute signal, for example the voltage output from a potentiometer, may be converted by an ADC for further processing at regular or irregular intervals. An incremental signal, for example that generated by a quadrature encoder. An incremental signal may be converted at the device to an absolute signal with appropriate counting logic, or it may preferably be transmitted incrementally to a remote controller having greater processing power. Output from a quadrature encoder is preferably fed to an onboard logic module to convert the quadrature counting pulses into separate up and down counting pulses. An assembly generating an incremental signal preferably also includes a separate sensor to generate a signal for home or neutral position.

In a preferred embodiment said logic module includes hardware and software for mapping the value from rotation or torsion of an arm about an axis into preferably user defined regions. The presence of the value in any defined region preferably determines the state of preferably all outputs associated with the mapping function.

Thus multiple outputs may be associated with a single region, even as the arm continues to be used to control pitch bend, if desired.

The controller is preferably configured to receive a separate signal, preferably from a momentary switch closure, receipt of which signal preferably initiates a map reading mode, during which the controller momentarily ceases to pass input from an arm sensor according to the current state, and instead uses the arm input value to set a new state according to the mapping function, preferably upon opening of the momentary switch.

The momentary switch may be a simple pushbutton, or for example a contact activated by twisting a preferably cylindrical arm about its cylindrical axis, or sliding it along its axis, or simply lifting it. The device preferably includes logic module or modules configured to suitably filter switch bounce, for example by testing switch states against on and off timers.

Embodiments of an arm using a remote controller may include, for example cable or rf communication with the controller.

Rather than sent incremental pulses to the remote controller, an embodiment (not shown) device accumulates pulses on board and transmits coded words containing a preferably fixed number of bits, for example identifying the device, and the signal value, and a checksum, as is common in some rf control circuits. A single word preferably includes bits for all discrete functions and at least the two analog functions. The onboard device preferably transmits the word upon any change, and at frequent intervals after a change and less frequent intervals while dormant.

In a useful embodiment displayed schematically in FIGS. 10H and 10J an RF transmitter, and a control arm are mounted to a common base, in turn secured to a guitar, preferably by means of a single machine screw 137*c* into an existing threaded hole 137*a*, for example in a Stratocaster "trem" anchor block.

The same or similar mounting screw is preferably adaptable to secure the unit to a mounting fixture (for example a plate) extending, for example, under the tailpiece of a guitar having a "stop bar tailpiece" such as that used on a Gibson Les Paul model. The flanged stop bar screws or simple machine screws are preferably tightened into the existing threaded sockets to tighten the mounting fixture and associated spacers rigidly to the body. (Alternatively, in an embodiment not shown, an electronic control arm, preferably with circuitry, is mounted to directly to a replacement stop bar shaped to accommodate the arm and circuitry, or shaped to receive the above base, preferably by means of one or more fasteners.)

The device housing 270 preferably encloses a preferably rechargeable DC power source 272, an antenna 271, a programmable logic device 274 (for example a digital signal processor), and an rf transmitter 275, (preferably fm).

Power switch (not shown) is preferably engages the arm hub or shaft or journal, preferably by a cam or eccentric to power up the device when arm 16 is rotated toward playing position.

A momentary switch device 277 preferably in the housing, is preferably activated by a rod or light beam along the control arm shaft axis, for example in an optical interrupter configuration, where sliding the arm or a button within the arm toward the hub causes an interruption in the beam. The configuration eliminates opportunity for wire chafe.

Alternative or additional arm 278 on an alternative axis may provide for control by the forearm, rather than the hands of the player.

It should be understood that the terms switch and closure as used here may be represent the assertion of any state by any device capable of generating a useable signal of any kind. Likewise a switch opening.

Said base and housing combination is preferably of adequate strength and rigidity to transfer dive torque from the arm to the mechanical vibrato to which it is mounted.

Said housing and circuitry preferably includes one or more momentary push buttons 276 as input devices in addition to or as alternative to said mapped arm rotation.

The remote processor in one embodiment includes a logic module of hardware and software configured to change the state of external switches or devices preferably by toggling in response from a signal transmitted from the on board processor that a momentary button or combination thereof has been pressed.

Said onboard processor in one embodiment includes a logic module of hardware and software configured to transmit the state of individual momentary buttons and other devices, and the incremental or absolute rotation or torque of the arm from its home about at least one axis. At least one axis is preferably substantially normal to the string plane at rest.

It should be understood where not expressly stated that any function ascribed to a disclosed device is in at least one embodiment expressed by a logic module comprising a combination of software and hardware components, where the term "software" extends to all forms of programming, including, for example, instructions for masking of programmable array logic, and where said hardware may include, for example, devices for processing analog signals and devices for converting between analog and digital signals.

Signal size or word length, broadcast frequency, and processor speed are preferably chosen to achieve a latency of less than 30 milliseconds.

A preferred embodiment of a unit adapted for use with a remote processor includes an rf transmitter (and separately a corresponding receiver) capable of sending at least 4 discrete momentary signals.

The four signals include home position pulse, up pulse, down pulse, and momentary button pulse. (where button pulse is a signal from an actual pushbutton, a lever, an interrupter, or any other device generating a discrete momentary signal in response to a user action.

The remote processor, in one embodiment includes a receiver and a cpu, where one or both decode signal from the transmitter.

The remote processor also preferably provides a performance-time alphanumeric display to display at least the code of the selected output state, an embodiment of which displays a single numeric and a single alpha character for each discrete output states. Another embodiment displays two hex digits. Another embodiment displays two fields of one alphanumeric digit each, the upper and lower bounds of each field settable by the user (preferably through a separate off stage setup interface).

The remote processor preferably includes the following modules (comprising a combination of hardware and software) to respond to the transmitted signal, set the output state, and set the display.

a) A receiver module to receive and demodulate the control signal from an rf or music signal source, or to extract bias information from a music signal source.

b) A decoder module comprising means to set the state of input registers based on the states of the input signals, c) An arm position registration module adapted to evaluate the position of the arm based on accumulated up and down pulses since the prior home pulse.

d) A display mapping module comprising one or more database and/or rule systems, enabling the module to associate the accumulated arm position register value with one or more transient character register values e) A display state fixing module comprising a rule system for copying (or locking) one or more transient character register values to relatively non-volatile display register, depending of the state of the momentary button input.

f) An output register state fixing module comprising a searchable or indexable database of potential non-volatile display register values associated with output register state values (output register database), where the module fixes the state of discrete output registers according to the associated values in the database, and where the connection or function associated with the control arm position value is preferably determined by the state of at least one of said output registers.

g) Relay or other power level conversion devices for converting the output from the output registers to appropriate power handling required by the function served by each register.

Output processor also preferably includes a power supply and other ancillary hardware, as well as filters and DAC hardware for use depending on the state of the appropriate output register.

Processor also preferably includes a database editing module comprising connection to a preferably external input device (for example a personal computer via a communications port, said computer executing instructions adapted to enable said editing, and where said external instructions are preferably interpretable and stored in non-volatile memory associated with said remote processor to enable downloading and execution by the external input device) where in response to signals from the external device having a predetermined significance, the module compares said signals to a rule base, and executes the appropriate rule for editing the nonvolatile memory associated with the display mapping database or the display vs output register database.

Description of Circuit and Flow Drawings

Figure 11K:
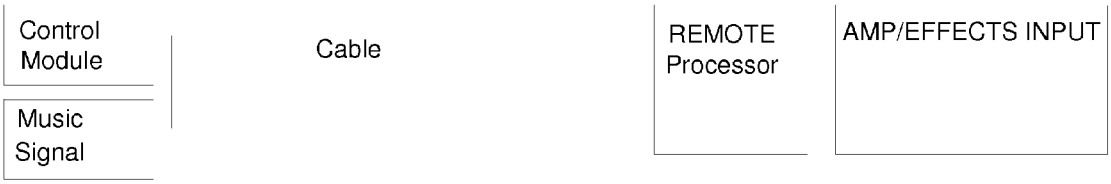
Figure 11L:
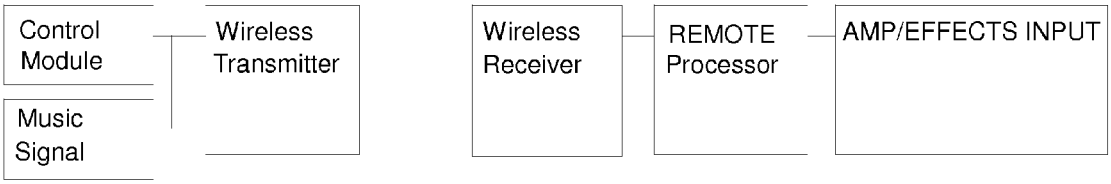

FIGS. 11K, and 11L show examples of two configurations of one embodiment of a remote processor and a control module receiving input from an electronic control arm with or without additional input devices.

In FIG. 11K, output from the control module combines with a music signal (for example from electromagnetic pickups on a guitar) or from a music signal amplifier on the instrument, to create a composite signal, which is preferably fed to an instrument output jack. A cable connects the instrument to a jack on remote processor. The remote processor preferably filters the control signal from the composite signal (including correcting for bias, if necessary). The remote processor decodes the control signal, and either sends appropriate signals to external effects processors, or modifies the music signal, and substitutes the modified signal for or adds it to the filtered music signal prior to passing the signal on to an amplifier, or a series of effects processors.

In FIG. 11L, the a wireless transmitter (mounted internally or plugged into the instrument output jack, for example) transmits the composite signal to a wireless receiver, preferably plugged into an input jack on the remote processor.

Figure 11M:
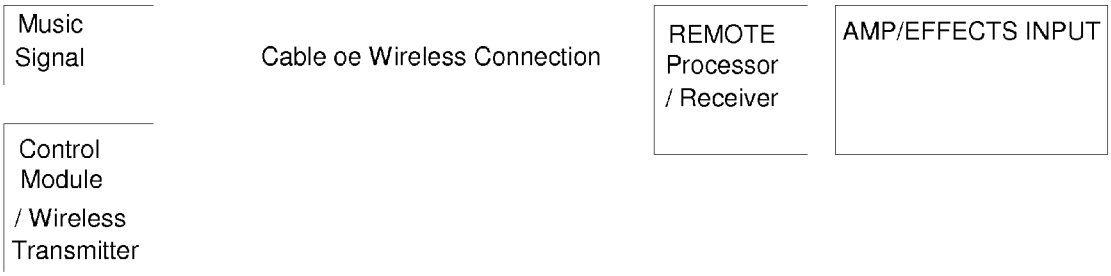

In FIG. 11M, the a wireless transmitter associated with the control module on the instrument transmits the control signal to a wireless receiver associated with the remote processor.

Said control transmitter and receiver may be configured to also transmit and receive a music signal. Alternatively the music signal may be transmitted as shown, by for example a standard cable engaging input and output jacks on the instrument and the remote processor.

FIGS. 11N and 11P through 11T show ladder/block diagrams of various embodiments of a control module configured to combine a control signal with a music signal into a composite, for transmission to a remote processor by means of a standard cable.

Figure 11N:
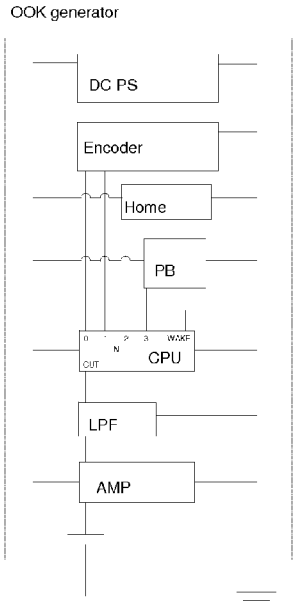
Figure 11P:
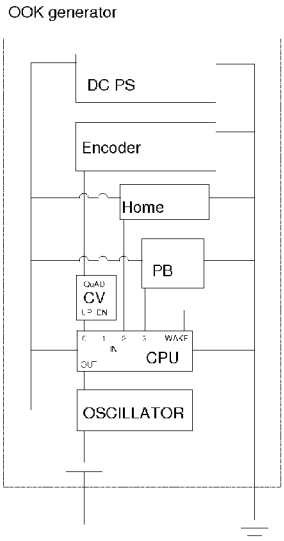
Figure 11Q:
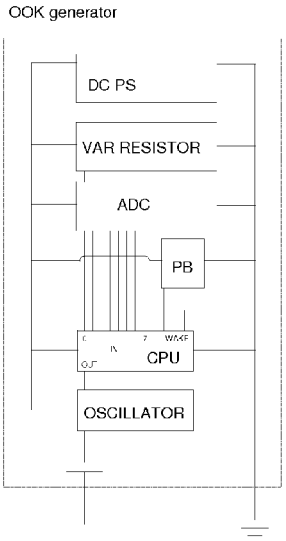
Figure 11R:
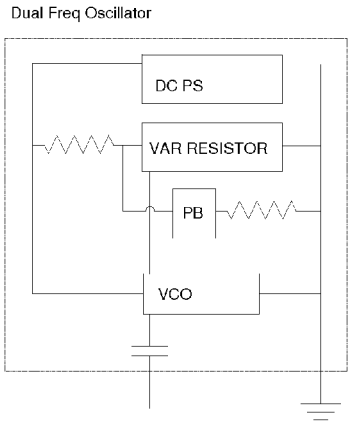
Figure 11S:
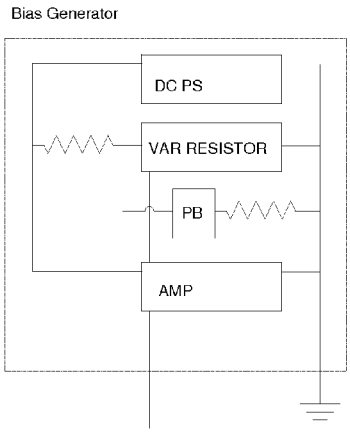
Figure 11T:
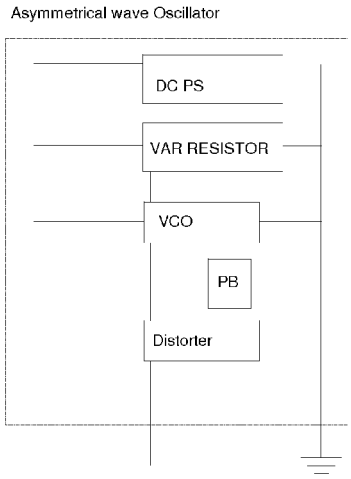
Figure 11U:
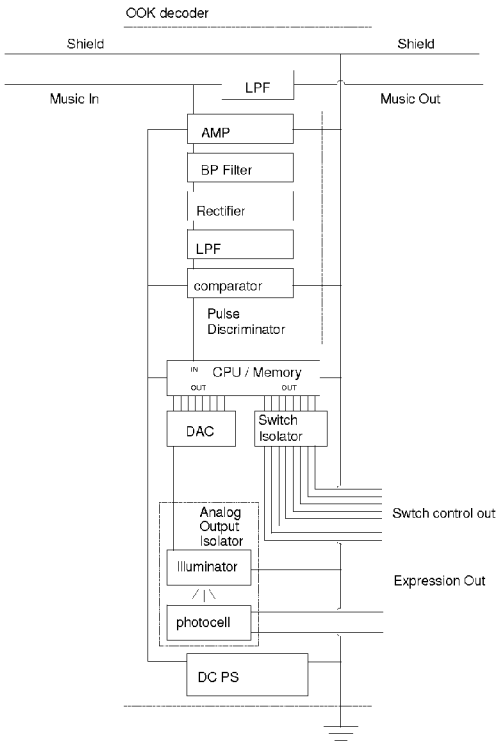
Figure 11V:
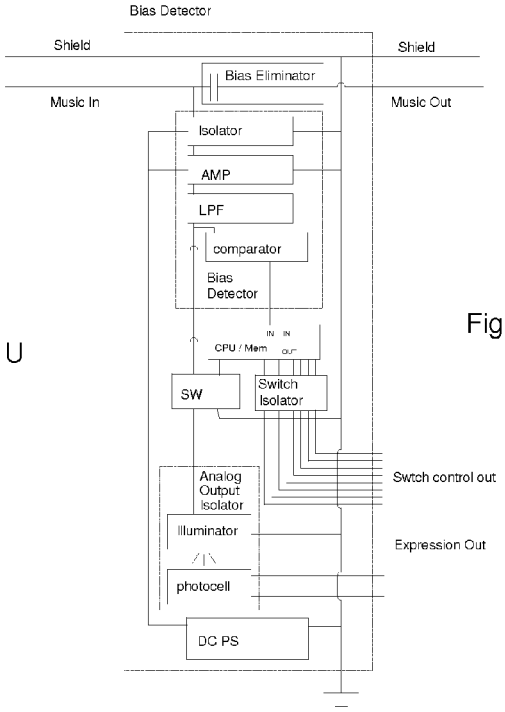
Figure 11W:
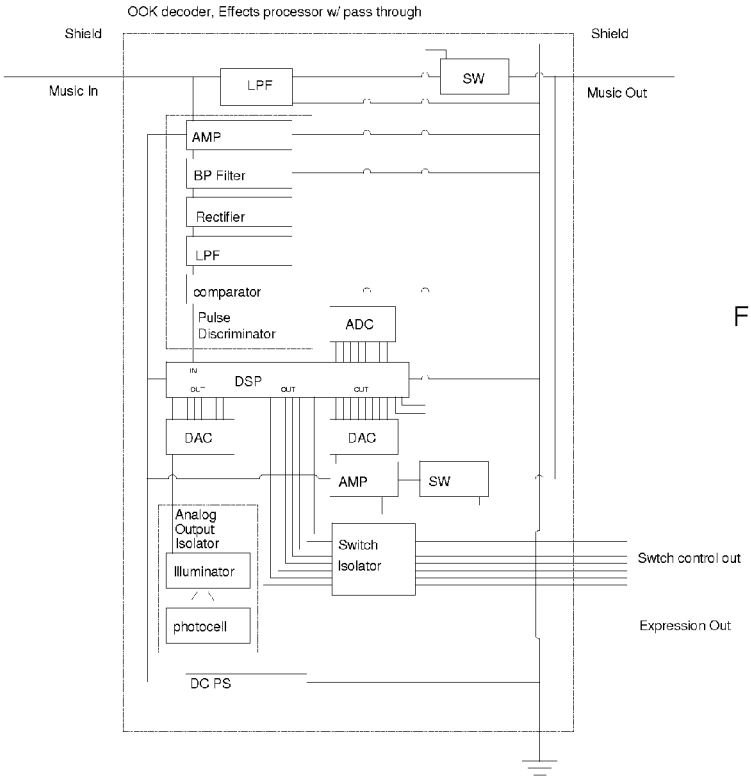

FIGS. 11U through 11W show ladder/block diagrams of example embodiments of remote processors configured to process the control signal and pass a raw, filtered, or modified music signal to an amp or effects processor.

Components and their arrangement in the figures are by way of example only.

FIGS. 11N, P, and Q show ladder examples of preferably OOK or FSK signal generators.

A processor (CPU) powered by a power supply (DCPS. Power switch not shown) receives input from an incremental or absolute encoder (Encoder) with or without a home position sensor (Home) and with or without switch or momentary inputs (for example pushbutton) (PB). Alternatively absolute encoder means may comprise a variable resistor (Var Resistor) for example a potentiometer coupled to an analog to digital converter (ADC), as in FIG. 11Q.

A quadrature encoder input may be converted to up down inputs by a converter (CV in FIG. 11P). The output signal may be generated by CPU in FIG. 11N and filtered in a low pass filter (LPF) or a separate OSCILLATOR may be triggered by the cpu in FIGS. 11P and 11Q).

In FIG. 11R, a powered voltage controlled oscillator (VCO) receives a voltage input from a variable resistor in a bridge circuit where the input voltage is modified by a momentary input pulling the voltage high or low by an amount to alter the frequency by a detectable level. The oscillator frequency is decodable as both arm position and switch state. (momentary input may alternatively be connected to a scaling input on a VCO IC.)

In FIG. 11S, the control voltage or current may directly or through an amplifier stage (AMP) alter the bias of the composite signal in a manner decodable by the remote processor.

In FIG. 11T, the output of a VCO may be fed to a distortion circuit to clip one or both poles of the oscillator output wave in accordance with the state of the momentary inputs (PB) in a manner decodably be a remote processor.ww Additional Electronic Features, A control arm having electronic means to sense rotation or torque about one two axes, for example as described for embodiments of this disclosure, may be provided by itself for connection by others to suitable internal or remote devices of their choosing, or it may be provided with any combination of processor and connection means.

A simple embodiment of a connection between an electronic control arm and a remote processor includes an oscillator generating a non audible (preferably high) frequency signal associated with the analog signal from arm manipulation.

Additional oscillating signals may be generated from preferably momentary switch devices, each feeding the input of an oscillator generating a preferably unique frequency preferably outside the range of the arm output oscillator.

The signal from one or more oscillators is preferably transmitted to a remote processor as an oscillating electrical value (for example current or voltage) preferably over the same conductor used to transmit the music signal from the pickups or onboard preamp.

The remote processor preferably filters the non-audible frequency from the music signal before passing the music signal to another processor or to an amplifier.

The remote processor preferably captures the non-audible frequency in a decoding module, comprising for example in a bandpass filter, or a combined ADC/DSP, or other logic module, comprising hardware and software components. Hardware components of decoding logic module may additionally be used in logic modules creating additional musical effects.

Alternatively or additionally the same hardware or separate hardware components are preferably incorporated into a control output logic module of hardware and software components configured to control suitable analog outputs (for example resistive photocell output) and discrete outputs (for example relay outputs) available for the control of amplifiers and effects boxes, and for swithching audio signal cables among amplifiers and effects boxes.

A benefit of a device using a limited range of ultrasonic or near ultrasonic frequencies to convey arm and switch information to a remote processor is that the signal may be superimposed over the music signal transmitted either by cable or by wireless means, for example, a commercially available fm transmitter plugged into the cable jack of the instrument. Where the signal is suitable for transmission over a wireless connection it should be understood that for embodiments where a cable connection is illustrated, a suitable wireless connection also falls within this disclosure.

A schematically simple embodiment of the device uses a single oscillator associated with the rotation or torque of the Conrail arm (preferably about an axis substantially normal to the plane of the strings). Oscillator circuitry is preferably configured to vary the output frequency according to input from the control arm, with output varying over a range preferably equal to less than 50% of the frequency at neutral position.

An example of a simple embodiment of such a circuit uses a variable resistance device (for example a potentiometer) associated with arm rotation as an input to a voltage controlled oscillator IC.

At least one discrete input, for example a momentary push button, leads to a unique change in oscillator frequency, preferably by a unique multiple, for example by switching of inductors or capacitors in a simple oscillator circuit, or switching inputs or input resistors on an oscillator IC.

The output from the example oscillator is superimposed over the music signal, for example by simple parallel connection of an isolated oscillator output to the instrument output.

The logic module of the remote processor determines the state of the discrete inputs, and the neutral oscillator pitch, preferably by detecting the control oscillator frequency and comparing the measured frequency with the ranges of frequencies possible for each switch closure. For each discrete input at the source unit, a logic module sets the state of an associated output depending on whether the oscillator frequency falls within a range associated with that input or that input in combination with other discrete inputs.

From the range of the input frequency, a logic module, for example, determines oscillator frequency associated with a neutral arm position, determines the ratio of actual frequency to neutral frequency, applies any necessary correction to that ratio required by the frequency range, applies any necessary scaling and zeroing functions, applies any necessary deadband rule, outputs the resulting digital value as a representation of the control arm position.

An analog output module evaluates the digital control arm position value and applies appropriate rules to pass values to one or more discrete and analog outputs according to logic instructions configured preferably to simulate a potentiometer when the outputs are connected to, for example, amplifiers for single or cascaded illuminate LEDs for preferably resistive photocells, where one or more discrete outputs, if any, may also be employed to activate switches to cascade photocell or transistor output to achieve greater range.

The transmitter device may alternatively include a modulator to transform the arm position to a frequency modulated characteristic frequency on a non audible carrier frequency determined by switch states, where the remote processor includes a demodulator to extract the characteristic frequency and convert it to a useable value representative of the arm position or changes in arm position.

A preferred embodiment includes both a coding module having hardware and software components, and a modulator, The coding module is configured to convert changes or states derived from switch and arm sensor inputs, for example, to (for example binary) coded messages, modulated preferably by standard means onto an AM or FM audio signal at a single non audible (preferably ultrasonic) output frequency.

If the arm position sensor is, for example simple potentiometer, the output may be input to an ADC to achieve an absolute digital input to the coding module. Alternatively an absolute encoder may be used.

If the arm position sensor is, for example, a quadrature encoder with a home position sensor, the main hardware component of the coding module may be a simple digital processor without analog capability. The instructions preferably configure the device to send switch state and arm position messages intermittently and upon change of switch state and arm position. A preferably binary sequence code is preferably associated with the state change of each switch, so that a signal from a momentary pushbutton closure or release may be sent multiple times with the same sequence code, where the sequence code represents the sequential order of the signals. A code representing the arm position value is preferably also associated with each transmission of at least one switch state code, to enable processing an arm mapping function as previously described.

A decoding module in the remote processor preferably has hardware and software components configured to interpret the message as a switch closure for only the first of each said sequence code signal for each given switch. For example, if the most recently processed sequence code for a given switch is 10, the decoding module is preferably configured to ignore subsequent signals for that switch until the sequence code exceeds 10 (or wraps to 0).

The coding module passes preferably the most recent switch state to the transmitter. By comparing the sequence code associated with a switch state signal to the last previous sequence code received for that switch, the remote processors decoding module reconstructs any missing the switch state history, and forwards the entire history in sequence to the processing module.

Frequency shift keying (FSK) or On-Off Keying (OOK, a subset of FSK) is a preferred modulation method, having the advantage that the modulation may be a wave output from the coding module itself (preferably with lowpass filter for external smoothing), or the coding module output may be used to trigger a timed burst from a separate oscillator. The demodulator may be a simple bandpass filter generating a smoothed rectified bit stream input to simple logic module with or without a separate input data register.

Digital representation of switch and arm position data on a carrier wave is alternatively performed by a phase modulator using a phase shift keying to represent individual bits of data. A demodulator associated with the remote processor extracts the digital data for use by the processor.

A simple coax cable (or a commercially available rf transmitter-receiver combination) transmits the combined music and control signal to the Input of the remote processor. Alternatively an rf transmitter and receiver, for both control and music signals, are incorporated into the control and remote processor modules.

The remote processor preferably includes one or more filter modules, comprising electronic hardware with or without logic modules comprising hardware and software components, configured to extract the control signals from the input.

A filter module (for example a crossover) for each frequency range preferably extracts preferably superaudio signal (of both analog and momentary signals)

Note that in some embodiments, the powersource to the

Physical Sensor Configuration

In an example of an alternative embodiment shown in FIGS. 10R and 10S, a housing 270 rotates preferably about a shaft 137D, preferably rigidly cantilevered from base 137 by compression screw 137*c* (or for example keyed to screw 137*c* and locked to said base with separate nut). Preferably a wrenchable surface 137*e*, preferably machined into shaft 137*d* enables positioning the shaft for manually fixing the neutral position of sensor 273 (for example a potentiometer) and spring 279. Sensor and spring are each preferably keyed or otherwise associated with both the shaft and the housing so that sensor preferably generates a signal or resistance corresponding to rotation or torque of housing about axis 113, and spring preferably resists said rotation, in at least one direction.

Control arm 16, preferably rigidly associated with the housing 270, extends from housing at a fixed or adjustable angle about an axis parallel to main rotational axis 113 (fixed relative to said base) to enable manipulation of housing about said axis, while also enabling manipulation if base 137 about pivots 129.

The embodiment preferably includes at least a single momentary switch (for example a pressure sensitive switch 276 on the housing, or 276*a* within the housing, activated by a ram 16*s*, for example through the center of arm 16).

Rod 16*s* (preferably of nylon or uhmw PE) preferably has a flanged tip 276*u* at its inboard end to retain it within the arm. Pressing on the tip 16*t* of the rod activates preferably pressure sensitive switch 276*a*, with little motion. In one embodiment, switch 276*a* has more than two states, enabling progressively harder pressure (or more travel) to trigger a separate signal.

Rod 16*s* may alternatively be a single or dual optical conductor, for example fiber optic glass. If switch 276*a* comprise an optical beam source and an optical receiver, and preferably a discriminator, then the touch of the users hand to the tip of the conductor 16*t* will alter the refractive index of the glass face that a signal will measurable at the switch 276*a*.

In vibrato embodiments in FIGS. 10U and 10V, at least the rotation sensor 273 and momentary switch 276*a* are located below the bridge plate 137, preferably in a housing 270, Signal processor and transmitter (not shown) may also be located in the same housing, or elsewhere, for example within a cavity in the instrument. Rod 16*s* in FIGS. 10U and 10V preferably extends though the center of arm pivot shaft 113*a* to engage momentary switch 276*a*. A bar or lever 16*p* (with or without mechanical advantage) may be used to enhance the surface area or actuating force or accessibility of the switch.

A shaft brake cam 279*d*, preferably cut into shaft 113*a*, engages a brake piston 279*c*, urged toward the cam by preferably flat spring 279*b* preferably screwed to the outer surface of the housing. Arm return spring may be a similar flat spring, or for example, a torsion spring 279 engaging shaft 113*a* and plate 137 or housing 270 (preferably by adjustable stop 279*a*, in this example a simple set screw).

Rotation sensor is preferably an encoder wheel 273 having preferably 3 sensors 273*i*, for example optical interrupters, or hall effect sensors, to generate signals for incremental rotation and home position.

Alternatively a variable resistive device or an absolute encoder may be operated intermittently for reduced power consumption, compared with the constant power requirement of an incremental encoder.

In FIG. 10W, a transmitter housing 270 and/or momentary switches may alternatively be mounted to or integrated into the base or moveable member of a vibrato 137 device. At least one button 276 is preferably accessible by the palm or heel of the hand while manually rotating lever 16 about shaft axis 113.

Remote processor is preferably configured or configurable to include display and/or foot controls in lieu of or in addition to controls on the instrument.

Electronic Arm Improvement

FIG. 10K shows an example embodiment of a release means (cam 279*y*) associated with human interface (lever 279*x*) to allow a musician to engage or release spring force on a shaft brake, shaft return mechanism, or positioning lobe associated with shaft 113*a* of arm 16.

In the example cam 279*y* deflects leaf spring 279*b* to remove pressure from a positioning lobe 279*d* on arm shaft 113*a*.

Return spring 279 may also be similarly disabled.

A single interface (for example a lever) may be associated with one or more springs (for example by cams on a common shaft) or multiple interfaces my be used.

A common shaft may also engage switch means to depower an electronic circuit.

In FIG. 10L, means to disengage springs from brake and positioning cams on shaft 113*a* may include, for example, a shift fork or equivalent 279*z* configured to axially slide a moveable cam shuttle 279*s* keyed to shaft 113*a* to and from an operative position, where for example a sprung piston 279*c* engages an operative region of the cam shuttle 279*s*. Fork engages shuttle preferably in a slot 279*t*. Forks to shift multiple cams may be combined on a single actuator, and may be configured to shift in unison or sequentially by their position on the actuator. Actuator is preferably also provided with detent means to hold it in or out of operative position. Actuation may be by sliding shaft 279*u*, as shown, or other means, for example a lever directly or indirectly displacing fork means. (fork 279*z* may have one or more contact points with the shuttle 279*s*).

It should be noted that in one embodiment partially illustrated in FIG. 10V, a lever 16*p* acts as an actuator for one or more momentary switch devices, and also replaces arm 16 as an actuator for one more of the electronic vibrato sensors and mechanical vibrato device. Momentary switch may be activated by upward or downward motion of arm or both.

A module or combination of modules in said controller is preferably adapted to receive the switch states and the angular sensor signal for the arm.

Upon receiving a momentary signal, a module or combination of modules in said controller (for example a PAL) preferably identifies the switch states and the angular range state of the arm, and according to programmed searchable rules, preferably sends a corresponding signal to an action module for the appropriate action.

Electronic Disclaimers

It is understood that the circuits shown are by way of example only.

It is understood that obvious modifications to the illustrations provided here fall within the scope of this disclosure. For example, components shown in the drawings may be freestanding hardware components, or may be incorporated into one or more ICs, or may be implemented as a combination of hardware and software instructions on the cpu, with instructions stored in on-or-off-chip memory (not shown). More or fewer amplification and filtration stages may be used, and their sequential order may be changed. Output isolation may be by any means suitable for the target, and may include amplification and filtering (not shown) One or more switch outputs may switch one or more analog outputs. Equivalent circuits or instructions fall within the scope of this disclosure.

Remote processor input and output may be isolated from the guitar cable on both conductors. It is understood that various modes of signal conversion and isolation, for example to ttl levels as may be necessary for IC inputs, may be employed, but for simplicity, are not illustrated.

Hardware used in the transmitting module may be shared with additional logic modules configured to switch among pickup wiring patterns on the instrument.

Various devices shown as passive (unpowered) in the figures may alternatively be active (powered) and vice versa.

It is understood that illustrations of embodiments showing a cpu (eg dsp) also include at least one memory device configured to store program instructions and/or data, and that any apparatus or method disclosed comprises means to read instructions from said memory, store and retrieve data, where said memory is discrete or integral to said cpu or cpu chip. In the figures the memory device is included in the cpu or dsp package. It is understood that analog, digital, and switch inputs and outputs shown are by way of example only.

It is understood that said processor is configured to boot, read and execute instructions, and to read and or write data to and from memory and/or input or output ports.

Clarifications Notes:

Not all embodiments of the disclosed invention are described here.

It is understood that a device configured to accept modification to include elements described here falls within the scope of this disclosure, as do elements configured to be added to a device such that the modified device falls contains disclosed elements.

It is understood that, where applicable, flex compensation may be added to an embodiment for which it is not illustrated, and that one embodiment of flex compensation may be substituted for any other.

It is understood that, where applicable, a bend or dive latch may be added to an embodiment for which it is not illustrated, and that one embodiment of a latch may be substituted for any other.

Stated position or orientation of an axis, journal, or shaft, unless otherwise stated, generally refers to orientation at-rest or at neutral position, where the axis may be associated with a moveable component, the movement of which would change the orientation of the axis, journal, or shaft.

Pivot or rotation means may include flexible solid connection approximating the functionality of a pivot, where practical.

In a description including an instrument body, it is understood where practical, that a separate discrete base fixed or moveable relative to the body may be substituted to fill the function of the body in an alternative embodiment. Likewise a body may be substituted for a base in alternative embodiments.

It is understood that, where practical, for any disclosure of a device having a control arm rotating relative to a discrete moveable transport device, an alternative embodiment includes a control arm rotating about two axes on a hub in hub retainer, where one of two pivot axes rotates relative to a hub retainer.

Use of common terms of the trade, for example "tone block" is meant to aid in identifying a component in a drawing, and not necessarily for describing or limiting its function in the present disclosure.

Where bias springs shown parallel to the strings, it is understood, where practical, that an alternative embodiment of the disclosure includes bias means at any angle, including normal to the string direction.

It is understood that any device configured to be combined with another device so that the combination yields a device equivalent to one or more elements of the present disclosure, also falls within the present disclosure.

Additional Notes

Because the pitch of a string varies with the square root of the string stretch, and the scale of the invention is large, the invention is robust enough to allow significant deviation from optimal design without creating excessive transposing errors. Thus any configuration substantially equivalent to the preferred optimal configuration falls within the scope of the invention. The low angle of rotation allows strings to wrapped about geometrically wrong side of said guide or about a guide in a geometrically incorrect track without excessive harm to pitch accuracy. Guide means may be visually placed by measurement or by index marks included on the device, and a small error in placement will be undetected acoustically.

An embodiment of the invention taking advantage of said tolerance in a flat plate configuration may use fewer than the total complement of arcuate paths. It may also use additional (for example parallel to the high e path) non converging paths to allow flexibility in setting up said device for multiple tuning. Where multiple paths converge near the main pivot axis, one may continue while the others terminate short of the convergence point. Alternatively, a less preferred configuration may employ a perforated plate straight slots approximating the preferred configuration. (FIG. 15). Guides on straight or curved paths (on a flat plate tail piece, for example) may be configured to vary the angle from tangency among the strings to approximately compensate for neck flex.

A control arm axis normal to the string plane as disclosed herein is additionally beneficial when applied to acoustic guitars, where motion of the control handle will not conflict with vibratory rotation of the sounding board about the bridge.

Mechanical construction listed above is by way of example and conceptual schematic only. Any configuration functioning according to the described principles falls within the scope of this invention. In particular switching locations of cams and cam followers, rotating axes, and utilization of mechanical linkage in place of cams, or vice versa, falls under the scope of this invention.

Size, shape and location of components shown was selected for clarity of illustration, and not to illustrate a preferred size or shape or location. Variations, which may be obvious to those skilled in the art, fall within the scope of this invention.

Mounting locations and axes of control arm, cams, cam follower, transposing hub, or linkage may be interchanged, reversed, or inverted from that shown.

In FIG. 21A or 23B, for example, where balancing spring 40 or harmonic dive bias spring 122 extending from rotating member 8 within the instrument body is shown anchored to base extension 119*b*, it should generally be clear that said spring may alternatively be anchored to the base 68 or to the body 25 in lieu of or in addition to standard bias spring 123.

In an alternative embodiment to FIG. 16H of the parent, the fine tuner 10*d* shown may alternatively pivot about a guide 6, as in figures Stops or other limiting devices may be relocated as desired.

String bearing means may serve also as bridge saddle means.

String guide means and string anchors may be combined into a single component or adjacent components, and ball cup anchor means may be pivotally suspended between guide means and bearing means.

The "substantially arcuate" adjusting path of string guides on a flat plate embodiment may include linear slots tangential to an arc as shown in FIG. 15, or discrete holes arranged in a suitable pattern.

Main rotating member pivot axis "substantially parallel" to the plane of the strings includes axes slightly oblique orientation to accommodate differences in crank length from lowE to highE.

Spring anchors shown in some drawings as rigid pins are schematic representations, and actual embodiments may be expected to include adjustable claw, or other spring adjustment means.

Bridge saddles preferably use grooved ball bearing saddles where the groove is preferably offset from the center of the bearing, as show in FIG. 32B thereby putting the balls in the ball race in a bind as shown in FIG. 32C. This binding action prevents rattle without increasing friction The term "vibrato" used in this specification and claims is intended to include temporary increase or decrease in string pitch with or without oscillation.

Where an activation mechanism is disclosed by way of illustration as it is applicable to a given vibrato device configuration, it should be understood that the invention is not limited to a vibrato of that style or rotating about that same axis, but includes any vibrato device configuration to which it applies.

Disclaimers

Where numbered elements in a figure are not described in the discussion of that figure, their basic descriptions may generally be taken to be substantially similar to elements of the same number described previously, where appropriate, and where the description is essential for understanding of the figure.

In most instances reference to a shaft element being oriented substantially normal to the string plane, for example, refers to the an angle at rest or neutral position, and encompasses any useable axis sufficiently askew to the standard vibrato fulcrum axis or the dive axis of the transport, for example, to allow rotation about one axis without interfering with rotation or stability about the other.

Pivot post brackets my be configured to include a fixed or adjustable (for example eccentric) post positioned to provide alignment of the moveable tailpiece in a direction parallel to a vector constructed between the pivot posts.

For figures related to electronic vibrato arm, it should be understood that at least one equivalent or alternative embodiment comprises a potentiometer as a rotation sensor.

Any single element or combination of elements disclosed herein whether from the same or different embodiments, falls within the scope of this disclosure. One or more elements of this disclosure may be combined with any known art or obvious improvement to create an embodiment falling within the scope of this disclosure.

It is to be understood that the illustrations, descriptions, and embodiments in this disclosure are by way of example only, and in no instance is any part of this disclosure intended to limit the scope of the disclosure or claims, regardless of the language used in the description.

Some of the embodiments described herein contain multiple novel features. Limitations which may be illustrated in the figures or described in the text of the specification, are not intended to limit the scope of the disclosure of any embodiment or of any claim or the use of a particular element to a given embodiment. A device incorporating some but not all of the teachings of a given embodiment falls within the scope of this disclosure. Each novel element described herein may be claimed individually. A device incorporating elements from two or more disclosed embodiments falls within the scope of this disclosure.

The location and orientation, of rotational axes, shafts, journals, cams and cam followers, transports, springs, and other disclosed mechanical components, and their association with other components of the devices disclosed are by way of example. It is understood that applying the teachings of this disclosure may involve change, interchange, reversal, or swapping of locations, orientations, and associations while maintaining the principles taught.

Any of the various methods available to scale the stretch of each string during actuation of a vibrato device, for example to maintain relative pitch, may be referred to as a proportioner.

A transport is preferably a mechanism allowing for displacement relative to a reference component of a first axis (associated with said transport) along or about a second axis, while resisting displacement of said first axis along or about other axes relative to said transport or relative to a reference component.

Pivot means disclosed or illustrated are for schematic illustration only, and it is understood that any pivot mechanism meeting the requirements of the device may be used, including knife edged fulcrum and journal and shaft. It is to be understood that illustration of any one pivot device does not amount to a disclosure of a preference for that device in any particular embodiment, unless expressly stated.

In every embodiment illustrated herein, it is understood that the type of springs and their attachment means and their location or orientation is by way of example only. Compressive springs, leaf springs, coil springs, torsion springs, or tensile springs may be used as may be appropriate. Where springs are illustrated without adjustment means, it is understood that any appropriate adjuster falls within the scope of the disclosure and claims.

The slope of a radial cam is generally expressed as dr/da where r is radius and a is angle of rotation. It should be understood that the sign of slope is generally a function of force direction, and not radius or height.

Device may be constructed of any solid material having adequate strength and rigidity. Polished plated steel is a preferred material for economical fabrication. Polished stainless steel is preferred material to eliminate a plating step in smaller lots.

Instruments fitted with the disclosed devices and methods of retrofitting existing instruments with the disclosed elements also fall within the scope of the invention.

I claim:

1. A device for altering string tension on a stringed musical instrument, said instrument configured to suspend at least two strings in tension above a structure defining a body, said device configured to engage at least two said strings and comprising, a first member moveable relative to a first base, and a second member moveable relative to a second member base, wherein each of said first and second members is configured to directly or indirectly engage each string of a first set comprising at least one string such that a said motion of said member relative to its respective base induces displacement relative to said base in the portion of said string engaged by said member, and further comprising a control lever configured to be rotated by a user about at least one control axis, wherein said lever is configured to directly or indirectly engage each of said first and second members, such that each of said first and second members is moveable simultaneously with the other relative to its respective base by said rotation of said lever, such that the tension in at least one string is altered to a degree substantially determined by the combination of said displacements caused by said simultaneous motion of said first and second members.

2. A device according to claim 1 wherein said first set comprises at least two strings, said device further comprising.

first and second bearing means, said first bearing means configured to substantially define said motion of said first member relative to said first base, said second bearing means configured to substantially define said motion of said second member relative to said second-member base,

3. A device according to claim 2 comprising a machine defining a compensator, said machine configured to engage said first member and a reference component such that a position of said first member is derived from a position of said reference component, wherein said reference component is said second member or said control lever.

4. A device according to claim 3, said second member comprising at least one proportioner, said at least one proportioner configured to differentially displace an engaged portion of each of at least two strings of said set when said second member is displaced relative to said second- member base, said compensator configured to cause motion of said first member relative to said first base in a direction of reduced string tension when said second member is moved relative to said second-member base in a direction of reduced string tension, said device comprising at least one adjuster configured to enable adjustment of said compensator to such a degree that said motion of said first member substantially offsets changes in said instrument dimensions resulting from said motion of said second member.

where said compensator comprises at least one component selected from the group consisting of cam, rocker, crank, lever, screw, and spring.

5. A device according to claim 2 said first bearing means configured to engage said second member with said first member in a manner defining said motion of said second member relative to first member, such that said first member defines said second-member base.

6. A device according to claim 5, wherein said second member comprises at least one string anchor configured to connect an end of at least one string of said set to said second member, such that said connection of said string to said second member defines said engagement of said first member with said string.

7. A device according to claim 5, said first or second bearing means comprising pivot means substantially defining at least one rotational axis, wherein said motion of at least one of said first and second members relative to its respective base is defined by rotation about a said axis.

8. A device according to claim 3, said device or said instrument comprising bridge means, wherein said first member comprises at least one sheave configured to engage at least one string of said first set at a location between engagements of said bridge means and said second member with said string.

9. A device according to claim 2, said second bearing means comprising pivot means substantially defining a main axis, such that a rotation of said lever in at least one direction about a said control axis causes a rotation of said second member about said main axis relative to said first member, where said first member defines said second-member base, said device further comprising at least one proportioner associated with said second member and at least one said string, where said at least one proportioner is configurable such that, said rotation of said second member about said main axis in at least one direction displaces the portion of a said string engaged by said second member to a degree differing from that of at least one other said string.

10. A device according to claim 3 wherein said compensator comprises a flexible cam, a cam follower, and at least one adjuster configured to deform said cam to a shape selected by a user, said cam and follower configured to urge motion of said first member relative to said first base in response to motion of said second member relative to said second-member base or in response to rotation of said lever in at least one direction.

11. A device according to claim 2, said first bearing means comprising inner and outer pivot means defining inner and outer axes, respectively, said first bearing means further comprising a crank defining a transport, said transport configured to connect said inner and outer pivot means, said outer pivot means configured to engage said first member with said transport, said transport configured to be pivotable in at least one direction about said inner axis from a home position, such that a rotation of said transport in a first direction from said home position moves at least a portion of said first member upward and in a direction of reduced string tension.

12. A device according to claim 1, wherein said first member is further configured to engage a second set of at least one string, and wherein said device further comprises a first stop, at least one spring configured to urge said second member in a direction of increasing string tension toward engagement with said first member at said first stop, such that, when said members are engaged at said first stop, motion of said first member causes motion of said second member relative to said first base, where rotation of said lever in a direction of increasing string tension beyond a critical angle causes said first member to move from engagement with said second member at said first stop, such that said second member moves in a direction of reduced string tension relative to said first member.

13. A device according to claim 12 comprising pivot means substantially defining first and second axes, said first and second members configured to be moved pivotingly about said first and second axes, respectively, said spring configured to urge rotation of said second member about said second axis, said device further comprising a second stop and/or a second-member anchor, said second-member anchor configured to attach a string of said first set to said second member, said second stop configured to substantially prevent rotation of said second member in a direction of increasing string tension beyond an angular limit relative to said first base, said second stop associated with an adjuster, said adjuster configured to position at least one surface of said second stop relative to said second member or to said first base.

14. A device according to claim 9 wherein means of said engagement of said first member with said lever comprises a compensator, and wherein rotation of said second member about said main axis or rotation of said lever about a control axis defines a reference motion, where said compensator is configured to urge a displacement of said first member relative to said first base in response to a said reference motion, where said apparatus further comprises at least one adjuster, and where at least one said adjuster is configured to enable said compensator to be characterized such that a said displacement of said first member by said compensator substantially offsets a change in said instrument dimensions resulting from rotation of said second member about said main axis.

15. A device according to claim 9, said first bearing means comprising pivot means substantially defining a first axis, wherein said first member is configured to be pivotable about said first axis such that an angular displacement of said first member about said first axis relative to said body results in an increase or decrease of in tension of a sting of said first set, where said rotation of said first member defines said motion of said first member relative to said first base.

16. A device according to claim 1, where a span of two said strings substantially defines a string plane, said device further comprising first control pivot means defining at least a first control axis, first and second pivot means substantially defining first and second axes, respectively said second axis and said first control axis configured to be substantially normal to said string plane when said device is at rest, said first member defining said second-member base, and said lever configured to engage said first and second members, such that a rotation of said lever in a first control direction about said first control axis causes said second member to move pivotingly about said second axis relative to said first member, and such that a rotation of said lever in a second control direction about said first axis causes said first member to move pivotingly about said first axis relative to said body, where said body defines said first base.

17. A biasing mechanism for association with a moveable component of a vibrato device, said moveable component configured to engage a set of strings such that motion of said moveable component relative to a base causes an increase or decrease in tension of said strings, said biasing mechanism comprising at least one cam, said cam or cams comprising a first and second operative cam surface, at least one cam follower, at least one spring configured to urge engagement of said first cam surface with a cam follower, where engagement of a said cam follower with said first or second cam surface defines a first or second cam engagement, respectively, where said moveable component is associated with a cam or cam follower of said first cam engagement, where said base is associated with a cam or cam follower of said second cam engagement, said device further comprising a control lever associated with at least one said cam and/or follower and configured to be pivotable about at least one control axis, such that a force applied to said lever urging rotation in a first or second control direction urges said first or second cam engagement, respectively, and further such that urging said lever in said first control direction urges said moveable component in a direction of increasing string tension, and such that urging said lever in said second control direction urges displacement of a cam or cam follower engaged in said first cam engagement in a direction opposed by at least one said spring, said displacement enabling motion of said moveable component in a direction of decreased string tension.

18. A mechanism according to claim 12, said mechanism further comprising a crank defining a transport, said control lever associated with a cam or cam follower from each of said first and second cam engagements, said control lever configured to be pivotable in said first and second control directions about a first control axis fixed relative to said crank, said crank pivotable about a second control axis, and a said spring configured to urge said crank about said second control axis in a direction of said first and second cam engagements, such that by said first cam engagement said spring urges said moveable component in a direction of increasing string tension, where said control lever is configured such that rotation of said lever in said first or second control direction is opposed by said first or second cam engagement, respectively.

19. A device to alter the tension of a string of a stringed instrument when said instrument is equipped with a vibrato mechanism comprising a component defining a main member pivotable about a main axis, said main member configured to alter the tension of multiple strings when pivoted about said main axis from an at rest position, said device comprising a lever and at least one stop, said lever configured to be pivotable from a first position to a second position relative to said main member, said lever configured to directly or indirectly engage a string such that pivoting said lever from said first to said second position when said main member is at rest alters the tension of a said string by an adjustably fixed interval, said interval defining a pitch interval, said lever and/or said main member comprising at least one guide configured to engage a string or intersect its axis at a radius from said main axis defining a radius of engagement such that motion of said lever from said first to said second position when said main member is at rest displaces a said string or its axis from a first radius of engagement to a second radius of engagement, the difference between said first and second radii defining a radius interval, said device comprising at least two adjusters, at least one said adjuster configured to enable a user to define the magnitude of said pitch interval when said main member is at rest, and at least one said adjuster configured to enable a user to define at least one of said first and second radii of engagement, such that each of said pitch interval and said radius interval are adjustably fixed.

20. A device according to claim 19, wherein at least one said adjuster is associated with at least one stop, said at least one adjuster and stop enabling a user to select a limit within the range of motion of said lever, said stop substantially preventing motion of said lever in at least one direction from at least one of said first and second positions.

21. A device for changing pitch in a stringed instrument, said instrument having multiple strings suspended in tension, said device comprising a main member pivotable about a main axis, said main axis substantially parallel to a bridge, at least two adjusters, at least two guides, each of at least two said guides defining a radius of engagement of said main member with a string or a string axis relative to said main axis, with at least two extenders, each of at least two said guides associated with an extender, each said extender configured to support a said guide in a position extended from said main member, at least one said adjuster configured to enable a user to alter a said radius of engagement by adjustment of the degree of extension of a said guide-and-extender combination relative to said main member, at least two surfaces of engagement between said extender and said main member defining a cam and cam follower, and said guide configured to engage a string or string anchor such that said string tension urges said cam and cam follower together, such that when said main member is at rest, adjustment of said extender causes said guide to follow a path defined in part by engagement of said cam with said cam follower.

22. A device according to claim 21, wherein said path has is substantially arcuate, having a focal axis substantially parallel to and between said main axis and said bridge.

23. A device according to claim 21 wherein said extenders are configured to cantilever said guides relative to said main member.

* * * * *